US008966674B2

(12) United States Patent
Lu et al.

(10) Patent No.: US 8,966,674 B2
(45) **Date of Patent: *Mar. 3, 2015**

(54) DISPENSING DEVICE FOR TOILET BOWL

(75) Inventors: Robert Zhong Lu, Hasbrouck Heights, NJ (US); Dana Moseson, Havertown, PA (US)

(73) Assignee: Reckitt Benckiser LLC, Parsippany, NJ (US)

( * ) Notice: Subject to any disclaimer, the term of this patent is extended or adjusted under 35 U.S.C. 154(b) by 1082 days.

This patent is subject to a terminal disclaimer.

(21) Appl. No.: 13/000,222

(22) PCT Filed: Jun. 23, 2009

(86) PCT No.: PCT/GB2009/001573

§ 371 (c)(1),
(2), (4) Date: Dec. 20, 2010

(87) PCT Pub. No.: WO2010/001092

PCT Pub. Date: Jan. 7, 2010

(65) Prior Publication Data

US 2011/0209276 A1 Sep. 1, 2011

(30) Foreign Application Priority Data

Jul. 3, 2008 (GB) ..... 0812141.0

(51) Int. Cl.
*E03D 9/02* (2006.01)
*E03D 9/03* (2006.01)
*C11D 17/00* (2006.01)

(52) U.S. Cl.
CPC ..... *E03D 9/032* (2013.01); *C11D 17/0056* (2013.01)
USPC ..... 4/223; 4/231

(58) Field of Classification Search
CPC ..... E03D 9/032; E03D 2009/021
USPC ..... 4/223, 231
See application file for complete search history.

(56) References Cited

U.S. PATENT DOCUMENTS

| | | | |
|---|---|---|---|
| 104,077 | A | 6/1870 | Strausbourgh, Jr. |
| 668,717 | A | 2/1901 | Rowell et al. |
| 849,978 | A | 4/1907 | Cox |
| 886,791 | A | 5/1908 | Gaines et al. |
| 1,815,197 | A | 7/1931 | Gamel et al. |
| 1,974,955 | A | 9/1934 | Foltis |
| 2,011,732 | A | 8/1935 | Saeks |
| 2,985,377 | A | 1/1958 | Saeks |
| 2,984,841 | A | 5/1961 | Wilson |

(Continued)

FOREIGN PATENT DOCUMENTS

| | | | |
|---|---|---|---|
| AT | 293965 | B | 11/1971 |
| CH | 675140 | A5 | 8/1990 |

(Continued)

OTHER PUBLICATIONS

English language abstract for EP1418225 which published May 12, 2004.

(Continued)

*Primary Examiner* — Tuan N Nguyen
(74) *Attorney, Agent, or Firm* — Norris McLaughlin & Marcus PA

(57) ABSTRACT

Cageless toilet dispensing devices for use in conjunction with a sanitary appliance particularly a toilet, and methods for their use.

12 Claims, 20 Drawing Sheets

(56) References Cited

U.S. PATENT DOCUMENTS

Figure 1:
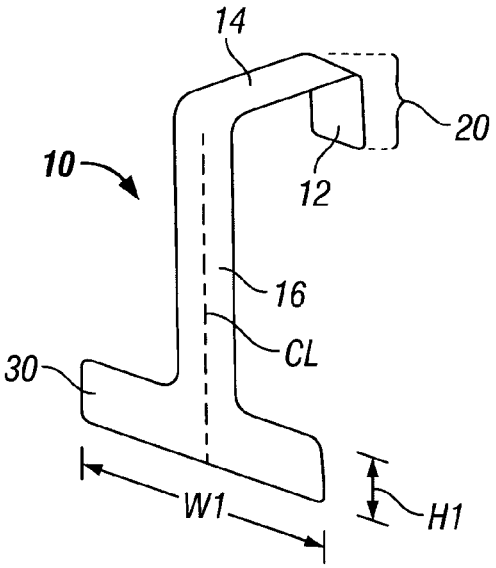

| | | | | |
|---|---|---|---|---|
| 3,088,126 | A | 5/1963 | Klingler | |
| 3,217,338 | A | 11/1965 | Wilson | |
| 3,290,699 | A | 12/1966 | Weinstein | |
| 3,604,021 | A | 9/1971 | Nolte, Jr. | |
| 3,668,717 | A | 6/1972 | Curran | |
| 3,675,254 | A | 7/1972 | Brownstein | |
| 3,694,354 | A | 9/1972 | Nolte, Jr. | |
| 3,943,243 | A | 3/1976 | Kook | |
| 3,947,901 | A | 4/1976 | Willert | |
| 4,067,946 | A | 1/1978 | Rickert | |
| 4,320,033 | A | 3/1982 | Yoshikawa | |
| 4,670,916 | A | 6/1987 | Bloom | |
| 5,206,959 | A | 5/1993 | Provenzano | |
| 5,449,473 | A | 9/1995 | Bunczk et al. | |
| 5,698,513 | A | 12/1997 | Schulz et al. | |
| 5,987,655 | A | 11/1999 | Smet | |
| 6,230,334 | B1 | 5/2001 | Camp et al. | |
| 6,517,761 | B2 | 2/2003 | Yoshida et al. | |
| 6,544,537 | B1 | 4/2003 | Mahaffey et al. | |
| 6,651,261 | B1 | 11/2003 | Leonard et al. | |
| 6,654,971 | B1 | 12/2003 | Middleton | |
| 7,056,873 | B1 | 6/2006 | Sidgwick et al. | |
| 2002/0035049 | A1 | 3/2002 | Suri et al. | |
| 2004/0216391 | A1* | 11/2004 | Papadaki et al. | 52/32 |
| 2006/0230576 | A1 | 10/2006 | Meine | |
| 2006/0246149 | A1 | 11/2006 | Buchholz et al. | |
| 2007/0039088 | A1 | 2/2007 | Nguyen et al. | |
| 2007/0092477 | A1 | 4/2007 | Cheung et al. | |
| 2007/0204389 | A1 | 9/2007 | Graefe et al. | |
| 2009/0119825 | A1 | 5/2009 | Wilson et al. | |
| 2009/0235443 | A1 | 9/2009 | Arora | |

FOREIGN PATENT DOCUMENTS

| | | | |
|---|---|---|---|
| CN | 1702240 | A | 11/2005 |
| CN | 1813111 | A | 8/2006 |
| DE | 89 06 140 | U1 | 11/1989 |
| DE | 8906140 | U1 | 11/1989 |
| EP | 0023059 | A1 | 1/1981 |
| EP | 0879877 | A1 | 11/1998 |
| EP | 1046755 | B1 | 10/2000 |
| EP | 1048687 | A1 | 11/2000 |
| EP | 1418225 | A1 | 5/2004 |
| GB | 460041 | | 1/1937 |
| GB | 813 392 | A | 5/1959 |
| GB | 2287712 | A1 | 9/1995 |
| GB | 2322632 | A | 9/1998 |
| GB | 2338496 | A | 12/1999 |
| GB | 2369377 | A | 5/2002 |
| GB | 2 407 825 | A | 5/2005 |
| GB | 2407825 | A | 5/2005 |
| GB | 2416784 | A | 2/2006 |
| JP | 2003-002733 | A | 1/2003 |
| WO | 9316242 | A1 | 8/1993 |
| WO | 9940169 | A1 | 8/1999 |
| WO | 2005052110 | A1 | 6/2005 |
| WO | 2006013318 | A1 | 2/2006 |
| WO | 2007107750 | A1 | 9/2007 |
| WO | 2007107755 | A1 | 9/2007 |
| WO | 2007107769 | A1 | 9/2007 |
| WO | 2007 148054 | A | 12/2007 |

OTHER PUBLICATIONS

English language abstract for JP2003002733 which published Jan. 8, 2003.

English language abstract for EP0879877 which published Nov. 25, 1998.

English Language abstract XP002452702 of CN1702240 taken from esp@cenet.

* cited by examiner

DISPENSING DEVICE FOR TOILET BOWL

This is an application filed under 35 USC 371 of PCT/GB2009/001573.

The present invention relates to improvements to a dispensing device. More particularly the present invention relates to a device used to deliver a treatment composition to a sanitary appliance, particularly to a toilet, which treatment composition contains one or more chemical constituents e.g., coloring agents, cleaning agents, disinfecting agents, anti-lime scale agents in the form of a block. The treatment composition is formed by water contacting the block of the device coming into contact with the one or more chemical constituents; the block provides for the long term release of the one or more active agents during sequential contacts with water contacting the block of the toilet dispensing device.

Since the advent of sanitary appliances and in particular modern flush toilets, there has been a continuing need in the art to provide effective ways to maintain these appliances in a satisfactory condition between uses. The art is replete with devices which are intended to be used as "in the bowl" (or ITB) or "in the cistern" (or ITC) in order to provide a coloring and/or cleaning and/or fragrancing and/or sanitizing effect to such sanitary devices, particularly toilet bowls.

One common approach known to the art is to provide a device which is at least immersed within the cistern or tank of a toilet, which may be either placed wholly within the interior of the toilet such as by placement at the bottom of a toilet tank so that the entire device is wholly immersed in water when the tank is full, or is at least partially immersed within the water present in a toilet tank, such as wherein such a device is suspended from a part of the toilet tank, such as a lip or rim of the tank. Such are generally referred to as ITC devices.

A further common approach known to the art is to provide a device which is suspended from the rim of the toilet bowl and which is placed at or near the interior sidewall of the toilet bowl. Such are generally referred to as ITB devices. Such a device is designed to typically dispense a treatment composition to the interior of a toilet when a gel or block compositions is contacted with flushing water, or alternately, dispensing a fragrancing composition to the toilet bowl which is intended to counteract or mask malodors. Typically such devices include a hanger portion which is used to suspend a cage portion from the rim of the toilet bowl, such that the cage portion is positioned within the path of flowing water which is dispensed with each flush operation of the toilet. The cage portion typically comprises a plurality of holes or apertures which permit for the flush water to both enter and to exit the cage portion of the device. Typically a solid block composition or a gel composition is present within the cage. The cast solid block composition and/or gel composition typically comprises one or more cleaning constituents, e.g., one or more surfactants which provide a good cleaning and/or foaming benefit. Often the cast solid block composition and/or gel composition comprises a fragrance constituent as well which is provided to provide some degree of malodor suppression. For most such devices, the use of a cage is essential as in the case of a gel compositions, as gels are not self supporting and would not be useful without the physical supporting structure provided by the cage. With regard to solid block compositions, such compositions are notoriously prone to weakening and softening over time and most are known to sell or sag over their lifetime, particularly when approaching the end of their useful service life. The cage acts then as a porous receptacle and support for said blocks which would otherwise prematurely soften or disintegrate and fall into the toilet bowl and be flushed away before their composition is substantially consumed.

While the use of a cage is beneficial, the use of a cage is not without attendant problems. The use of a cage requires increased material costs, and additional manufacturing steps. Further as such ITB devices are typically single use type devices, once the gel or block composition is consumed or otherwise exhausted, the consumer discards the entire ITB device which is wasteful and contributes to the problems associated with proper garbage disposal. With regard to costs, in most conventional rim suspended lavatory devices comprising a hanger portion and a cage portion, the bulk of the material is typically used to form the cage. As such cages are typically fabricated from a synthetic polymer, such requires specific molding operations in order to form the rim suspended lavatory device, and to fill the cage with the cast solid block composition and/or gel composition prior to use and or sale.

Known to the art are rim suspended lavatory devices which are lavatory blocks of paradichlorobenzene which provide no cleaning benefit, but provide only a fragrancing benefit. Such blocks typically erode per sublimation of the paradichlorobenzene and/or by contact with flush water. Such rim suspended are lavatory blocks of paradichlorobenzene are typically packaged as a solid block or cake having extending from one side a loop of bendable wire. A portion of the bendable wire is embedded within the paradichlorobenzene block. The consumer is required to form the wire into a hanger appropriate to the particular geometry of their toilet so that the paradichlorobenzene block is positioned with the interior of the toilet bowl.

Also known to the art are the devices disclosed in (commonly assigned) PCT applications: PCT/GB2007000999 and PCT/GB2007001008 which described certain cageless lavatory dispensing devices which include solid block compositions which are formed by extruding a mass(es) of a lavatory treatment composition, and thereafter stamping or compressing the extrudate in a die or pair of dies in order to densify the cast solid block compositions and to attach them to a hanger. While said devices function adequately, it has been observed that the compositions may be inadequately stable for long periods of storage at high temperatures wherein it has been observed that the cast solid block compositions may be deformed or slump when packaged. It has also been observed that rough handling of the said devices when packaged in blister-type packaging may suffer deformation at contact points with the blister-type packaging which is unattractive from a consumer standpoint. Such deformation is due to the fact that the device is inserted within a cavity of the blister, but is otherwise free to move within the cavity. Depending upon the configuration of the cavity and that of the stamped block compositions there may be one or more contact points, such as at edges of the stamped solid block compositions, the device moving within the confines of the cavity may be deformed, or smear at such contact points which provides for an unattractive appearance, and depending upon the composition of the block and that of the ambient temperature of the environment wherein the device is removed from the blister-type package, may also provide for undesirable sticking or adhesion between the blister of the package and the stamped solid block compositions.

Thus, while certain known-art dispensing devices provide beneficial treatment effects, there is nonetheless a real and continuing need in the art to provide still further improved devices which can provide to a sanitary appliance a useful treatment benefit, preferably a useful cleaning benefit, and which overcome one or more of the shortcomings of prior art devices.

The present invention, in its various aspects, provides a lavatory dispensing device useful for the delivery of at least one treatment composition, preferably a cleaning composition and/or a sanitizing composition to a sanitary appliance, e.g. a toilet bowl. The device can be used either as an ITC type device, or an ITB type device for a sanitary appliance such as a urinal, toilet tank or toilet bowl. In certain preferred embodiments the device according to the invention is used as an ITB type device. In certain alternate preferred embodiments the device according to the invention is used as an ITC type device.

According to a first aspect of the invention there is provided a cageless lavatory dispensing device comprising a hanger and a cast solid block comprising one or more chemical constituents for use with a sanitary appliance, preferably a toilet.

According to a second aspect of the invention there is provided a cageless lavatory dispensing device comprising a hanger having a hook end adapted to be suspended from a part of a sanitary appliance, particularly the rim of a toilet bowl, and a cast solid block comprising at least one chemical constituent adapted to be suspended within the interior of the sanitary appliance. The dimensions and configuration of the cageless lavatory dispensing device are such that the cast solid block comprising the one or more chemical constituents are preferably positioned within the path of flushing water which is released or dispensed by the sanitary appliance.

According to a third aspect of the invention there is provided a cageless lavatory dispensing device comprising a hanger having a part adapted to be suspended from a part of a sanitary appliance, and a cast solid block comprising one or more chemical constituents, wherein the device is adapted to be suspended within the interior of the toilet bowl.

In accordance with a fourth aspect of the invention there is provided a cageless lavatory dispensing device comprising a hanger adapted to be suspended from the rim of a sanitary appliance, particularly a toilet bowl, and block comprising at least one or more chemical constituents adapted to be suspended within the interior of the toilet bowl, wherein the block composition is cast from one or more fluidified chemical constituents, and subsequently solidified.

According to a fifth aspect of the invention there is provided a process for delivering a treatment composition to a sanitary appliance, especially preferably, to the interior of a toilet bowl, which process comprises: providing a cageless lavatory dispensing device comprising a hanger adapted to be suspended from a part of a sanitary appliance, and a cast block comprising at least one or more chemical constituents adapted to be suspended within the sanitary appliance, and, periodically flushing water about the exterior of the cast block to elute at least one chemical constituent to form a treatment composition with said water which treatment composition is used to treat a part of the sanitary appliance.

According to a sixth aspect of the invention there is provided a process for delivering a treatment composition to a to the interior of a toilet bowl, which process comprises: providing a cageless lavatory dispensing device comprising a hanger adapted to be suspended from a part of a toilet bowl, preferably the rim thereof, where the device further comprises a cast block comprising at least one chemical constituent, said cast block adapted to be suspended within the interior of the toilet bowl, and, periodically flushing water about the exterior of the cast block to elute or release at least one chemical constituent so to form treatment composition with the water which is used to treat at least the interior of the toilet bowl.

According to a seventh aspect of the invention there is provided a cageless lavatory dispensing device comprising a hanger having a part thereof adapted to be suspended from a part of a sanitary appliance, particularly from a part a toilet cistern or toilet tank, and a cast solid block comprising one or more chemical constituents, wherein the device is adapted to be suspended within the interior of said cistern or tank.

In accordance with a eighth aspect of the invention there is provided a cageless lavatory dispensing device comprising a hanger adapted to be suspended from the rim of a sanitary appliance, particularly a part of a toilet cistern or toilet tank such as from a part of a rim of a toilet cistern or toilet tank comprising at one or more chemical constituents adapted to be suspended within the interior of said cistern or tank, wherein the block composition is long lasting.

According to a ninth aspect of the invention there is provided a process for delivering a treatment composition to a sanitary appliance, especially preferably, to the interior of a toilet cistern or toilet tank, which process comprises: providing a cageless lavatory dispensing device comprising a hanger adapted to be suspended from the rim of a sanitary appliance, particularly a part of a toilet cistern or toilet tank such as from a part of a rim of a toilet cistern or toilet tank, and a cast block comprising one or more chemical constituents adapted to be suspended within the said cistern or tank, and, periodically immersing the exterior of the cast block in the water within the cistern or tank so to elute at least one chemical constituent to form a treatment composition with the water which is used to treat a part of the sanitary appliance.

According to a tenth aspect of the invention there is provided a process for delivering a treatment composition to a to the interior of a toilet bowl, which process comprises: providing a cageless lavatory dispensing device to the interior of a toilet cistern or tank comprising a hanger adapted to be suspended from a part of the toilet cistern or tank, preferably from a part of the rim thereof, where said device further comprises a cast block comprising at least one chemical constituent adapted to be suspended within the water within the cistern or tank so to elute at release at least one chemical constituent and to form a treatment composition therefrom which is used to treat at least the toilet cistern or tank, and preferably to also treat the interior of the toilet bowl when the treatment composition formed is used to flush the toilet bowl.

In accordance with a still further aspect of the invention there is provided as a vendible article, a cageless lavatory dispensing device comprising a hanger and a cast solid block comprising one or more chemical constituents for use with a sanitary appliance, particularly a toilet.

In accordance with a yet further aspect of the invention there is provided as a vendible article, a cageless lavatory dispensing device comprising a hanger having a standoff section and a cast solid block comprising one or more chemical constituents for use with a sanitary appliance, particularly a toilet.

According to a still further aspect of the invention there is provided a process for the production of a cageless lavatory dispensing device comprising a hanger and a cast solid block comprising one or more chemical constituents for use with a sanitary appliance, preferably a toilet, which process includes the steps of:

fluidifying one or more of the chemical constituents in order to form a fluid, e.g. pourable and/or pumpable, castable solid block composition, pouring the same into a cavity containing a part of hanger, and subsequently permitting the constituents to solidify so to at least partially encase or enrobe a part of the hanger and to form a cast solid block from the prior fluidified castable solid block which is sufficiently hard and rigid that it may be removed from the cavity into which it was introduced.

Preferably the cast solid blocks are formed without a compression or densification step, although the cast solid blocks, once they have hardened or otherwise solidified may be subsequently stamped on part of their surface, e.g., to impress upon or indent within a symbol, logo or legend such as in written or pictoral form.

These and other aspects of the invention will be more evident from a reading of the following specification.

It is to be understood that in this specification and with reference to the invention, the terms "cast block", "cast solid block" are used interchangeably. Further, a "cast solid block" as well as a "cast solid block composition" may be formed from a "castable solid block composition" which comprises one or more chemical constituents which elute from the cast solid block form a treatment composition with water which treatment composition is used to treat a part of the sanitary appliance.

Broadly defined, the present invention provides a cageless lavatory dispensing device comprising a hanger and a cast solid block comprising one or more chemical constituents for use with a sanitary appliance, as well as methods for its use of the cageless lavatory dispensing device in the treatment of sanitary appliances, particularly toilets.

The inventors have surprisingly found that notwithstanding the existing prejudice in the prior art which dictates the use of cages to support and contain lavatory treatment blocks, that it has been discovered by the inventors that it is now possible to fabricate cageless lavatory dispensing devices which comprise a hanger and a cast solid block composition depending from the hanger which solid block compositions comprise one or more chemical constituents, preferably at least a surfactant composition, which cageless lavatory dispensing devices are useful in providing a treatment composition to a sanitary appliance over repeated flushes of water and/or repeated immersions in water wherein the cast blocks to not fall away from or break away from the hanger for a reasonable duration of time. This result is unexpected as the prior art dictates the use of a cage as previously described, and as is also widely known in the art to support a lavatory block composition over its useful lifespan, particularly wherein the lavatory block comprises one or more surfactants. As is known to the art, with repeated flushes of water, many such surfactant containing lavatory blocks tend to swell and/or soften and very frequently disintegrate or slump, thus requiring a cage to contain the lavatory block. Alternately as is known in the art, with long term immersion in water such as in a toilet cistern or toilet tank, such surfactant containing lavatory blocks tend to swell and/or soften and very frequently disintegrate or slump, thus requiring a cage to contain the lavatory block.

The inventors have discovered that cageless lavatory dispensing devices which comprise a hanger and a cast solid block composition depending from the hanger which solid block compositions include one or more chemical constituents, preferably at least a surfactant composition, may be formed by a process which contemplates: (a) forming a pourable mass comprising at least one or more chemical constituents; (b) providing a cavity which is adapted to contain both a part of a hanger and a quantity of the pourable mass, and (c) supplying an quantity of the pourable mass to the said cavity and allowing it solidify such that it at least partially enrobes or encases, preferably completely enrobes or encases part of the hanger present in the cavity, and thereby form the cageless lavatory dispensing device. Subsequently the cageless lavatory dispensing devices may be removed from the cavity and packed for storage, or in certain preferred embodiments the cavity is part of the cavity of a blister-type package, such that the ultimate product consumer may remove the cageless lavatory dispensing device from the blister of the product package. The cast solid blocks are retained on a part of the hanger without the need of an enclosing cage, as well as without the need of any separate adhesive material or composition which is placed between the cast solid block and the part of the hanger which the cast solid block contacts.

In its simplest form the hanger is merely an article which comprises at one end, a hook end which is adapted to or configured to suspend the hanger from a part of a sanitary appliance. The hanger is preferably configured so to permit its use either as an ITB device or as an ITC device. The hanger also includes an element, preferably a plate, which is adapted to be embedded within the cast solid block composition. While the hook end may be integrally formed and proximate to the plate, quite frequently the hanger includes an intermediate stalk connecting the hook end with the plate. The hanger itself may be a single element of a unitary construction, or alternately, may be formed from a plurality of elements which are adapted to be linked or connected together. When the hanger is formed from two or more such discrete elements, the individual elements can be affixed, attached, or linked together to ultimately form the hanger of the invention. The cageless lavatory dispensing device of the invention may be provided as a multiple-use article, wherein the consumer retains a part said device on the sanitary appliance, but replaces a part of the said device periodically as may be needed. In such a configuration, usually a part of the hanger is retained and reused by a consumer, but upon consumption of the cast solid block, a new cast solid block is provided to the sanitary appliance where it may be removably affixed to the retained part of the cageless lavatory dispensing device. Most conveniently however the hanger is a single piece article.

With regard to the hook end, it is to be understood that the hook end of the hanger can be of any configuration which is suitable to provide a hook-type support for suspending the plate and the cast solid block within the interior of a sanitary appliance. Ideally, the hook is configured such that it is adapted to be suspended over at least a part of the rim of sanitary appliance. Such may be a rim of a urinal, a toilet bowl, or toilet cistern or tank. The hook may be of any suitable dimension, and as it is understood that as the configuration and geometry of sanitary appliances vary, naturally the hook can be adapted to suit the particular dimensional or geometric configurations of toilets. Alternately and preferably the hook end is flexible and configurable to adapt to various configurations and geometries so that it may be used with different sanitary appliances. Typically however, the hook end may be configured into a "U" shaped portion of the hanger such that it may be used to suspend the hanger and plate bearing the cast solid block composition.

The hook may be provided in a rigid, preformed configuration which is non-flexible or only sparingly flexible in order to accommodate the dimensions of the hook to a particular sanitary appliance. For example wherein the hook is provided as a rigid, preformed configuration to be used in suspending the cageless lavatory dispensing device in an ITC application the hook may be a discrete element which is dimensioned to have a cross-section which in adapted to accommodate a part of the upper rim or edge of a toilet cistern or toilet tank. Such a hook may merely suspend the device on the rim, or the hook may be configured so that when applied to the part of the upper rim or edge of a toilet it functions as a mechanical clip such that it is generally retained at its point of installation and resists accidental misplacement or movement. Additionally or alternately such a hook may further include a connector element which may take any physical shape or form and which is configured to cooperatively connect with a the remaining element or elements of the cageless lavatory dispensing device so that said remaining element or elements may be removably affixed to such a hook. In such manner, the hook may be retained although the remaining elements, viz., the plate bearing the cast block and/or the stalk may be replaced a number of times once the cast block is exhausted. Any suitable mechanical or chemical fastener means may be used to provide such a function. By way of non-limiting example may be used any of a number of cooperating mechanical elements such as clips, hook-and-loop fasteners, pins, springs, elastic bands, loops, eyelets as well as chemical means including adhesives such as light or medium duty adhesives may be used as the fastener means. Other fastener means not elucidated herein but known to the art may also be used. In one preferred embodiment the hook includes a part which includes a mortise shaped element, which cooperates with the stalk or plate which is configured as a cooperating tenon which is removably insertable into the mortise shaped element. In another preferred embodiment the hook includes a peg or hook, and the stalk or plate includes a cooperating loop or eye from which the stalk and/or plate bearing the cast block may be suspended. The use of such two-part embodiments of the inventive cageless lavatory block is in certain embodiments of the invention preferred as such provide a great deal of flexibility and also permits for the reuse of at least one element of the cageless lavatory dispensing device multiple times without requiring replacement of the complete cageless lavatory dispensing device when a cast lavatory block is exhausted. Thus is certain embodiments, certain elements of the cageless lavatory dispensing device may be reused, while others are intended to be single-use elements.

Conveniently however, the hook end is provided as one or more articulated elements which can be flexed or bent from a first or a "folded" configuration to a second or "open hook" configuration. It is to be understood that according to preferred embodiments, in order to minimize the volume of the hanger and in particular the hook end thereof, the hanger may be provided in a collapsed or folded configuration when placed into a package. Upon opening of the package, the consumer is then expected to easily unfold, extend, or otherwise stretch a portion of the hanger in order to form the hook end. A further important advantage is that the degree of flexibility provided into the hanger in order to provide for such a foldable and unfoldable hook end also introduces a degree of tension when the hook end is configured to be hung upon a sanitary appliance, and in particular the rim of a urinal, a toilet tank or cistern, or the rim of a toilet bowl. In such a configuration, the tension actually aids in the gripping of the hook upon the portion of the sanitary appliance upon which it is originally positioned by the consumer. Such tension reduces the likelihood of lateral movement or translation from its initial placement by a consumer unless desired by the consumer. Thus, specific placement of the cageless lavatory dispensing device, and a reasonable expectation that it will be retained at or near the position in which it was originally installed by a consumer relative upon a sanitary appliance is provided. Furthermore, the tension provided also provides for a degree of resiliency and also aids in the positioning of the cast solid block at, or near, a specific part of the sloping interior wall of a sanitary appliance, e.g., a toilet bowl. Such can be beneficially particularly due to the fact that flush water from the toilet bowl typically exits from beneath the rim. Utilizing the tensile property of the hanger, the continuous positioning of the cast solid block within the path of the flowing flush water is assured under most circumstances.

As has been noted above, in certain preferred embodiments and indeed, according to most preferred embodiments a stalk exists to connect the plate with the hook end of the hanger. The stalk itself may be of any dimension or length, however when used in an embodiment of the invention wherein the device is an ITC type device, desirably the stalk is of sufficient length to ensure that the cast block will be at least partially immersed, but preferably wholly immersed, in the water present in the toilet tank or cistern between flushes. When the stalk is used in an ITB type device, advantageously once the hook end is suspended upon a sanitary appliance, particularly the rim of a toilet bowl, the stalk extends a sufficient length to the plate such that ultimately, the positioning of the hook and the length of the stalk as such that the cast solid block enrobing the plate is positioned in the path of the flush water. Again, the dimensions and in particular the length of the stalk can be varied in order to meet the specific requirements of a specific configuration of a sanitary appliance, particularly in the case of a toilet bowl, the distance from the top of the rim downwardly into the interior of the toilet bowl, or in the case of a cistern or tank, the distance from the top of the rim of the tank or cistern downwardly such that the plate intersects or is beneath the waterline of the water present in the tank or cistern between flushes. For example, when used as an ITB device, in toilets typically found in use in North America, the interior sloping walls of the toilet bowl are typically of a smaller and a more circular radius, thereby providing a "shallower" distance between the top of the rim of the toilet bowl, and the sump or water outlet at the bottom of the toilet bowl. In such a circumstance, a shorter stalk length is typically adequate in order to ensure that the cast solid block is placed within the path of the flush water. In European toilets, typically, the configuration of the toilet bowl and its sloping walls are usually in the form of a more frusto-conical configuration, thus providing a "deeper" toilet bowl as measured from the rim to the top level of the water in the sump. In such configuration, frequently, a longer stalk length then would be required for a North American toilet is typically preferred. Of course, different configurations of other toilet bowls are contemplated as well.

The hanger is used to support the cast solid block composition, and accordingly part of the hanger is adapted to be embedded and/or enrobed within the cast solid block composition. While the cast solid block composition may depend from any part of the hanger, preferably the cast solid block composition encases a part of the hanger other than the hook end thereof, and advantageously encases a part of the stalk, preferably a part of the stalk which is distal to the hook end of the hanger.

The hanger of the invention desirably necessarily includes a retention element which is useful for retaining the cast solid block composition on the hanger. Such may take any of a number of forms, such as, e.g., shafts, plates, perforated plates, loops, rings, barbed shafts, spheres, one or more discs or other elements which extend at an angle to, or generally perpendicularly to part of the hanger, or any other configuration which is found to be effective. Most preferably the retention element is a plate which is adapted to be embedded and/or enrobed within the cast solid block composition. The plate itself is proximate to or at the end distal to the hook end of the hanger and typically is integrally formed with the stalk, or where a stalk is not provided, with the hook end of the hanger. The plate itself may be essentially of any useful configuration, but desirably, the plate is dimensioned such that it is completely encased by the cast solid block composition. Conveniently, the plate has a geometry which is symmetrical about the longitudinal center line or axis of the stalk and/or hook and depends directly from the stalk where present, or from the end of the hook end of the hanger. Conveniently, the plate is generally of a flat, planar configuration, and has a uniform thickness across its surface. However, it is also contemplated that the plate may include regions of diminishing thickness i.e. such as tapered sections or margins at or near the boundaries of the plate.

The retention element, itself need not necessarily be limited to a generally planar, and generally two-dimensional configuration, such as the plate, but may include elements or sections which extend outwardly from the top and/or bottom surfaces of the plate, such as in the form of one or more pegs, studs, pins, fins, rods, loops or the like which might be useful in providing further physical support between the retention element, e.g., plate, and the cast solid block composition enrobing it. Such may provide one or more extended elements which extend outwardly from the retention element, or which extend inwardly or through part of the retention element, especially where the retention element is generally planar such as in the form of a plate. Alternately, the plate may include one or more perforations passing therethrough whereby, upon casting adjacent portions of the cast solid block composition meet and pass through one or more perforations which may be provided within the retention element.

The retention element, when in the form of plate itself may be of any configuration and when in a planar form can be square, rectangular, triangular, polygonal, ellipsoid, circular, oblate, or for that matter any configuration which may be embedded within the interior of the cast solid block. Alternately, the retention element (and/or part thereof) may be one or more elements such as rods or tubes, which depend from and extend outwardly from the stalk, or be part of a retention element, e.g., plate or other retention element. While the thickness of the plate may vary, preferably it is between 0.05-3 mm thick, preferably between 0.1 and 2 mm thick, and most preferably between 0.25 and 1.5 mm thick. The thickness of the plate may vary across its surface, and in certain embodiments the thickness of the plate decreases across its dimensions with the thickest portion of the plate being near its geometric center, and the thinnest parts of the plate being one or more of the margins or peripheral sections of the plate. Such may be used to form a plate of tapering dimensions. Preferably however the plate is of generally uniform in thickness with at least 90%, preferably at least 95% of its surface being of a constant thickness with a variance of not more than +/−10%, preferably of not more than +/−5%. Still alternately a separate plate may be omitted and the cast solid block composition merely encasing or enrobing a part of the hanger, especially a part of the stalk.

Optionally the hanger of the invention also includes a standoff element. The standoff element may conveniently be a formed section of the hanger or stalk such that the standoff element is an integral part thereof. Alternately the standoff element may be a discrete element or discrete part of the hanger, preferably a part of the stalk when present in a hanger according to the invention. The standoff element may be provided preassembled or pre-affixed to the stalk or may require that such be attached by a user or consumer. The hanger standoff element may be positioned or located anywhere on the hanger, but is preferably located between the hook and the cast treatment block. Advantageously the hanger standoff element is positioned or located such that with respect to the total length of the hanger as measured from the end of the hook end, to the distal end of the hanger, the standoff element is within the lower half of this length. Preferably the standoff element is within the lower 40% of the distance, more preferably is within the lower 33% of this distance. In particularly preferred embodiments the standoff element is at a position proximate to or adjacent to the cast solid block encasing or enrobing a part of the hanger, or at a position proximate to or adjacent the retention means, e.g., the plate.

Optionally but in certain embodiments very preferably the hanger includes at least one peak section, preferably wherein the peak section is proximate to the retention means, e.g., plate. The peak section is preferably oriented with respect to the hanger such that the peak of the peak section is directed with respect to the center line of the hanger and/or stalk of the hanger such that the peak section is "generally coplanar" with the direction of the hook end of the hanger. By the term "generally coplanar" is to be understood that the angle formed between a first peak section reference plane, which is in turn a reference plane passing through the midsections of the first peak segment, second peak segment, and the peak, and a second hook reference plane which is in turn defined as a further reference plane defined by a plane passing through the center line of each section of the hook, and the center line of the hanger and/or stalk, is +/−20° or less, and in order of increasing preference +/−18° or less, +/−16° or less, +/−14° or less, +/−12° or less, +/−10° or less, +/−8° or less, +/−7° or less, +/−6° or less, +/−5° or less, +/−4° or less, +/−3° or less, +/−2° or less, +/−1° or less and especially preferably the first peak section reference plane and the second hook reference plane are coplanar. That being said it is also to be understood that the peak may be directed in a direction opposite to that of the direction of the end of the hook, or alternately, may be directed in the same direction as that of the direction of the end of the hook. Thus in certain preferred embodiments the direction of the peak of the peak section is either away from the sidewall of a lavatory appliance or alternately towards the sidewall of a lavatory when the cageless lavatory dispensing device is either packaged and/or when the cageless lavatory dispensing device is suspended upon a part of a lavatory appliance, e.g., a toilet bowl rim.

In certain embodiments, the peak section may also function as the standoff element, which in part depends upon the configuration of either the peak section and/or the standoff element, as well as the orientation of the peak section and/or the standoff element with respect to the hanger.

When a hanger is provided with a plate, the inventors have unexpectedly observed that the preferred configuration of the plate is a generally planar plate which has sloping top edges which are angled downwardly and form an obtuse angle with the center line (or center-axis) of the stalk or hook of the hanger, as measured from the points from which the edges of plate intersect the stalk or hook end. The downwardly sloping edges may be linear or straight-edged, or arcuate. The inventors have found that downwardly sloping edges are advantageous in resisting pooling of water, and permit for the runoff of water during the service life of the cageless lavatory dispensing devices when the cast solid blocks may have sufficiently eroded to expose part of the plate from within the interior of the said cast blocks. Surprisingly, the inventors have found that the best configuration for the plate is indeed a generally planar plate having a generally uniform thickness across its surface. The dimensions of the plate should be such that when considering the cross-sectional area of the plate with that of the cross-sectional laminar layer of the block within which it is positioned, the percent coverage of the plate area to the laminar cast solid block area should be not more than about 90%, more preferably the ratio is between about 10% and 90%, more preferably between about 20% and 80% of the surface area of the laminar layer or plane of the cast solid block composition within which the plate lies.

The inventors have also surprisingly found that while many plate configurations are possible, the longest service life of the cageless lavatory dispensing devices were observed with generally planar plates which were substantially embedded and enrobed within the interior of the cast solid block composition. The cast solid blocks do not require the use of an adhesive substance or material intermediate the plate and the cast solid block in order to retain the cast solid block on the faces of the plate. While not wishing to be bound by the following, it was theorized that when used as an ITB type device, during repeated flushes of water coming into contact with the upper surface of the cast solid block, viz, the region from which the stalk or hook end extends, minimal cracking or delamination of the regions of the block was observed. This ensured the longer term retention of the cast solid block composition upon the plate, and thereby the improved duration of the service life. Again, and while not wishing to be bound by the following theory, it is believed that the formation of miniscule channels in the within the cast solid block particularly in the locus of the stalk extending outwardly from the cast block which may have formed during repeated flush cycles, and these channels passing into the interior of the cast block formed cavities and/or otherwise soften the interior of the cast solid block in the region of such discontinuities in the plate, thereby mechanically softening the block and weakening its hold upon the plate. Similarly, it is also observed that when the plate had a more three-dimensional shape, that is to say included elements such as studs, or pins extending outwardly from one or more faces of the plate, that again, premature failure of the cast solid block compositions was observed. Again, it is believed that a similar phenomenon also occurred, namely in the formation of microchannels in the some portions of the cast block were formed, and provided for the flow of flush water into the interior of the cast block and to the region of the plate and particularly to the regions surrounding the extended studs or pins. Again, this was believed to be responsible for premature softening of the interior of the cast solid block, and its premature failure.

Thus, in particularly preferred embodiments, the plate configuration is absent any perforations, as well as being absent of any elements or protrusions extending outwardly from one or more faces of the plate.

Referring again to the standoff element, in embodiments of the hanger which comprise a standoff element, the standoff element is suitably dimensioned such that it is adapted to extend from the stalk or other part of the hanger in a direction rearwardly of the stalk, that is to say, in the direction which is coincident with the direction of the hook end relative to the stalk. Thus, when the cageless lavatory device is mounted on the rim of a toilet bowl or on the rim of a toilet cistern or toilet tank, the standoff element extends in generally the same direction as the hook end. Desirably this direction is also generally perpendicular, viz., 90°, +/−15° relative to the plane defined by the plate, where such a plate is also present as part of the hanger. The standoff element has a height dimension at which is forms a peak point which is the maximum distance from which it extends from the hanger, preferably the stalk. Desirably the height of the standoff element is such that when the cageless lavatory dispensing device is initially installed in a sanitary appliance, the height of the standoff element is sufficient to impede interfacial contact between the cast solid block and a sidewall or other part of a sanitary appliance adjacent to the said block, and/or when the said block is partially eroded due to dissolution or other cause the height of the standoff element is sufficiently great such that the peak point of the standoff element contacts the sidewall or other part of the sanitary appliance and acts to lift the cast solid block such that a gap is formed between the said sidewall or other part and the cast solid block. In certain embodiments, such occurs when less than 50% of the total mass of the cast solid lock, preferably when less than 65% of the cast solid block is eroded or dissolved. The formation of such a gap, particularly prior to the substantial erosion of the cast solid block is surprisingly advantageous from several technical perspectives. First, the formation of such a gap permits for the composition of the cast solid block to be out of contact with a wet sidewall between flush cycles when the cageless lavatory device is used in a toilet bowl. Such improves the service life of the cast solid block. Second, when the cast solid block includes a surfactant constituent, and is spaced-apart from the sidewall of a toilet bowl, during the flush cycle improved foam formation is observed to occur. While not wishing to be bound by the following the inventors believe that the gap between the surface of the cast solid block suspended on the hanger and the adjacent sidewall of the toilet bowl provides for some cavitation and air entrapment within this gap space during the flushing operation. Such is believed to improve the formation of bubbles and contribute to the generation of a more visible foam. Preferably the gap between the gap between the surface of the cast solid block suspended on the hanger and the adjacent sidewall of the sanitary appliance should be in the range of from 0.1 mm-10 mm, preferably 0.1-7 mm, still more preferably 0.2-5 mm, and most preferably 0.2-3 mm at the closest point between the block surface and the adjacent sidewall.

While it is understood that various configurations and geometries of the cast block compositions, as well as various configurations and geometries of the hanger and standoff element are possible, it is nonetheless preferred that the relative dimensions of these elements is such that when the cageless lavatory dispensing device which includes a standoff element is formed but has not been put into service, when the said device is laid upon a flat horizontal surface, the standoff element has a sufficient height such that the peak point is sufficient to raise at least a part of the rearward face of the cast solid block from contacting the horizontal surface. Preferably as well, after the lavatory dispensing device is put into service and installed in a sanitary appliance, preferably a toilet bowl and at least 50% of the mass is eroded, desirably the height of the standoff element is sufficient that the peak point contacts the surface of the sanitary appliance adjacent to the cast solid block and is sufficient to cause a gap of at least 0.2 mm, preferably a gap of between 0.2 and 5 mm between the closest point between the block surface and the adjacent sidewall.

In a particularly preferred embodiment the hanger includes a peak section, which is intermediate the two ends of the hanger, which peak section provides a configuration to part of the hanger such that it extends for a first peak segment outwardly from the center line or axis of the hanger, or stalk and/or hook where it terminates at a peak, and extending from the peak is a second peak segment which extends from the peak and inwardly from the center line or axis of the stalk and/or hook. The peak section may include parts or portions in excess of the said first peak segment and the second peak segment but such are usually unneeded. Preferably the peak section is a continuous part of, and more preferably is integrally formed as part of the hanger and especially as a part of the stalk of a hanger. Advantageously the peak section is directed to be oriented such that the peak extends outwardly from the center line or axis of the hanger, or stalk. Preferably the peak section peak extends outwardly from the center line or axis of the hanger, or stalk and is also in a direction which is "generally perpendicular" to the plate which is present according to preferred embodiments of the hanger. The term "generally perpendicular" is to be understood that the angle between a first reference line drawn from the peak towards the center line of the hanger, and equidistant between the first peak segment and the second peak segment, and a second reference line extending outward from and perpendicular to a plate reference plane which is defined as (i) a plane defined by the face of the plate nearest to the peak section, or (ii) a plane passing through the widest part of the retention element which plane also intersects the junction or point of connection between the retention element and the part of the hanger from which the retention element depends, is +/−45°, and in order of increasing preference is within +/−40°, +/−35°, +/−30°, +/−28°, +/−26°, +/−24°, +/−22°, +/−20°, +/−18°, +/−16°, +/−15°, but in accordance with certain further preferred embodiments is +/−13°, +/−12°, +/−11°, +/−10°, +/−9°, +/−8°, +/−7°, +/−6°, +/−5°, +/−4°, +/−3°, +/−2°, +/−1°, and most preferably +/−0°. The function of the peak section, as well as preferred configurations thereof, are discussed hereafter.

The hanger and where present, a standoff element and/or a peak section, whether provided as a single unitary piece or assembled from a composite of discrete pieces or elements, may be formed from any of a variety of materials which can be used for the purpose described herein. Exemplary and preferred materials include metals including wires or rods which are bendable and are preferably coated with flexible non-metallic material such as a flexible polymer, a paint or a sheath, as well as one or more synthetic polymers which are preferred. Preferably the hanger may be formed of any of a number of thermosettable or thermoformable synthetic polymers such as are widely used in casting or injection molding. Exemplary synthetic polymers such as polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers. Preferably the material of construction is at least somewhat flexible. As to the material of construction of the hanger, the only criteria being that the selected materials used to fabricate the hanger is not deleteriously affected by the chemical constituents of the cast solid block composition with which part of the hanger, viz., the plate and possibly part of the stalk. contacts.

The dispensing devices according to the invention may optionally include an air treatment dispenser which may be an article or element which forms part of the dispensing device of the present invention. The air treatment dispenser may be affixed to or form part of the hanger and provides for the release of a fragrance or other air treatment composition to the ambient environment of a toilet or other lavatory appliance, e.g. a lavatory or bathroom. The fragrance may be any composition which is known to the art to provide a perceptible fragrancing benefit, any may be based on naturally occurring materials such as one or more essential oils, or may be based on synthetically produced compounds as well. Examples of essential oils include pine oil, Anetlhole 20/21 natural, Aniseed oil china star, Aniseed oil globe brand, Balsam (Perui), Basil oil (India), Black pepper oil, Black pepper oleoresin 40/20, Bois de Rose (Brazil) FOB, Bomneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Counmarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen oil.

Many of these essential function as a fragrance agent, which fragrance agent which may be a substance or mixture of various substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrance agents are complex mixtures or blends various organic compounds including, but not limited to, certain alcohols, aldehydes, ethers, alamatic compounds and varying amounts of essential oils such as from about 0 to about 25% by weight, usually from about 0.05 to about 12% by weight, the essential oils themselves being volatile odiferous compounds and also functioning to aid in the dissolution of the other components of the fragrance agent. In the present invention, the precise composition of the fragrance agent desirably emanates a pleasing fragrance, but the nature of the fragrance agent is not critical to the success of the invention.

In addition to a fragrance or in place thereof, the air treatment dispensers may be used to deliver one or more further compositions or constituent which provide a further or different air treatment benefit. Such may be any other material which is useful in providing treatment of ambient air, such as a sanitizing agents. e.g., one or more glycols or alcohols, or materials which are intended to counteract, neutralize, or mask odors in the absence of, or in conjunction with, the fragrance composition of the present invention. Alternatively, the air treatment constituent may be one or more materials which provide and effective insecticide repelling or insecticidal benefit; such would be particularly useful in climates or environments where insects present a nuisance or health hazard According to certain preferred embodiments of the invention, the fragrance composition or other air treatment composition is associated solely with the air treatment dispenser of the invention. In this preferred that such an air treatment dispenser containing a fragrance composition or other air treatment composition be positioned with respect to a sanitary appliance, particularly a toilet bowl, such that the air treatment dispenser does not come into contact with water during the useful life of the device. This provides several simultaneous benefits including, the longevity of the fragrance composition, the improved delivery characteristic of the fragrance composition which does not become submerged or diluted with water associated with the sanitary appliance, as well as the fact that a much broader range of fragrance compositions (or other air treatment compositions as noted above) can be utilized as, there is no concern regarding the compatibility of fragrance with the materials in the cast solid block composition. Furthermore, the utilization of the fragrance composition solely in conjunction with the air treatment dispenser also provides a constant release of the fragrance composition to the ambient environment of the sanitary appliance even when the sanitary appliance is not being the used. In the case where pleasant fragrance and/or odor masking composition is provided in the fragrance composition, a beneficial consumer perception of the use of the products can be realized. Alternately, where a sanitizing agent and/or an insecticidal agent is utilized as all or part of the fragrance composition of the air treatment dispenser, the continual benefits of continuous release of such agency may be provided. Advantageously the air treatment dispenser may be affixed to or form part of the hanger, preferably either on part of the stalk such that the air treatment dispenser faces the interior of the toilet bowl or other sanitary appliance or alternately the air treatment dispenser may be affixed to or form part of the hook end, preferably on a part thereof such that the air treatment dispenser is positioned on the exterior of the toilet bowl or other sanitary appliance. Alternately the air treatment dispenser may be an article which is removable from the hook end, such as wherein the hook end includes a fastener component and the air treatment dispenser includes a complimentary fastener component which provides means to affix the air treatment dispenser to the hanger. By way of non-limiting example, fastener components include, but are not limited to: hook-and-loop type fasteners (VELCRO®), clips, pins, snaps, adhesive strips, screw type fasteners as well as hook and eye type fasteners which may provide for removal of an replacement of the air treatment dispenser. By way of non-limiting example fastener components providing a permanent connection between the air treatment dispenser and the hanger include adhesives, spot welds, pins, rivets, screw-type fasteners and of course the air treatment dispenser may be integrally formed as part of the hanger.

The form of the fragrance composition or other air treatment composition provided in the air treatment dispenser can take any form including, liquid, solid, or gel form. Advantageously fragrance composition or other air treatment composition is provided as one or more of: a gel contained in a cavity, such as part of the air treatment dispenser or a removeable tray; a bottle or vessel which comprises a wick having one end extending into its interior which contains a quantity of the fragrance composition or other air treatment composition and the other end of said wick being exposed to the exterior of the bottle or vessel and into the ambient environment of the toilet or lavatory appliance; a canister or container such as a pressurized aerosol container or a pump supplied with a non-pressurized vessel or container, said container containing a quantity of the fragrance composition or other air treatment composition which may be manually dispensed by a consumer to the ambient environment of the toilet or lavatory appliance; as well as a film, sheet or fibrous pad or other porous substrate which contains a quantity of a fragrance composition or other air treatment composition which volatilizes into the ambient environment of the toilet or lavatory appliance. Preferably however, the fragrance composition or other air treatment composition is a gel system which is then deposited in a chamber or cavity present in the air treatment dispenser. The gel system can be formed by a variety of components known to those of ordinary skill in the art. For example, it can be formed from absorbents, starch based systems, modified celluloses, natural gums and other materials which can form a gel when the fragrance composition, aforementioned gel components, and water or hydrophilic solvents are mixed together. According to certain particularly advantageous embodiments of the invention the fragrance composition is a gel system as it is described in U.S. Pat. No. 5,780,527, the contents of which are hereby incorporated by reference.

The lavatory dispensing devices according to the invention necessarily also comprise a cast solid block comprising at least one or more chemical constituents such that when the block is immersed, rinsed or washed with water, said chemical constituents are eluted or dissolved into said water and forms a treatment composition which is useful in treating a sanitary appliance, and particularly a toilet tank or cistern or a toilet bowl. Such a treatment composition may provide a cleaning and/or sanitizing and/or disinfecting benefit to the toilet or other sanitary appliance being treated with the devices of the invention.

As chemical constituents the cast solid block may include any known art cleaning agents or cleaning constituents known to those of ordinary skill in the relevant art, and without limitation include one or more detersive surfactants selected from anionic, cationic, nonionic as well as amphoteric or zwitterionic surfactants. Certain detersive surfactants may also provide a dual role in providing detergency as well as a disinfecting effect, viz, certain cationic surfactants, which are described hereinafter as a disinfecting agent. These one or more cleaning agents or cleaning constituents may be used with or without other constituents being present in the cast solid blocks of the invention.

The cast solid block composition of the invention desirably comprises a surfactant constituent which may be one or more detersive surfactants. Exemplary useful surfactants include anionic, nonionic, cationic, amphoteric, and zwitterionic surfactants.

Exemplary useful anionic surfactants which may be used in the cast solid block composition of the invention can be broadly described as the water-soluble salts, particularly the alkali metal salts, of organic sulfuric acid reaction products having in their molecular structure an alkyl or alkaryl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic surfactants which can be employed in practicing the present invention are the sodium or potassium alkyl sulfates, especially those obtained by sulfating the higher alcohols ($C_8$-$C_{18}$ carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); paraffin sulfonate surfactants having the general formula $RSO_3M$, wherein R is a primary or secondary alkyl group containing from about 8 to about 22 carbon atoms (preferably 10 to 18 carbon atoms) and M is an alkali metal, e.g., sodium, lithium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium β-acetoxy- or β-acetamido-alkanesulfonates where the alkane has from 8 to 22 carbon atoms.

One preferred class of anionic surfactants are linear alkyl benzene sulfonate surfactant wherein the alkyl portion contains 8 to 16 carbon atoms, and most preferably about 11 to 13 carbon atoms. Such are sometimes referred to as alkyl aryl sulfonates. According to particularly preferred embodiments of the invention, the cast solid block compositions necessarily include an anionic surfactant.

A further preferred class of anionic surfactants are alpha olefin sulfonates, as well as salts thereof, e.g., alkali metal salts. Preferred are $C_8$ through $C_{22}$ alpha olefin sulfonates, particularly $C_{12}$ through $C_{18}$, and especially $C_{14}$, and $C_{16}$ alpha olefin sulfonates as well as blends of two or more thereof. According to particularly preferred embodiments of the invention, the cast solid block compositions necessarily include an alpha olefin sulfonate anionic surfactant.

A particularly preferred class of anionic surfactants are sarcosinates. Typically such sarcosinate surfactants are alkali metal salts of N-alkyl-N-acyl amino acids. These are salts derived from the reaction of (1) N-alkyl substituted amino acids of the formula:

$$R_1—NH—CH_2—COOH$$

where $R_1$ is a linear or branched chain lower alkyl of from 1 to 4 carbon atoms, especially a methyl, for example, aminoacetic acids such as N-methylaminoacetic acid (i.e. N-methyl glycine or sarcosine), N-ethyl-aminoacetic acid, N-butylaminoacetic acid, etc., with (2) saturated natural or synthetic fatty acids having from 8 to 18 carbon atoms, especially from 10 to 14 carbon atoms, e.g. lauric acid, and the like.

The resultant reaction products are salts which may have the formula:

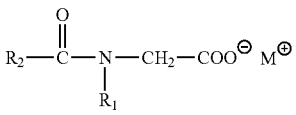

where M is an alkali metal ion such as sodium, potassium or lithium; $R_1$ is as defined above; and wherein $R_2$ represents a hydrocarbon chain, preferably a saturated hydrocarbon chain, having from 7 to 17 carbon atoms, especially 9 to 13 carbon atoms of the fatty acyl group

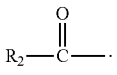

Exemplary useful sarcosinate surfactants include cocoyl sarcosinate, lauroyl sarcosinate, myristoyl sarcosinate, palmitoyl sarcosinate, stearoyl sarcosinate and oleoyl sarcosinate, tallow sarcosinate, myristoyl/stearoyl sarcosinates, as well as salts thereof such as sodium lauroyl sarcosinate, sodium cocoyl sarcosinate, and sodium myristoyl sarcosinates. Such sarcosinates are presently commercially available from Croda Inc., and are marketed as CRODASINIC surfactants.

In certain preferred embodiments, one or more anionic surfactants based on sarcosinates or sarcosinate salts are necessarily present in the cast solid block composition.

A further particularly preferred class of anionic surfactants which are desirably present as a detersive surfactant in the cast solid block composition are one or more compounds based on sulfates or phosphates of a branched alcohol, and/or ethoxylates thereof (sometimes referred to as branched alcohol surfactants) according to the following general formula A:

$$R—O-M \quad (A)$$

wherein: R is a branched alkyl chain having at least 9 carbon atoms, generally from 9 to 15 atoms, and at least two branches; O is an oxygen atom; and M is ($—SO_3X$), ($—CH_2CH_2O)_n—SO_3X$), ($—PO_3X$), or ($—(CH_2CH_2O)_n—PO_3X$), and mixtures thereof, where n is an integer of at least 1 and X is hydrogen or a cation, which is selected from the group consisting of sodium, lithium, potassium, calcium, magnesium, and amines including quartenary alkyl amines. Such compounds may be referred to as branched alkyl anionic surfactants.

The branched alkyl chain is derived from a branched alcohol having at least 3 carbon atoms and have at least two branches. Preferred alcohols contain a total of at least 6 carbon atoms, and preferably contain from 2 to 5 branches. Preferably, the branches are methyl branches, due to commercial availability, but may be other branches as well, e.g. ethyl, propyl, and the like. The alcohol may also contain a mix of various chain lengths' alcohols. Such mixed alcohol is suitable as long as the predominant alcohol in the mix contains a total of at least 3 carbon atoms and at least two branches. Sulfation of the branched alcohol involves the addition of a sulfate group to the branched alcohol. Phosphorylation of the branched alcohol involves the addition of a phosphate group to the branched alcohol. Ethoxylation involves first directly adding an ethylene oxide to the branched alcohol, followed by either sulfation of phosphorylation.

Specific and preferred examples of such branched alkyl anionic surfactants include the compounds according to the following general structure:

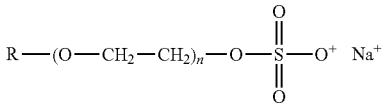

One such exemplary commercially available compound, DACLOR 70-1-23 AL is described to be a primary alcohol $C_{12}$-$C_{13}$ (1) ethoxylate, sulfate, sodium salt, wherein R is $C_{12}$-$C_{13}$, and n is approximately 1 in the foregoing formula. A further exemplary commercial compound, DACLOR 70-3-23 AL is described to be a primary alcohol $C_{12}$-$C_{13}$ poly (3) ethoxylate, sulfate, sodium salt, wherein R is $C_{12}$-$C_{13}$, and n is approximately 3 in the foregoing formula. Still further commercially available compounds include COSMACOL AES 70-2-24 NE, described to be a primary alcohol $C_{12}$-$C_{13}$ poly (2) ethoxylate, sulfate, sodium salt, wherein R is $C_{12}$-$C_{13}$, and n is approximately 2 in the foregoing formula, as well as COSMACOL AES 70-3-24 NE, described to be a primary alcohol $C_{12}$-$C_{14}$ poly (3) ethoxylate, sulfate, sodium salt, wherein R is $C_{12}$-$C_{14}$, and n is approximately 3 in the foregoing formula.

Advantageously, the castable solid block compositions necessarily comprise one or more branched alkyl anionic surfactants as they are observed to provide good foaming of the final cast solid block compositions. When present, the one or more branched alkyl anionic surfactants are advantageously present in an amount of from 0.01% wt. to 25% wt., more preferably in amounts of from about 1% wt. to about 20% wt., and especially from about 2.5% wt., to about 17% wt., based on the total weight of the castable solid block compositions of which they form a part. In certain preferred embodiments one or more branched alkyl anionic surfactants according to formula A are necessarily present.

The detersive surfactant constituent of the cast solid block composition of the invention may include one or more non-ionic surfactants. Practically any hydrophobic compound having a carboxy, hydroxy, amido, or amino group with a free hydrogen attached to the nitrogen can be condensed with an alkylene oxide, especially ethylene oxide or with the polyhydration product thereof, a polyalkylene glycol, especially polyethylene glycol, to form a water soluble or water dispersible nonionic surfactant compound. Further, the length of the polyethenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

One class of useful nonionic surfactants include polyalkylene oxide condensates of alkyl phenols. These compounds include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a $C_8$-$C_{10}$ straight-chain alcohol having an average molecular weight of 356, an ethylene oxide content of about 4.85 moles (about 60 wt. %), and an HLB of about 12; Alfonic® 810-2, which is described in product literature as a $C_8$-$C_{10}$ straight-chain alcohols having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are $C_{10}$ oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Muttenz, Switzerland) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

Exemplary useful nonionic surfactants include the condensation products of a secondary aliphatic alcohols containing 8 to 18 carbon atoms in a straight or branched chain configuration condensed with 5 to 30 moles of ethylene oxide. Examples of commercially available nonionic detergents of the foregoing type are those presently commercially available under the trade name of Tergitol® such as Tergitol 15-S-12 which is described as being $C_{11}$-$C_{15}$ secondary alkanol condensed with 9 ethylene oxide units, or Tergitol 15-S-9 which is described as being $C_{11}$-$C_{15}$ secondary alkanol condensed with 12 ethylene oxide units per molecule.

A further class of useful nonionic surfactants include those surfactants having a formula:

$$RO(CH_2CH_2O)_nH$$

wherein;

R is a mixture of linear, even carbon-number hydrocarbon chains ranging from $C_{12}H_{25}$ to $C_{16}H_{33}$ and n represents the number of ethoxy repeating units and is a number of from about 1 to about 12.

Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3,26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3,24-L-45, 24-L-50, 24-L-60, 24-L-60N, 24-L-75, 24-L-92, and 24-L-98N, all sold under the Genapol® tradename.

Further useful non-ionic surfactants which may be used in the inventive compositions include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64.

Further nonionic surfactants which may be included in the inventive compositions include alkoxylated alkanolamides, such as fatty mono-alkanolamides, and fatty di-alkanolamides. These include but are not limited to: cocamide MEA, cocamide DEA, soyamide DEA, lauramide DEA, oleamide MIPA, stearamide MEA, myristamide MEA, lauramide MEA, capramide DEA, ricinoleamide DEA, myristamide DEA, stearamide DEA, oleylamide DEA, tallowamide DEA, lauramide MIPA, tallowamide MEA, isostearamide DEA, isostearamide MEA, and mixtures thereof. Two or more fatty alkanolamides may be used to in the cast solid block compositions of the invention. In certain particularly preferred embodiments, one or more alkoxylated alkanolamides are necessarily present in the cast solid block compositions, advantageously in amounts of from 0.1% wt.-25% wt., preferably 2% wt.-20% wt., more preferably 5% wt.-15% wt., based on the total weight of the cast solid block compositions of which they form a part.

One further useful class of nonionic surfactants include those in which the major portion of the molecule is made up of block polymeric $C_2$-$C_4$ alkylene oxides, with alkylene oxide blocks containing $C_3$ to $C_4$ alkylene oxides. Such nonionic surfactants, while preferably built up from an alkylene oxide chain starting group, can have as a starting nucleus almost any active hydrogen containing group including, without limitation, amides, phenols, and secondary alcohols.

One group of nonionic surfactants containing the characteristic alkylene oxide blocks are those which may be generally represented by the formula (A):

$$HO\text{-}(EO)_x(PO)_y(EO)_z\text{—}H \quad (A)$$

where EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, the alkoxy group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO\text{—}(BO)_n(EO)_X\text{—}H \quad (C)$$

wherein R is an alkyl group containing 1 to 20 carbon atoms, n is about 15 and x is about 15.

Also useful as the nonionic block copolymer surfactants which also include polymeric butoxy groups are those which may be represented by the following formula (D):

$$HO\text{-}(EO)_x(BO)_n(EO)_y\text{—}H \quad (D)$$

wherein n is about 15, x is about 15 and y is about 15.

Still further useful nonionic block copolymer surfactants include ethoxylated derivatives of propoxylated ethylene diamine, which may be represented by the following formula:

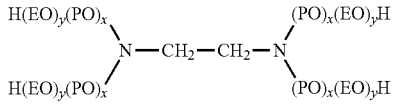

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound. Further useful nonionic surfactants include nonionic amine oxide constituent. Exemplary amine oxides include:

A) Alkyl di (lower alkyl) amine oxides in which the alkyl group has about 10-20, and preferably 12-16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

B) Alkyl di (hydroxy lower alkyl) amine oxides in which the alkyl group has about 10-20, and preferably 12-16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide;

C) Alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and D) Alkylmorpholine oxides in which the alkyl group has about 10-20, and preferably 12-16 carbon atoms, and can be straight or branched chain, saturated or unsaturated.

Preferably the amine oxide constituent is an alkyl di (lower alkyl) amine oxide as denoted above and which may be represented by the following structure:

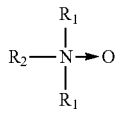

wherein each:

$R_1$ is a straight chained $C_1$-$C_4$ alkyl group, preferably both $R_1$ are methyl groups; and, $R_2$ is a straight chained $C_8$-$C_{18}$ alkyl group, preferably is $C_{10}$-$C_{14}$ alkyl group, most preferably is a $C_{12}$ alkyl group. Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{12}$ alkyl groups and at least 25% wt. of $C_{14}$ alkyl groups, with not more than 15% wt. of $C_{16}$, $C_{18}$ or higher alkyl groups as the $R_2$ group.

Still further exemplary useful nonionic surfactants which may be used include certain alkanolamides including monoethanolamides and diethanolamides, particularly fatty monoalkanolamides and fatty dialkanolamides.

A cationic surfactant may be incorporated as a germicide or as a detersive surfactant in the cast solid block composition of the present invention, particularly wherein a bleach constituent is absent from the cast solid block composition. Cationic surfactants are per se, well known, and exemplary useful cationic surfactants may be one or more of those described for example in *McCutcheon's Functional Materials, Vol.* 2, 1998; *Kirk-Othmer, Encyclopedia of Chemical Technology,* 4th Ed., Vol. 23, pp. 481-541 (1997), the contents of which are herein incorporated by reference. These are also described in the respective product specifications and literature available from the suppliers of these cationic surfactants.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

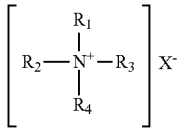

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

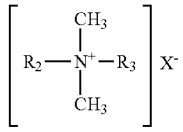

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, *McCutcheon's Functional Materials* (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYAMINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% active); BTC® 776 is described to be myrisalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTU®) 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymer.

Preferred quaternary germicides used in the cast solid block compositions are those which are supplied in a solid or powdered form, as such greatly facilitates the manufacture of the cast solid block compositions.

When present in a cast solid block composition, it is preferred that the germicidal cationic surfactant(s) are present in amounts so to dispense at least about 200 parts per million (ppm) in the water flushed into the sanitary appliance, e.g., toilet bowl, or into the water retained in the sanitary appliance at the conclusion of the flush cycle.

Further detersive surfactants which may be included are amphoteric and zwitterionic surfactants which provide a detersive effect. Exemplary useful amphoteric surfactants include alkylbetaines, particularly those which may be represented by the following structural formula:

$$RN^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms.

As noted above, preferred detersive surfactants are those which exhibit a melting points above about 110° F., preferably above 125° F., in order to permit convenient processing according to known art techniques. Nonetheless small amounts of low melting point surfactants, i.e., those exhibiting melting points below about 110° F. and even liquid surfactants may be used in providing the surfactant constituent of the cast solid block composition.

As the performance requirements of the cast solid blocks may differ according to their use as either an ITB or as an ITC block, the amounts of the constituents present in the block may vary as well depending upon the final intended use of the treatment block.

When intended for use as an ITB block, the detersive surfactant constituent may be present in any effective amount and generally comprises up to about 90% wt. of the total weight of the cast solid block composition, and the resultant treatment block formed therefrom. Preferably the detersive surfactant constituent comprises about 20-90% wt., more preferably 5-95% wt. of the cast block composition, and when used as an ITB block the detersive surfactant constituent most preferably comprises about 10-95% wt. of the cast solid block composition, and the resultant treatment block formed therefrom. When intended for use as an ITC block, the detersive surfactant constituent may be present in any effective amount and generally comprises up to about 60% wt. of the total weight of the cast block composition, and the resultant cast treatment block formed therefrom. Preferably the detersive surfactant constituent comprises about 10-55% wt., more preferably 20-50% wt. of the solid block composition, and the resultant treatment block formed therefrom.

In particularly preferred embodiments the cast solid blocks of the invention necessarily comprise at least one surfactant, preferably at least one anionic surfactant.

Further exemplary chemical constituents may be one or more sanitizing agents or germicides which may be present with our without other constituents being present in the cast solid blocks of the cageless lavatory dispensing devices.

The sanitizing agent can be any sanitizing composition known to those of ordinary skill in the relevant art, and without limitation exemplary sanitizing compositions include materials containing alkyl halohydantoins, alkali metal haloisocyanurates, bleach, essential oils, non-quaternary ammonium based germicidal compounds as well as quaternary ammonium germicidal compounds.

By way of non-limiting example, an exemplary further constituent is a bleach constituent. The bleach constituent is relatively inert in the dry state but, which on contact with water, releases oxygen, hypohalite or a halogen especially chlorine. Representative examples of typical oxygen-release bleaching agents, suitable for incorporation in the solid block composition include the alkali metal perborates, e.g., sodium perborate, and alkali metal monopersulfates, e.g., sodium monopersulfates, potassium monopersulfate, alkali metal monoperphosphates, e.g., disodium monoperphosphate and dipotassium monoperphosphate, as well as other conventional bleaching agents capable of liberating hypohalite, e.g., hypochlorite and/or hypobromite, include heterocyclic N-bromo- and N-chloro-cyanurates such as trichloroisocyanuric and tribromoiscyanuric acid, dibromocyanuric acid, dichlorocyanuric acid, N-monobromo-N-mono-chlorocyanuric acid and N-monobromo-N,N-dichlorocyanuric acid, as well as the salts thereof with water solubilizing cations such as potassium and sodium, e.g., sodium N-monobromo-N-monochlorocyanurate, potassium dichlorocyanurate, sodium dichlorocyanurate, as well as other N-bromo and N-chloroimides, such as N-brominated and N-chlorinated succinimide, malonimide, phthalimide and naphthalimide. Also useful in the solid block composition as hypohalite-releasing bleaches are halohydantoins which may be used include those which may be represented by the general structure:

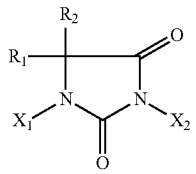

wherein:

$X_1$ and $X_2$ are independently hydrogen, chlorine or bromine; and, $R_1$ and $R_2$ are independently alkyl groups having from 1 to 6 carbon atoms. Examples of halohydantoins include, for example, N,N'-dichloro-dimethyl-hydantoin, N-bromo-N-chloro-dimethyl-hydantoin, N,N'-dibromo-dimethyl-hydantoin, 1,4-dichloro, 5,5-dialkyl substituted hydantoin, wherein each alkyl group independently has 1 to 6 carbon atoms, N-monohalogenated hydantoins such as chlorodimethylhydantoin (MCDMH) and N-bromo-dimethylhydantoin (MBDMH); dihalogenated hydantoins such as dichlorodimethylhydantoin (DCDMH), dibromodimethylhydantoin (DBDMH), and 1-bromo-3-chloro-5,5,-dimethylhydantoin (BCDMH); and halogenated methylethylhydantoins such as chloromethylethylhydantion (MCMEH), dichloromethylethylhydantoin (DCMEH), bromomethylethylhydantoin (MBMEH), dibromomethylethylhydantoin (DBMEH), and bromochloromethylethylhydantoin (BCMEH), and mixtures thereof. Other suitable organic hypohalite liberating bleaching agents include halogenated melamines such as tribromomelamine and trichloromelamine. Suitable inorganic hypohalite-releasing bleaching agents include lithium and calcium hypochlorites and hypobromites. The various chlorine, bromine or hypohalite liberating agents may, if desired, be provided in the form of stable, solid complexes or hydrates, such as sodium p-toluene sulfobromamine trihydrate; sodium benzene sulfochloramine dihydrate; calcium hypobromite tetrahydrate; and calcium hypochlorite tetrahydrate. Brominated and chlorinated trisodium phosphates formed by the reaction of the corresponding sodium hypohalite solution with trisodium orthophosphate (and water, as necessary) likewise comprise useful inorganic bleaching agents for incorporation into the inventive solid block composition and the treatment blocks formed therefrom.

When present, preferably the bleach constituent is a hypohalite liberating compound and more preferably is a hypohalite liberating compound in the form of a solid complex or hydrate thereof. Particularly preferred are chloroisocynanuric acids and alkali metal salts thereof, preferably potassium, and especially sodium salts thereof. Examples of such compounds include trichloroisocyananuric acid, dichloroisocyanuric acid, sodium dichloroisocyanurate, potassium dichloroisocyanurate, and trichloro-potassium dichloroisocyanurate complex. The most preferred chlorine bleach material is sodium dichloroisocyanurate; the dihydrate of this material being particularly preferred.

When present, the bleach constituent may be present in any effective amount and may comprise up to about 90% wt., preferably at least about 0.1-60% wt of the cast solid block composition. More preferably, when present, the bleach constituent comprises about 0.5-50% wt., more preferably at least 1-40% wt. of the cast solid block composition.

Other germicidally effective agents useful as sanitizing agents include sodium dichloroisocyanurate (DCCNa) and sodium dibromoisocyanurate. Further examples of non-quaternary ammonium based sanitizing agents include pyrithiones, dimethyldimethylol hydantoin, methylchloroisothiazolinone/methylisothiazolinone sodium sulfite, sodium bisulfite, imidazolidinyl urea, diazolidinyl urea, benzyl alcohol, 2-bromo-2-nitropropane-1,3-diol, formalin (formaldehyde), iodopropenyl butylcarbamate, chloroacetamide, methanamine, methyldibromonitrile glutaronitrile, glutaraldehyde, 5-bromo-5-nitro-1,3-dioxane, phenethyl alcohol, o-phenylphenol/sodium o-phenylphenol, sodium hydroxymethylglycinate, polymethoxy bicyclic oxazolidine, dimethoxane, thimersal dichlorobenzyl alcohol, captan, chlorphenenesin, dichlorophene, chlorbutanol, glyceryl laurate, halogenated diphenyl ethers, phenolic compounds, mono- and poly-alkyl and aromatic halophenols, resorcinol and its derivatives, bisphenolic compounds, benzoic esters (parabens), halogenated carbanilides, 3-trifluoromethyl-4,4'-dichlorocarbanilide, and 3,3',4-trichlorocarbanilide. More preferably, the non-cationic antimicrobial agent is a mono- and poly-alkyl and aromatic halophenol selected from the group p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, and 5-chloro-2-hydroxydiphenylmethane.

Quaternary ammonium based sanitizing agents include any cationic surfactant which is known or may be found to provide a broad antibacterial or sanitizing function; these have been described above with reference to detersive surfactants.

A further chemical constituent which is advantageously present in the cast solid block compositions are one or more oxyalkylenated compounds. Exemplary oxyalkylenated compound(s) which may be used in the composition of the invention may comprise ethylene oxide groups (oxyethylenated compounds), propylene oxide groups (oxypropylenated compounds) or both (oxyethylenated/oxypropylenated compounds).

Suitable oxyalkylenated compounds include, in particular, polyethylene glycols, polyethylene glycol esters and/or polypropylene glycol esters, polyethylene glycol ethers and/or polypropylene glycol ethers, alkoxylated aryl derivatives and in particular ethoxylated aryl polyol derivatives, oxyalkylenated and in particular oxyethylenated triesters of glycerol and of fatty acids, ethoxyethylenated urethane derivatives modified with alkyl chains, and mixtures thereof.

Exemplary polyethylene glycols which may be used in the composition of the invention include ethylene oxide polycondensates having a number of ethylene oxide (EO) units of greater than 100. The ethylene oxide number may range, for example, from 100 to 50 000. Suitable examples of polyethylene glycols include polyethylene glycol comprising 7 000 EO (CTFA name: PEG-7M), polyethylene glycol comprising 75 EO (CTFA name: PEG-75), polyethylene glycol comprising 20,000 EO (CTFA name: PEG-20M) and polyethylene glycol comprising 150 EO (CTFA name: PEG-150).

Also useful as oxyalkylenated compounds are polyethylene glycol esters and/or polypropylene glycol esters which are condensates of polyethylene glycol and/or polypropylene glycol with one or more fatty acids. These compounds have the formula:

$$RCOO\text{-}(EO)_m\text{—}(PO)_n\text{—}R'$$

in which m has a value of 0 to 300, n has a value of 0 to 300 the sum of m and n is 6 or greater, and R and R' represent, independently of each other, hydrogen or a saturated or unsaturated, linear or branched, hydroxylated or non-hydroxylated alkyl chain containing from 1 to 30 carbon atoms and preferably from 12 to 22 carbon atoms, or an aryl chain, with the proviso that R and R' are not simultaneously hydrogen.

Suitable, non-limiting examples of polyethylene glycol acid esters and/or polypropylene glycol acid esters include polyethylene glycol distearate (150 EO), PEG-150 dibehenate, polyethylene glycol palmitostearate (120 EO), the copolymer of polyethylene glycol ligand (30 EO) and of 12-hydroxystearic acid and polyethylene glycol stearate (40 EO), as well as such compounds based on polyoxyethylene/polyoxypropylene copolymers.

Further useful compounds include polyethylene glycol ethers and/or polypropylene glycol ethers are condensates of polyethylene glycol and/or polypropylene glycol with one or more fatty alcohols. These are compounds of formula:

$$R\text{-}(EO)_m\text{—}(PO)_n\text{—}R'$$

in which m has a value of 0 to 300, n has a value of 0 to 300 the sum of m and n is 6 or greater, and R and R' represent, independently of each other, hydrogen or a saturated or unsaturated, linear or branched, hydroxylated or non-hydroxylated alkyl chain containing from 1 to 30 carbon atoms and preferably from 12 to 22 carbon atoms, or an aryl chain, with the proviso that R and R' are not simultaneously hydrogen.

Suitable, albeit non-limiting examples of such polyethylene glycol ethers include, in oxyethylenated (30 EO) cetyl alcohol, oxyethylenated (15 EO) oleyl alcohol, oxyethylenated (50 EO) oleyl alcohol, oxyethylenated (10 EO) behenyl alcohol, oxyethylenated (30 EO) behenyl alcohol, oxyethylenated (12 EO) lauryl alcohol, oxyethylenated (23 EO) lauryl alcohol, oxyethylenated (20 EO) 2-octyldodecyl alcohol, oxyethylenated (20 EO) isocetyl alcohol, oxyethylenated (10 EO) oleyl alcohol, oxyethylenated (20 EO) oleyl alcohol, oxyethylenated (100 EO) stearyl alcohol, and oxyethylenated (21 EO) stearyl alcohol.

Suitable non-limiting examples of polyethylene glycol/polypropylene glycol ethers include oxyethylenated (5 EO) oxypropylenated (5 PO) lauryl alcohol, oxypropylenated (3 PO) myristyl alcohol, oxyethylenated (20 EO) oxypropylenated (5 PO) cetyl alcohol, oxyethylenated (26 EO) oxypropylenated (26 PO) butyl alcohol, oxyethylenated (26 EO) oxypropylenated (26 PO) butyl alcohol, oxyethylenated (30 EO) oxypropylenated (6 PO) decyltetradecanol, and oxyethylenated (25 EO) oxypropylenated (25 PO) lauryl alcohol.

Further suitable oxyalkylenated compounds include the ethoxylated alkyl or aryl derivatives of polyol include, for example, oxyethylenated derivatives of fatty acid esters or of fatty alcohol ethers and of a polyol such as glycerol, sorbitol, glucose or pentaerythritol. Non-limiting examples of such compounds include, oxyethylenated (78 EO) glyceryl cocoate, oxyethylenated (120 EO) methylglucose dioleate, oxyethylenated (40 EO) sorbitan septaoleate, oxyethylenated (10 EO) polyglyceryl (2 mol of glycerol) laurate, oxyethylenated (60 EO) glyceryl isostearate, oxyethylenated (20 EO) glyceryl monostearate, oxyethylenated (200 EO) glyceryl stearate, and oxyethylenated (150 EO) pentaerythrityl tetrastearate.

Further suitable compounds include oxyalkylenated glyceryl triesters of fatty acids, for example, oxyethylenated (6 EO) caprylic/capric acid glycerides, and oxyethylenated (50 EO) olive oil.

Other oxyalkylenated compounds falling within the above descriptions, although not specifically disclosed herein but known to the art may also be used. Preferred oxyalkylenated compounds are disclosed with reference to one of more of the following Examples. The oxyalkylenated compounds may be present as single compounds or as mixtures of two or more oxyalkylenated compounds. Particularly preferred oxyalkylenated compounds are relatively high molecular weight glycol polymers, such as polyalkylene glycols having molecular weights of from 500 to 35000, more preferably from about 1000 to 15000 and most preferably 5000 to 10000. Especially preferred examples of polyethylene glycol polymers include PEG 6000 and PEG 8000. Such are typically solids at room temperature (approx. 20° C.), are readily meltable and provide some degree of solubility in water. Further such relatively high molecular weight glycol polymers are also found to be chemically compatible with preferred further constituents useful in the cast solid block compositions.

The oxyalkylenated compound(s), and especially the preferred relatively high molecular weight glycol polymers, are preferably present in amounts of from 25% wt. to 90% wt. based on the total weight of the composition of which they form a part. Preferably however the oxyalkylenated compounds comprises 35-70% wt., preferably from 40-60% wt. based on the total weight of the cast solid block compositions of which they form a part.

As a further chemical constituent, the cast solid block compositions of the invention may also comprise a coloring agent which imparts either a color to the cast solid blocks, to the water in which it comes into contact, but especially which imparts color to the water contained within the sanitary appliance. Where the sanitary appliance is a toilet, desirably the coloring agent imparts a color to the water contained within the cistern, or within the toilet bowl particularly following the flush cycle of a toilet, or may impart a color in both locations. Such coloring agents have great consumer appeal, and indeed any known art coloring agent may be provided in any effective amount in order to impart a coloring effect. Colorants, especially dyes, are preferred when formulated as dry powders to enable direct incorporation into cast solid blocks of the invention, however, liquid colorants may be employed in conjunction with suitable carriers. Useful colorants include any materials which may provide a desired coloring effect. Exemplary useful coloring agents include dyes, e.g., Alizarine Light Blue B (C.I. 63010), Carta Blue VP (C.I. 24401), Acid Green 2G (C.I. 42085), Astragon Green D (C.I. 42040) Supranol Cyanine 7B (C.I. 42675), Maxilon Blue 3RL (C.I. Basic Blue 80), acid yellow 23, acid violet 17, a direct violet dye (Direct violet 51), Drimarine Blue Z-RL (C.I. Reactive Blue 18), Alizarine Light Blue H-RL (C.I. Acid Blue 182), FD&C Blue No. 1, FD&C Green No. 3 and Acid Blue No. 9. When a bleach constituent is included in the cast solid block composition, the colorant, e.g., dye, should be selected so to ensure the compatibility of the colorant with the bleach constituent, or so that its color persists despite the presence in the toilet bowl of a concentration of hypochlorite which is effective to maintain sanitary conditions. Frequently however, a cast solid block composition which includes a bleach constituent do not comprise any colorants. Desirably the colorants, when present, do not exceed 15% wt. of the cast solid block composition, although generally lesser amounts are usually effective. When present, colorants are desirably present in an amount from about 0.1 to 15 percent of the total weight of the chemical composition.

The cast solid block compositions may include a fragrance or other air treatment constituent. The fragrance may be any composition which is known to the art to provide a perceptible fragrancing benefit, any may be based on naturally occurring materials such as one or more essential oils, or may be based on synthetically produced compounds as well. Examples of essential oils include pine oil, Anetlhole 20/21 natural, Aniseed oil china star, Aniseed oil globe brand, Balsam (Perui), Basil oil (India), Black pepper oil, Black pepper oleoresin 40/20, Bois de Rose (Brazil) FOB, Bomneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Counmarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen oil.

Many of these essential function as a fragrance agent, which fragrance agent which may be a substance or mixture of various substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrance agents are complex mixtures or blends various organic compounds including, but not limited to, certain alcohols, aldehydes, ethers, alamatic compounds and varying amounts of essential oils such as from about 0 to about 25% by weight, usually from about 0.05 to about 12% by weight, the essential oils themselves being volatile odiferous compounds and also functioning to aid in the dissolution of the other components of the fragrance agent. In the present invention, the precise composition of the fragrance agent desirably emanates a pleasing fragrance, but the nature of the fragrance agent is not critical to the success of the invention.

As noted above, in conjunction with or in the absence of a fragrance constituent, the cast solid block compositions may comprise an air treatment constituent. Such may be any other material which is useful in providing treatment of ambient air, such as a sanitizing agents. e.g., one or more glycols or alcohols, or materials which are intended to counteract, neutralize, or mask odors in the absence of, or in conjunction with, the fragrance composition of the present invention. Alternatively, the air treatment constituent may be one or more materials which provide and effective insecticide repelling or insecticidal benefit; such would be particularly useful in climates or environments where insects present a nuisance or health hazard.

As further chemical constituents, the cast solid block compositions of the invention may comprise an anti-limescale agent, which can be generally classified as a cleaning agent in that it provides a cleaning effect to treated lavatory device surfaces. The anti-limescale agent can virtually any known anti-limescale agent compositions known to those of ordinary skill in the relevant art. For example, compositions containing anionic and/or nonionic surfactants together with typical anti-limescale agents, for example, amidosulfonic acid, bisulfate salts, organic acids, organic phosphoric salts, alkali metal polyphosphates, and the like. Examples of anti-limescale agent compositions can be found in, for example, U.S. Pat. Nos. 5,759,974; 4,460,490; and 4578207, the contents of which are herein incorporated by reference. Further examples of anti-limescale agents include organic acids (for example, citric acid, lactic acid, adipic acid, oxalic acid and the like), organic phosphoric salts, alkali metal polyphosphates, sulfonic, and sulfamic acids and their salts, bisulfate salts, EDTA, phosphonates, and the like.

The cast solid block compositions may comprise stain inhibiting materials. The cast solid block composition of the invention may, for example, include an effective amount of a manganese stain inhibiting agent which is advantageously included wherein the sanitary appliance is supplied by a water source having an appreciable or high amount of manganese. Such water containing a high manganese content are known to frequently deposit unsightly stains on surfaces of sanitary appliances, especially when the cast solid block composition also contains a bleach source which provides a hypochlorite. To counteract such an effect the cast solid block composition of the present invention may comprise a manganese stain inhibiting agent, such as a partially hydrolyzed polyacrylamide having a molecular weight of about 2000 to about 10,000, a polyacrylate with a molecular weight of about 2000 to about 10,000, and/or copolymers of ethylene and maleic acid anhydride with a molecular weight of from about 20,000 to about 100,000. When present the satin inhibiting materials may comprise to about 10% wt. of the weight of the cast solid block composition.

The cast solid block compositions of the invention may include one or more preservatives. Such preservatives are primarily included to reduce the growth of undesired microorganisms within the treatment blocks formed from the cast solid block composition during storage prior to use or while used, although it is expected that the such a preservative may impart a beneficial antimicrobial effect to the water in the sanitary appliance to which the treatment block is provided. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. For reasons of availability, the most preferred preservative are those commercially available preservative comprising a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.). When present, the optional preservative constituent should not exceed about 5% wt. of the cast solid block composition, although generally lesser amounts are usually effective.

The inventive cast solid block compositions may include a binder constituent. The binder may function in part controlling the rate of dissolution of the tablet. The binder constituent may be a clay, but preferably is a water-soluble or water-dispersible gel-forming organic polymer. The term "gel-forming" as applied to this polymer is intended to indicate that on dissolution or dispersion in water it first forms a gel which, upon dilution with further water, is dissolved or dispersed to form a free-flowing liquid. The organic polymer serves essentially as binder for the tablets produced in accordance with the invention although, as will be appreciated, certain of the polymers envisaged for use in accordance with the invention also have surface active properties and thereby serve not only as binders but also enhance the cleansing ability of the tablets of the invention. Further certain organic polymers, such as substituted celluloses, also serve as soil antiredeposition agents. A wide variety of water-soluble organic polymers are suitable for use in the cast solid block composition of the present invention. Such polymers may be wholly synthetic or may be semi-synthetic organic polymers derived from natural materials. Thus, for example, on class of organic polymers for use in accordance with the invention are chemically modified celluloses such as ethyl cellulose, methyl cellulose, sodium carboxymethyl cellulose, hydroxypropyl cellulose, hydroxypropyl methyl cellulose, ethyl hydroxyethyl cellulose, carboxymethyl hydroxyethyl cellulose, and hydroxyethyl cellulose. Another class of organic polymers which may be used include naturally derived or manufactured (fermented) polymeric materials such as alginates and carageenan. Also, water-soluble starches and gelatin may be used as the optional binder constituent. The cellulose based binders are a preferred class of binders for use in the cast solid block composition and may possess the property of inverse solubility that is their solubility decreases with increasing temperature, thereby rendering the tablets of the invention suitable for use in locations having a relatively high ambient temperature.

The optional binder constituent may also be one or more synthetic polymers e.g., polyvinyl alcohols; water-soluble partially hydrolyzed polyvinyl acetates; polyacrylonitriles; polyvinyl pyrrolidones; water-soluble polymers of ethylenically unsaturated carboxylic acids, such as acrylic acid and methacrylic acid, and salts thereof; base-hydrolysed starch-polyacrylonitrile copolymers; polyacrylamides; ethylene oxide polymers and copolymers; as well as carboxypolymethylenes.

In the case of the organic polymeric binders it may be noted that, in general, the higher the molecular weight of the polymer the greater the in-use life of the treatment block of the invention. When present, the total binder content may comprise up to 75% wt. of the cast solid block composition, but preferably is from 0.5 to 70% by weight, preferably from 1 to 65% by weight, more preferably from 5 to 60% by weight.

The cast solid block composition may optionally include one or more dissolution control agents. Such dissolution control agent are materials which provide a degree of hydrophobicity to the treatment block formed from the cast solid block composition whose presence in the treatment block contributes to the slow uniform dissolution of the treatment block when contacted with water, and simultaneously the controlled release of the active constituents of the cast solid block composition. Preferred for use as the dissolution control agents are mono- or di-alkanol amides derived from $C_8$-$C_{16}$ fatty acids, especially $C_{12}$-$C_{14}$ fatty acids having a $C_2$-$C_6$ monoamine or diamine moiety. When included the dissolution control agent may be included in any effective amount, but desirably the dissolution control agent is present in an amount not to exceed about 600% wt. of the cast solid block composition, although generally lesser amounts are usually effective. Generally wherein the treatment block is to be used in an ITB application the dissolution control agent is present to about 12% wt., more preferably is present from 0.1-10% wt. and most preferably is present from about 3-8% wt. of the cast solid block compositions, as well as in the treatment blocks formed therefrom. Generally wherein the treatment block is to be used in an ITC application the dissolution control agent is present to about 50% wt., more preferably is present from 1-50% wt. and most preferably is present from about 10-40% wt. of the cast solid block compositions, as well as in the treatment blocks formed therefrom.

The cast solid block compositions may optionally include one or more water-softening agents or one or more chelating agents, for example inorganic water-softening agents such as sodium hexametaphosphate or other alkali metal polyphosphates or organic water-softening agents such as ethylenediaminetetraacetic acid and nitrilotriacetic acid and alkali metal salts thereof. When present, such water-softening agents or chelating agents should not exceed about 20% wt. of the cast solid block composition, although generally lesser amounts are usually effective.

The cast solid block composition may optionally include one or more solid water-soluble acids or acid-release agents such as sulphamic acid, citric acid or sodium hydrogen sulphate. When present, such solid water-soluble acids or acid-release agents should not exceed about 20% wt. of the cast solid block composition, although generally lesser amounts are usually effective.

The cast solid block compositions may include diluent materials may be included to provide additional bulk of the product solid block composition and may enhance leaching out of the surfactant constituent when the cast solid block composition is placed in water. Exemplary diluent materials include any soluble inorganic alkali, alkaline earth metal salt or hydrate thereof, for example, chlorides such as sodium chloride, magnesium chloride and the like, carbonates and bicarbonates such as sodium carbonate, sodium bicarbonate and the like, sulfates such as magnesium sulfate, copper sulfate, sodium sulfate, zinc sulfate and the like, borax, borates such as sodium borate and the like, as well as others known to the art but not particularly recited herein. Exemplary organic diluents include, inter alia, urea, as well as water soluble high molecular weight polyethylene glycol and polypropylene glycol. When present, such diluent materials should not exceed about 80% wt. of the cast solid block composition, although generally lesser amounts are usually effective.

The cast solid block composition and treatment blocks formed therefrom may include one or more fillers. Such fillers are typically particulate solid water-insoluble materials which may be based on inorganic materials such as talc or silica, particulate organic polymeric materials such as finely comminuted water insoluble synthetic polymers. When present, such fillers should not exceed about 30% wt. of the cast solid block composition, although generally lesser amounts are usually effective.

Preferably the cast solid block of the invention includes silica. Silica has been observed to aid in the controlling the rate of dissolution of the cast solid blocks of the invention.

The cast solid block composition and treatment blocks formed therefrom may include one or more further processing aids. For example, the cast solid block composition may also include other binding and/or plasticizing ingredients serving to assist in the manufacture thereof, for example, polypropylene glycol or dipropylene glycol having a molecular weight from about 300 to about 10,000 in an amount up to about 20% by weight, preferably about 4% to about 15% by weight of the mixture may be used. The polypropylene glycol reduces the melt viscosity, acts as a demolding agent and also acts to plasticize the cast solid block when the composition is prepared by a casting process, and removed from the mold cavity in which the cast solid block hardens or is allowed to set. Other suitable plasticizers such as pine oil fractions, d-limonene, dipentene and the ethylene oxide-propylene oxide block copolymers may be utilized. Other useful processing aids include tabletting lubricants such as metallic stearates, stearic acid, paraffin oils or waxes and the like.

One advantageously utilized processing aid is a diester constituent which may be represented by the following structure:

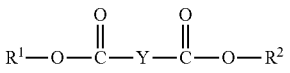

wherein:

$R^1$ and $R^2$ can independently be $C_1$-$C_6$ alkyl which may optionally substituted, Y is $(CH_2)_x$, wherein x is 0-10, but is preferably 1-8, and while Y may be a linear alkyl or phenyl moiety, desirably Y includes one or more oxygen atoms and/or is a branched moiety.

Exemplary diester constituents include the following diester compounds according to the foregoing structure: dimethyl oxalate, diethyl oxalate, diethyl oxalate, dipropyl oxalate, dibutyl oxalate, diisobutyl oxalate, dimethyl succinate, diethyl succinate, diethylhexyl succinate, dimethyl glutarate, diisostearyl glutarate, dimethyl adipate, diethyl adipate, diisopropyl adipate, dipropyl adipate, dibutyl adipate, diisobutyl adipate, dihexyladipate, di-$C_{12-15}$-alkyl adipate, dicapryl adipate, dicetyl adipate, diisodecyl adipate, diisocetyl adipate, diisononyl adipate, diheptylundecyl adipate, ditridecyl adipate, diisostearyl adipate, diethyl sebacate, diisopropyl sebacate, dibutyl sebacate, diethylhexylsebacate, diisocetyl dodecanedioate, dimethyl brassylate, dimethyl phthalate, diethyl phthalate, dibutyl phthalate.

Preferred diester constituents include those wherein Y is —$(CH_2)$— wherein x has a value of from 0-6, preferably a value of 0-5, more preferably a value of from 1-4, while $R^1$ and $R^2$ are $C_1$-$C_6$ alkyl groups which may be straight chained alkyl but preferably are branched, e.g., iso- and tert-moieties. Particularly preferred diester compounds are those in which the compounds terminate in ester groups.

A further advantageously utilized processing aid is a hydrocarbon solvent constituent. The hydrocarbon solvents are immiscible in water, may be linear or branched, saturated or unsaturated hydrocarbons having from about 6 to about 24 carbon atoms, preferably comprising from about 12 to about 16 carbon atoms. Saturated hydrocarbons are preferred, as are branched hydrocarbons. Such hydrocarbon solvents are typically available as technical grade mixtures of two or more specific solvent compounds, and are often petroleum distillates. Nonlimiting examples of some suitable linear hydrocarbons include decane, dodecane, decene, tridecene, and combinations thereof. Mineral oil is one particularly preferred form of a useful hydrocarbon solvent. Further preferred hydrocarbon solvents include paraffinic hydrocarbons including both linear and branched paraffinic hydrocarbons. The former are commercially available as NORPAR solvents (ex. ExxonMobil Corp.) while the latter are available as ISOPAR solvents (ex. ExxonMobil Corp.) Mixtures of branched hydrocarbons especially as isoparaffins form a further particularly preferred form of a useful hydrocarbon solvent of the invention. Particularly useful technical grade mixtures of isoparaffins include mixtures of isoparaffinic organic solvents having a relatively narrow boiling range. Examples of these commercially available isoparaffinic organic solvents include ISOPAR C described to be primarily a mixture of $C_7$-$C_8$ isoparaffins, ISOPAR E described to be primarily a mixture of $C_8$-$C_9$ isoparaffins, ISOPAR G described to be primarily a mixture of $C_{10}$-$C_{11}$ isoparaffins, ISOPAR H described to be primarily a mixture of $C_{11}$-$C_{12}$ isoparaffins, ISOPAR J, ISOPAR K described to be primarily a mixture of $C_{11}$-$C_{12}$ isoparaffins, ISOPAR L described to be primarily a mixture of $C_{11}$-$C_{13}$ isoparaffins, ISOPAR M described to be primarily a mixture of $C_{13}$-$C_{14}$ isoparaffins, ISOPAR P and ISOPAR V described to be primarily a mixture of $C_{12}$-$C_{20}$ isoparaffins.

When present such further processing aids are typically included in amounts of up to about 30% by weight, preferably to 20% wt. of the cast solid block composition, although generally lesser amounts are usually effective.

Optionally but in some cases, preferably one or more of the foregoing constituents may be provided as an encapsulated, particularly a microencapsulated material. That is to say, quantities of one or more constituents are provided covered or encapsulated in an encapsulating material. Methods suitable for such an encapsulation include the customary methods and also the encapsulation of the granules by a melt consisting e.g. of a water-soluble wax, coacervation, complex coacervation and surface polymerization. Non-limiting examples of useful encapsulating materials include e.g. water-soluble, water-dispersible or water-emulsifiable polymers and waxes. Advantageously, reactive chemical constituents, particularly the fragrance composition when present, may be provided in an encapsulated form so to ensure that they do not prematurely degrade during processing of the constituents used to form the cast solid block composition and that they are retained with minimal degradation in the cast solid block composition prior to their use. The use of water soluble encapsulating material is preferred as such will release the one or more chemical constituents when the cast solid block composition is contacted with water supplied either in the cistern or in the toilet bowl.

Ideally the cast solid blocks exhibit a density greater than that of water which ensures that they will sink when suspended in a body of water, e.g., the water present within a cistern. Preferably the treatment blocks formed from the cast solid block composition exhibit a density in excess of about 1 g/cc of water, preferably a density in excess of about 1.5 g/cc of water and most preferably a density of at least about 2 g/cc of water.

While the mass of the cast solid blocks may vary, and amount of up to an including 500 grams may be practiced, generally the mass of the cast solid block compositions do not exceed about 150 grams. Advantageously the mass of the cast solid blocks is between about 20 and 100 grams. It is appreciated that cast solid blocks having great mass should provide a longer useful service life of the cageless lavatory dispensing devices, with the converse being equally true.

The cast solid blocks according to the present invention may also be provided with a coating of a water-soluble film, such as polyvinyl acetate following the formation of the treatment blocks from the recited solid block composition. Such may be desired for improved handling, however such is often unnecessary as preferred embodiments of the cast blocks exhibit a lower likelihood of sticking to one another following manufacture than many prior art treatment block compositions.

It will be appreciated by those of ordinary skill in the art that several of the components which are directed to provide a chemical composition can be blended into one chemical composition with the additional appreciation that potential blending of incompatible components will be avoided. For example, those of ordinary skill in the art will appreciate that certain anionic surfactants may have to be avoided as some may be incompatible with certain sanitizing agents and/or certain anti-lime scale agents mentioned herein. Those of ordinary skill in the art will appreciate that the compatibility of the anionic surfactant and the various sanitizing and anti-limescale agents can be easily determined and thus incompatibility can be avoided in the situations.

The cast solid blocks may be formed of a single chemical composition, or may formed of two (or more) different chemical compositions which may be provided as separate regions of a solid block, such as a first layer of a solid block consisting of a first chemical composition, alongside a second layer of a the cast solid block consisting of a second chemical composition which is different than the first chemical composition. The block may also be formed of two or more separate regions or masses of different chemical compositions which are simply layered adjacent to one another. Further layers of still further different chemical compositions may also be present. Such solid blocks formed having two or more discrete layers or regions of, respectively, two or more different chemical compositions may be referred to as composite blocks.

Any form of the cast solid blocks may also be provided with a coating film or coating layer, such as a water soluble film which is used to overwrap the chemical composition provided in the device which film provides a vapor barrier when dry, but which dissolves when contacted with water. Alternately the cast solid blocks may be oversprayed or dipped into a bath of a water soluble film forming constituent, and thereafter removed and thus allowing the water soluble film forming constituent to dry and form a coating layer on the cast solid block.

Exemplary materials which may be used to provide such a coating on some or all of the surfaces of the cast solid block compositions include one or more of the following: Rhodasurf TB-970 described by its supplier to be a tridecyl alcohol having a degree of ethoxylation of approximately 100 having an HLB of 19, and exhibiting a melting point in the range of 52-55° C.; Antarox F-108 which is described to be an EO-PO block copolymer having a degree of ethoxylation of approximately 80% and having a melting point in the range of 54-60° C.; further materials including those identified as Pluriol Z8000, and Pluriol E8000 which are believed to be optionally substituted, high molecular weight polyethylene glycols ("PEG") having a sufficiently high molecular weight such that they have a melting point of at least 25° C., preferably a melting point of at least about 30° C. may also be used. Other water soluble materials, desirably those which have a melting point in the range of about 30-70° C., and which may be used to provide a water soluble or water dispersible coating on the cast solid blocks are also contemplated to be useful, especially synthetic or naturally occurring waxy materials, and high molecular weight polyalkylene glycols, especially polyethylene glycols. Certain of these coating materials may be surfactants and form part of the cast solid block composition. Generally such materials may be provided as a dispersion in water, an organic solvent or in an aqueous/organic solvent, but preferably are used as supplied from their respective supplier and are heated to at least their melting points in order to form a liquid bath. Conveniently, the cast solid blocks affixed to the plate of a hanger are then conveniently dipped into the said bath, thereby providing a coating layer to the cast solid blocks. Alternately, the coating materials may be sprayed, brushed on or padded onto at least part of the surfaces of the previously formed cast solid blocks.

The application of a water soluble film or coating is preferred in certain embodiments of the invention as the surface film may facilitate the handling of the blocks during packaging and storage prior to use of the cageless lavatory dispensing devices. Further, the application of a water soluble film or coating is preferred as certain water soluble film former compositions may impart a desirable surface gloss to the cast lavatory blocks.

Preferably the cast solid block compositions useful in the cageless lavatory dispensing devices include those which comprise at least one surfactant, preferably at least one anionic or nonionic surfactant.

Preferred cast solid block compositions according to the invention comprise:

35-70% wt., preferably 40-60% wt. of one or more oxyalkylenated compounds, preferably wherein the oxyalkylenated compounds are high molecular weight glycol polymers, such as polyalkylene glycols having molecular weights of from 500 to 35000, more preferably from about 1000 to 15000 and most preferably 5000 to 10000;

a detersive surfactant selected from one or more of nonionic surfactants, anionic surfactants based on branched alkyl anionic surfactants and/or anionic surfactants based on sarcosinate surfactants;

0.1% wt.-25% wt. of one or more fatty alkanolamides; and, optionally to 40% wt. further additive constituents, including but not limited to further surfactants, fillers, binders, fragrances, processing aids such as lubricants and tabletting aids, bleaches, sanitizing compositions and the like.

Yet further and particularly preferred embodiments of cast solid blocks and their compositions include those which are recited on Table 1, discussed with reference to the Examples.

As opposed to prior art processes wherein lavatory block compositions were produced by extrusion techniques wherein one or more constituents were provided to a an extruded which extruded a well mixed, generally homogenous body which could be subsequently cut into segments, the cageless lavatory dispensing devices according to the present invention are produced by casting.

The manufacture of the cageless lavatory dispensing device comprises a process step wherein one or more of the constituents used to form the cast solid block composition are rendered fluid, viz., fluidifying, e.g., by heating such that the constituents used to form the block may be poured into a cavity, e.g., a mold and thereafter permitted to solidify. Preferably the blend of the constituents used to form a block are formed into a generally homogenous fluid and pourable composition which can be readily poured from a vessel or a container into the cavity and subsequently, allowed to solidify or harden until the hardened block composition is sufficiently hard and rigid that it may be removed from the cavity into which it was introduced. Ideally the pourable composition is a liquid. It is to be expressly understood that in accordance with the present invention, not all of the constituents used to form a cast solid block composition need be rendered fluid when heated, but only that a sufficient amount of the constituents be melted so that any remaining unmelted or non-liquefied constituents are entrained in the fluid castable solid block composition such that it may be poured or pumped. It is contemplated that all of the constituents used to form the cast solid block need not be necessarily liquefied and indeed, in view of the varying types of constituents which may be used which insert embodiments may include high melting point materials, or in organic materials which do not liquefy such indeed may be technically impossible or infeasible. As noted, only a sufficient amount of the constituents present in a castable solid block composition be susceptible to liquefication such that the composition be rendered into a fluid state or any can be poured, or pumped readily, and thereafter hardens into a stiff or rigid form. Additionally it is preferred that only a minority of the constituents used to form the fluid castable solid block composition be liquid or fluid at room temperature (approx. 20° C.), and preferably not more than 35% wt., and in order of increasing preference not more than 30% wt., 25% wt., 20% wt., 15% wt, 10% wt., 8% wt., 6% wt., 5% wt., 4% wt., 3% wt., 2% wt., 1% wt. and especially 0% wt. of the constituents used to form a fluid castable solid block composition have a melting point of 20° C. or less at room temperature at normal atmospheric conditions. The use of reduced amounts of constituents having a melting point of about 20° C., may improve the hardness of the cast solid block composition in minimizing the amounts of such materials which would be normally liquid or fluid at room temperature (approx. 20° C.).

Advantageously, the inventors have found that the constituents used to form the fluid castable solid block composition are favorably prepared by gently heating (a temperature rise of not more than 2° C.-10° C./minute, preferably 2° C.-5° C./minute from an initial room temperature of approx. 20° C.) until a desired "peak fluid temperature" was reached, and subsequently the fluid compositions were allowed to cool at room temperature to a reduced "pouring temperature" where aliquots of the fluid compositions were poured into either mold cavities, or trays having a shaped cavity within which was present a part of hanger and the plate of a hanger. Such a slow heating rate to the peak fluid temperature provides for a relatively slow transition in temperature and has been observed to provide for a more homogenous castable solid block composition which, when allowed to solidify appears to be often less prone to internal cracking of the cast solid block composition. The reduced pouring temperature is typically a temperature wherein the viscosity of the castable solid block composition remains pourable and pumpable and thus may be easily provided to molds or other cavities but is at a higher viscosity than at the peak fluid temperature. It will be understood that such peak fluid temperatures will vary depending upon the constituents used to form the castable solid block compositions, however such may be determined by routine experimental techniques as the peak fluid temperature often corresponds to a minimum temperature wherein homogenous mixing may reliably occur and at the same time, no appreciable degradation of one or more of the constituents in the castable solid block composition will occur for the duration of its residence at such a temperature. The pouring temperature typically corresponds to a lower temperature wherein the physical characteristics (e.g., viscosity) of the fluid castable solid block composition may be readily handled and maintained in a fluid state, e.g., pourable and/or pumpable, for use in automatic processing and/or dispensing equipment. Generally the pouring temperature is at least 5° C. less, preferably about 8° C. less, and most preferably at least about 10° C. less than the peak fluid temperature. Although a process wherein a castable solid block composition is advantageously heated to a first, higher peak fluid temperature, and then cooled to a lower, pouring temperature is contemplated, it is to be understood that the process may be practiced wherein the peak fluid temperature and the pouring temperature are the same.

During the time period or time interval during which the liquefied constituents use to form the block are provided to the cavity, a part of the hanger is also present within the cavity such that said liquefied constituents come into contact with the part of the hanger present within the cavity, and preferably at least partially encase or enrobe part of the hanger, especially the retention element, e.g., a plate.

While the process according to the invention is conveniently practiced with a single chemical composition useful in forming the cast solid block, it is contemplated that two or more different chemical compositions may be used to form the cast solid block wherein the two or more chemical compositions are separately fluidized and then introduced into the cavity and subsequently allowed to solidify. The order of addition may vary, for example, the individual chemical compositions may be added simultaneously with one another, or may be added in sequence to the cavity. With regard to the former option, it may be desired to include, for example, two or more different chemical compositions, each in any fluid and pourable form which can be provided simultaneously to the cavity in order to produce a solidify block composition having a particular feature which may be advantageous from a technical and/or from a consumer standpoint. For example, two or more different chemical compositions each having a different technical feature, such as a different color, may be simultaneously added and such may provide a solid block composition which has a desirable visual characteristics such as a "swirled" appearance wherein the appearance of the block is not necessarily a single homogenous caller but rather may have different regions or portions demonstrating different coloration. A further example, to a more different local compositions each having a different technical feature, such as wherein one of said two or more different chemical compositions has a constituents having a particular individual components which provides the desired technical feature, such as a visually discernible constituents, and/or a sensorially discernible constituents may also be used. For example, with regarding to the former, by way of nonlimiting example, visibly discernible constituents may for example be particles or particulates which are visibly discernible such as insoluble in organic materials which provided desired appearance, for example particulates of mica, colored beads such as glass beads or colored polymeric beads, and the like. The purpose of such visibly discernible materials is to provide for a more attractive appearance, such as a spotted or speckled appearance to the ultimately form solid block composition. With regard now to the latter, by way of nonlimiting example, sensorially discernible constituents may include one or more particular individual components which provide a fragrancing benefit, odor neutralization benefit, which may be provided by the incorporation of encapsulated fragrance or odor neutralization materials such as in beads or particulates. Such need not be necessarily visibly discernible, but may be of such a size that they are not visibly discernible as their primary purpose is to provide a sensorial benefit when they are exposed to the ambient environment from within the block composition or are released from the block composition and into the water of a passing through a lavatory appliance, e.g., a toilet. While not specifically elucidated herein, it is contemplated that yet further materials may be utilized to provide visibly discernible constituents and/or sensorially discernible constituents which may be advantageously utilized as well.

In a further embodiment, the process of the invention can be practice utilizing two or more individual chemical compositions which are provided in a non-simultaneous manner whereby a first individual chemical composition is provided to the cavity and/or portion of the hanger and permitted to solidify prior to the addition of any further individual chemical constituents which are subsequently added to the cavity and/or hanger. In one exemplary process sequence utilizing to a more individual chemical compositions, there is first provided a cavity having a portion of the hanger extending within the interior of the cavity, e.g., a plate which is located approximately midway within the interior of any cavity. Thereafter, a first solidified chemical composition is provided to the cavity and allowed to use harden or solidify and a thereafter, any further individual fluidified chemical compositions, e.g., a second chemical composition is provided to the cavity and allow to harden or solidify. In this manner a solid block composition having to discrete "zones" having distinguishable chemical compositions may be provided. The foregoing process is preferably practiced in a manner wherein the quantity of the first individual chemical composition is provided in a sufficient amount so that it at least partially contacts the retention element, e.g., the plate, present within the cavity and may partially or completely in case or enrobe the retention element, and is allowed to solidify. Thereafter, a second individual chemical composition may be added to the cavity whereby it comes into interfacial contact with the solidified, first chemical composition and the second individual chemical composition is allowed to solidified. Where present, still further individual chemical compositions may be sequentially subsequently added to the cavity until, the desired volume of the cavity is filled and after the hardening or solidification novel on the individual chemical constituents provided to the cavity, the cast solid block composition which is now at least partially encased or embedded in a portion of the hanger may be removed or ejected from the cavity.

It is also contemplated that a plurality of cavities or molds may be used in the process according to the present invention. Such may be particularly advantageous wherein it is desired to form a specific three-dimensional shape to the cast solid block composition or portions thereof. For example in one such process, a first cavity may be provided, a portion of the hanger, especially the retention element is provided in therein, and a first chemical composition is provided to at least partially fill this first cavity and thereafter the first chemical composition is allowed to harden or solidify. Thereafter the cast solid block composition and hanger may be ejected or removed from this first cavity. In such a process, and a solidified mass of the first chemical composition may be thus provided as an interior "core" of a larger solid block composition and this core may be overlaid or overmolded by a second and/or third further chemical block composition. Accordingly then, a hanger having to be solidified first composition may then be provided to a second cavity having a larger volume than the first cavity used in the prior step, whereby the solidified first chemical composition is present within the interior of a second larger cavity. Subsequently, a second individual chemical composition is then added to the second cavity wherein it comes into contact with the solidified first chemical composition, preferably at least partially in cases worn robes the solidified first chemical composition such that it overmolds it. Thereafter, the second chemical composition is allowed to harden and solidify and subsequently may be removed from the second cavity. In such a manner, a manner for producing and a solid block composition having an interior mass or body of a first chemical composition, and exterior mass of body second and different chemical composition can be easily produced.

In a still further variant of the foregoing process whereby a plurality of chemical compositions are utilized to form a cast solid block therefrom, it is contemplated that a quantity of first chemical composition is provided in a fluid form in a container or vessel, and a portion on the hanger is inserted into, e.g., dipped into, the solidified first chemical composition and withdrawn whereby a coating or an amount on the solidified first chemical composition is retained on a portion of the hanger. Afterwards the first chemical composition is allowed to harden or solidify on the hanger, preferably on the retention element thereof. Optionally, but frequently desirably, this process can be repeated and number of times so a plurality of lamina of the first chemical composition can be built up by sequential insertion, withdrawal, and hardening of the first individual chemical composition on the portion of the hanger until a desired thickness or mass of the solidified first chemical composition is achieved. Such may be referred to as series of successive "dipping" operations. Subsequently, the hanger having a quantity of the solidified first individual chemical composition can then be supplied to a cavity and a second individual chemical composition can be provided to the cavity thereby contacting and preferably encasing or at least partially enrobing the solidified first chemical composition. Alternately, a quantity of a second chemical composition is provided in a fluid form such as in a container or vessel and the portion of the hanger having the solidified first chemical composition is inserted thereto, such as by dipping. Again, this sequence may be repeated for the second individual chemical composition a plurality of times until number of lamina are built up on the hanger and/or a sufficiently thick quantity on the second individual chemical composition is present. The foregoing process provides for the production of a cageless lavatory dispensing devices according to the invention which may be performed absent the use of a cavity or mold.

In certain particularly preferred embodiments the cast solid blocks of the present invention weigh from 15 to 150 grams, preferably from about 20 to about 75 grams. The blocks are typically oblate in shape, having a length of from about 1 to about 4 inches and having a thickness of from about 0.5-1.5 inches.

The service life of the cast solid blocks should be from about 10 to about 90 days, based on 12 flushes per day. Preferably the service life of the cast solid blocks is at least about 14 days when installed on the rim of a toilet bowl such that the said block is positioned adjacent to the sloping interior sidewall of the toilet bowl and is subjected to between 6-12 flushes per day. Preferably the temperature of the water which is flushed is in the range of 16-24° C. The length of life of the cast solid blocks will of course depend on a variety of factors including product formulation, water temperature, tank size, the number of flushes over the period of use and the volume of the water which contacts the cast solid blocks.

Various configurations of the cageless lavatory dispensing device, including certain particularly preferred embodiments, are depicted on the following figures. In the accompanying figures, like elements are indicated using the same numerals throughout the figures.

FIG. 1 depicts a hanger 10 comprising a hook end 20 comprising an end member 12 flexibly attached to a top member 14 as well as part of the stalk 16. Depending from the end of the stalk 16 distally from the hook end 20 is a plate 30. As can be seen from the perspective view provided by FIG. 1, the plate itself is generally rectangular in configuration, and it is coplanar with the ribbon-type or strip-type configuration and construction of both the stalk 16 and hook end 20. The plate 30 has a width dimension "W1" as well as a height dimension "H1" and as depicted, desirably the width is greater than the height. As is visible from the figure, the hanger 10 is generally symmetrical about a center line "CL" which is drawn with respect to the midline of the stalk 16. The center line does not exist as an actual element of the device but is illustrated for the sake of convenient reference. While not illustrated with sufficient particularity in the figure, it is of course understood that the plate, stalk 16 and the hook end 20 all have a thickness which may be consistent throughout, or which can vary.

Figure 2:
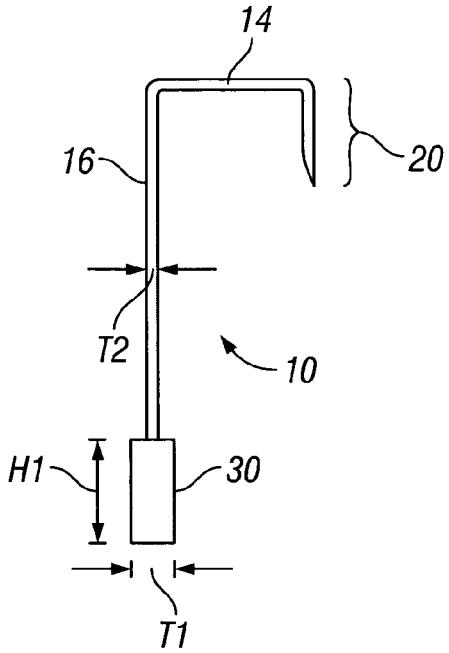

FIG. 2 depicts a side view of a further embodiment of the hanger 10 of FIG. 1. As is more clearly seen in this figure, the hook end 20 is formed from first and second elements 12, 14 and part of the stalk 16. Depending from the stalk 16 is the plate 30. In this embodiment the plate 30 has a thickness "T1" which is greater than the thickness "T2" of the stalk 16 and the hook end 20. Of course, it will be understood that each of the hook end, stalk, and plate can have different thicknesses or can all share the same thickness as illustrated in FIG. 1.

Figure 3:
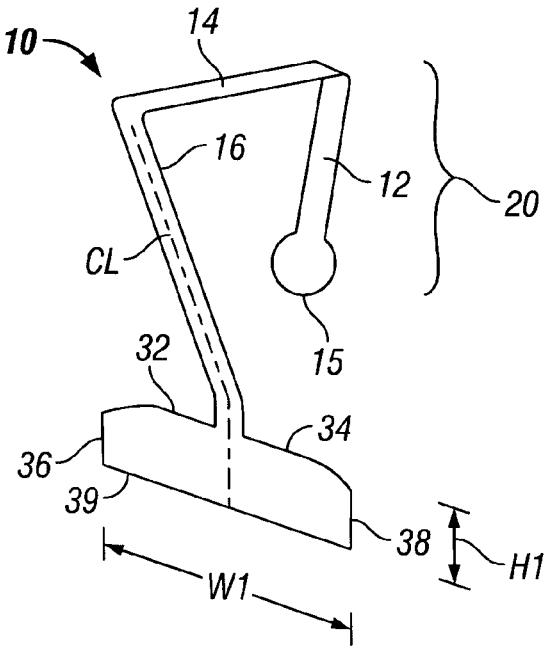

FIG. 3 depicts a further embodiment of a hanger 10 according to the invention, in which the hook end 20 is a flexible element. As can be seen from the figure, the hook end is comprised of an end member 12 flexibly connected to a top element 14 which in turn is flexibly connected to the stalk 16. At the end opposite the hook end, depends the plate 30. With regard to the hook end, as can be seen, at the terminal end of the end member 12 is seen a broadened region which is referred to as a "pad" 15. The pad region is of the same thickness as the end member 12, but is slightly broader. The width of the pad end 15 is greater than the width of the end member 12. This increased width is sometimes useful to stabilize the hook end of the cageless lavatory dispensing device when suspended upon part of a sanitary appliance. As is further visible from FIG. 3, the plate 30 is substantially planar in configuration has a width W1 as well as height H1 and is symmetric around the center line CL of the stalk 16. The plate has a generally linear bottom edge 39 at opposite ends thereof to generally straight end walls 36, 38 which end walls proceed and extend to the stalk 16 via sloping top walls 32, 34.

Figure 4:
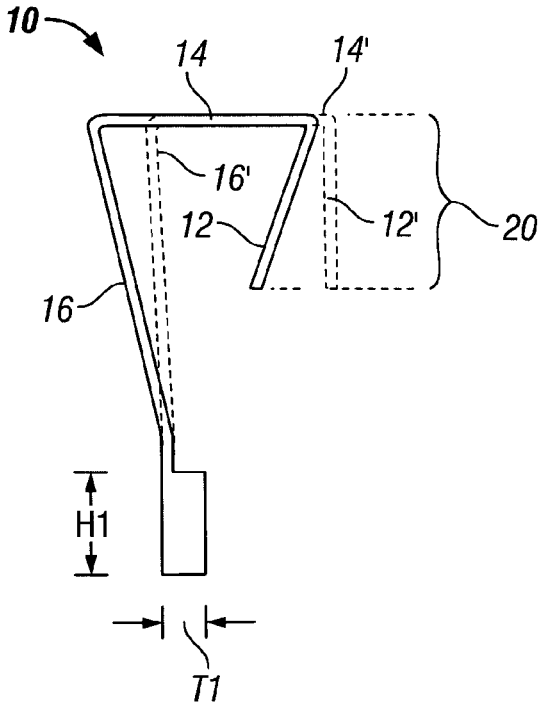

FIG. 4 depicts the hanger 10 of FIG. 3 in both a "folded" as well as in an "unfolded" configuration.

As seen from the solid line elements depicted on FIG. 4, the hanger 10 on the folded configuration illustrates, that when the hook end and the stalk are untensioned, the hook end 20 is retained in a closed configuration. In the unfolded configuration, as depicted by the elements depicted in a broken line format, the end member 12' and the pad 15' are extended away from the stalk 16 and are more distantly positioned with respect to the stalk than in the prior, folded configuration. Typically, this also causes a degree of translation of the top element 14' which may extend down to, include a portion of the stalk 16' as well. When made of a flexible material, in the unfolded configuration as depicted in FIG. 4, the elastic bias of the material of construction, such as a polymer, tends to cause the hook end to seek to return to the folded configuration. However, when placed about the rim of a portion of a sanitary device, i.e. a toilet bowl, this action causes the hook end to impart a degree of gripping to that portion of the rim upon which it is mounted. This is turn helps retain the relative position of the hook end, as well as that of the cageless lavatory dispensing device until repositioned, or removed by a consumer.

Figure 5:
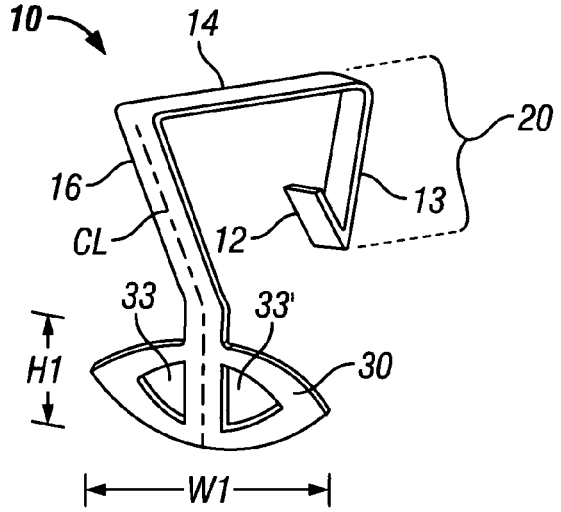

FIG. 5 depicts a still further embodiment of a hanger 10. In this embodiment, the hanger includes a coiled hook end 20 comprised of the end member 12, the second element 13 and a top element 14 which is in a compressed, coiled arrangement thus making it particularly convenient to include in a consumer package. The top end of the top element 14 extends to a stalk 16 having at its opposite end a depending plate 30. In this configuration, the plate 30 is oblate in shape and is generally symmetrical about a center line (CL). The plate has a width dimension (W1) as well as a height dimension (H1). Further, the plate illustrates that it can be produced with perforations passing therethrough. Here, two similarly shaped, generally triangular passages 33, 33' are provided. As has been discussed previously in the specification, while it is contemplated that the plate of the hanger may include one or more perforations passing there through, for reasons observed although not yet fully understood by the applicants, it is believed that the use of plates having such perforations passing there through are to be preferably avoided as such may undesirably reduce the service life of the cageless lavatory dispensing device.

Figure 6:
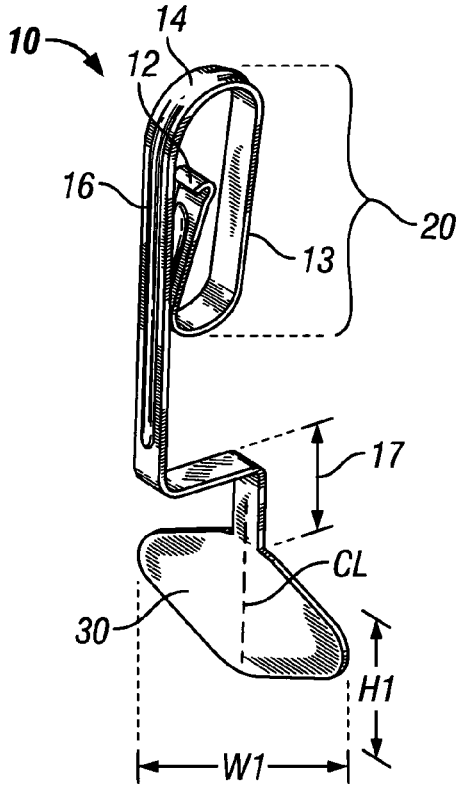

FIG. 6 depicts a still further embodiment of a hanger 10 according to the invention. As is shown, the hanger includes a hook end 20 which is comprised of the end member 12, flexibly connected to element 13, which is in turn flexibly connected to a top element 14, which in turn is flexibly connected to a part of the stalk 16. The opposite end of the stalk terminates in a generally oblate shaped plate 30 having a width dimension (W1), a height dimension (H1) wherein the plate is generally symmetrically about the center line (CL) as depicted in the dotted line drawn on FIG. 6. Whereas the hanger is depicted in a folded or otherwise coiled configuration, it is to be understood that the hook end can be extended by a user of the hanger and the cageless lavatory dispensing device to reconfigure said hook end 20 to form a hook end which can be used to suspend the hanger and the cageless lavatory dispensing device upon a part of a sanitary device particularly a toilet bowl rim. The embodiment according to FIG. 6 also illustrates that, according to preferred embodiments, the plate 30 is substantially planar and as is shown in FIG. 6, it is of generally uniform thickness. The embodiment depicted in FIG. 6 is preferred in that the hook end is particularly well coiled when in its folded configuration, but when uncoiled or in its unfolded configuration, provides a significant degree of tension which is useful in retaining the respective position of the cageless lavatory dispensing device when installed upon a sanitary appliance, particularly when the hook is affixed on a part of a toilet bowl rim. Furthermore, FIG. 6 depicts that that embodiment also includes a bent neck 17 formed as part of the stalk 16 and immediately adjacent to the region of the plate 30 which is connected to the stalk 16. As depicted, the bent neck 17 positions the plate 30 at a position which is rearward of the major portion of the stalk 16 but retains the plate 30 as being generally parallel thereto. This positioning rearward of the major part of the stalk 16 is beneficial as ultimately, it acts to also thereby position the cast solid block enrobing the plate 30 such that when mounted upon a toilet bowl, the cast solid block is in contact with, or is in very proximity to the interior sloping side wall of a toilet bowl. Such positioning is advantageous in that it ensures that the cast solid block remains in the flow path of the flush water throughout the useful service life of the cageless lavatory dispensing device.

Figure 7:
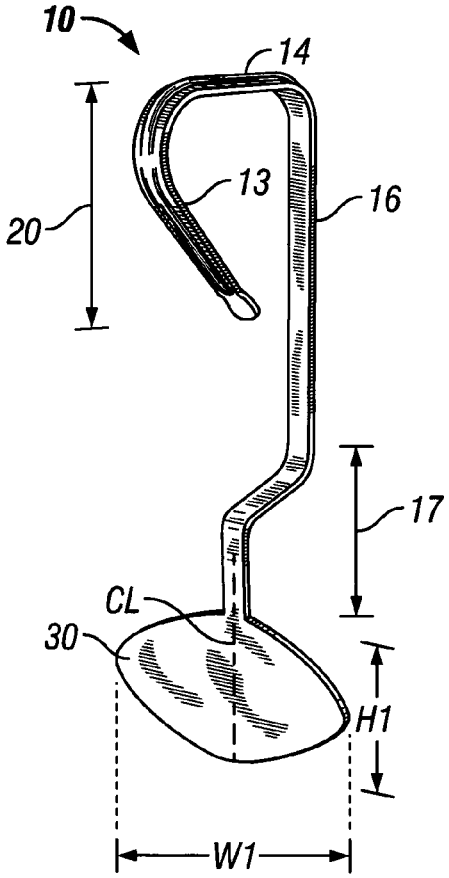

FIG. 7 illustrates a yet further embodiment of a hanger 10 according to the invention. As is shown, the hanger includes a hook end 20 comprising an element 13, flexibly connected to a top element 14, which in turn is flexibly connected to a part of the stalk 16. The stalk 16 extends downwardly through a bent neck section 17 and terminates in a generally oblate shaped plate 30 having a width dimension (W1), a height dimension (H1) wherein the plate is generally symmetrically about the center line (CL) as depicted in the dotted line drawn on FIG. 6. Whereas the hanger is depicted in a folded configuration, it is to be understood that the hook end can be extended by a user of the hanger and the cageless lavatory dispensing device to flex and open said hook end 20 suspend the hanger and the cageless lavatory dispensing device upon a part of a sanitary device, particularly a toilet bowl rim. The embodiment according to FIG. 7 also illustrates that, according to preferred embodiments, the plate 30 is substantially planar and as is shown in FIG. 7, it is of generally uniform thickness. The embodiment depicted in FIG. 7 depicts that that embodiment also includes a bent neck section 17 formed as part of the stalk 16 and immediately adjacent to the region of the plate 30 which depends from the stalk 16. As illustrated, the bent neck 17 positions the plate 30 at a position which is rearward of the major portion of the stalk 16 but retains the plate 30 as being generally parallel thereto. This positioning rearward of the major part of the stalk 16 is beneficial as ultimately, it acts to also thereby position the cast solid block enrobing the plate 30 such that when mounted upon a toilet bowl, the cast solid block is in contact with, or is in very proximity to the interior sloping side wall of a toilet bowl. Such positioning is advantageous in that it ensures that the cast solid block remains in the flow path of the flush water throughout the useful service life of the cageless lavatory dispensing device.

Figure 8:
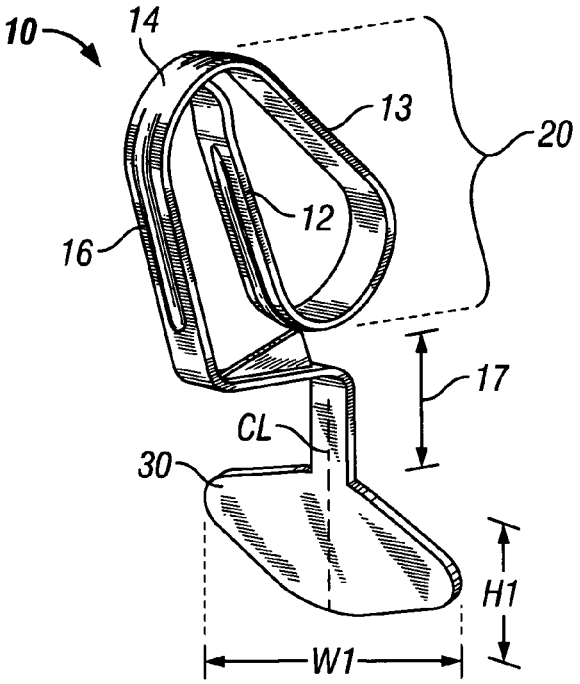

FIG. 8 depicts a still further embodiment of a hanger 10 according to the invention. As is shown, the hanger includes a hook end 20 which is comprised of the end member 12, flexibly connected to element 13, which is in turn flexibly connected to a top element 14, which in turn is flexibly connected to a part of the stalk 16. The stalk extends downwardly through a neck section 17, and terminates at a generally oblate shaped plate 30 having a width dimension (W1), a height dimension (H1) wherein the plate is generally symmetrically about the center line (CL) as depicted in the dotted line drawn on FIG. 6. The illustrated embodiment includes a bent neck 17 which is angled, thereby configuring the major part of the stalk 16 to be non-parallel to the plane of the plate 30, but rather is angled with respect thereto. Whereas the hanger 20 is depicted in a folded or otherwise coiled configuration, it is to be understood that the hook end can be extended by a user of the hanger and the cageless lavatory dispensing device to reconfigure said hook end 20 to form a hook end which can be used to suspend the hanger and the cageless lavatory dispensing device upon a part of a sanitary device particularly a toilet bowl rim. The embodiment according to FIG. 8 illustrates that, according to preferred embodiments, the plate 30 is substantially planar and as is shown is of a generally uniform thickness. The embodiment depicted in FIG. 8 is preferred in that the hook end 20 is tightly coiled when in its folded configuration, but when uncoiled or in its unfolded configuration and suspended from a part of a lavatory appliance, provides a significant degree of tension which is useful in retaining the respective position of the cageless lavatory dispensing device when installed upon a sanitary appliance, particularly when the hook is affixed on a part of a toilet bowl rim. Furthermore, as seen the bent neck 17 positions the plate 30 at a position which is rearward of the major portion of the stalk 16 but retains the plate 30 as being generally parallel thereto. Such positioning of the plate rearward of the major part of the stalk 16 is beneficial as ultimately, it acts to also thereby position the cast solid block enrobing the plate 30 such that when mounted upon a toilet bowl, the cast solid block is in contact with, or is in very proximity to the interior sloping side wall of a toilet bowl. Such positioning is advantageous in that it ensures that the cast solid block remains in the flow path of the flush water throughout the useful service life of the cageless lavatory dispensing device.

Figure 9A:
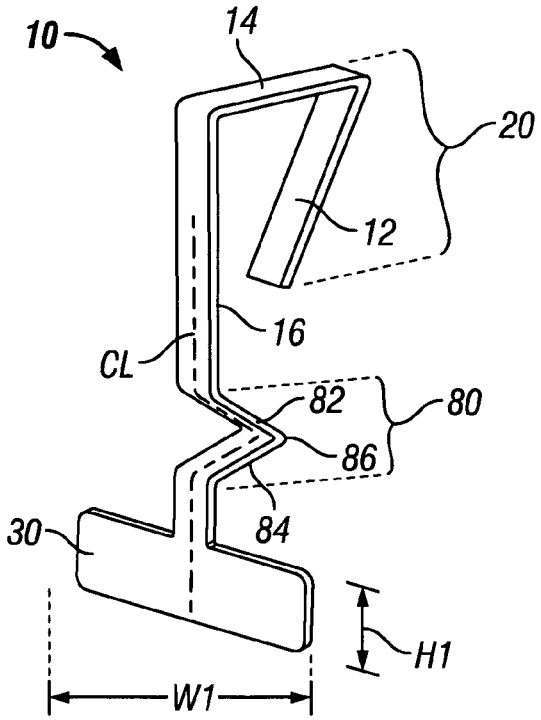
Figure 9B:
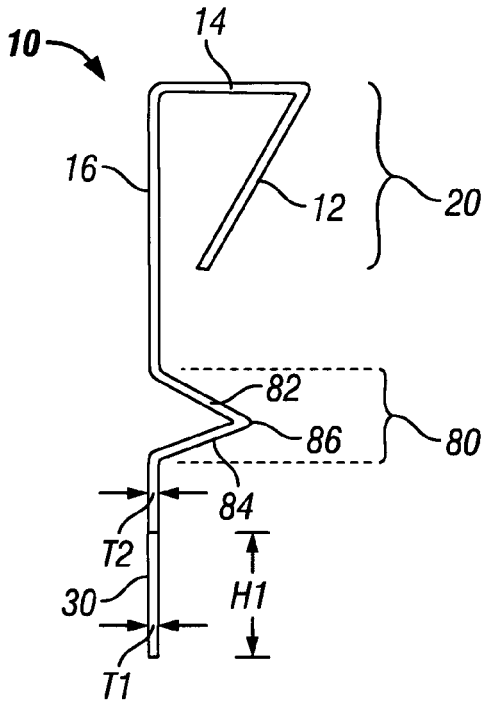

FIGS. 9A and 9B depict a hanger 10 comprising a hook end 20 comprising an end member 12 flexibly attached to a top member 14 as well as part of the stalk 16. Depending from the end of the stalk 16 distally from the hook end 20 is a plate 30. As can be seen from the perspective view provided by FIG. 1, the plate itself is generally planar and rectangular in configuration, and it is coplanar with the configuration and construction of both the stalk 16 and hook end 20. The plate 30 has a width dimension "W1" as well as a height dimension "H1" and as depicted, desirably the width is greater than the height. As is visible from the figure, the hanger 10 is generally symmetrical about a center line "CL" which is drawn with respect to the midline of the stalk 16. The center line does not exist as an actual element of the device but is illustrated for the sake of convenient reference. As is also visible in the figure, a portion of the stalk 16 is configured to extend rearwardly, namely in the direction of the hook end 20 to form a peak section 80. In the embodiment depicted, the peak section comprises a first peak segment 82 which extends rearwardly from the stalk 16 to a peak 86, and a second peak segment 84 which extends rearwardly from the stalk 16 to the same peak 86. As is visible in the depicted embodiment of FIG. 1. the stalk 16, first peak segment 82, peak 86, second peak segment 84 and the plate 30 are all integrally formed as parts of the hanger 10, and the first peak segment 82, peak 86, second peak segment 84 together define a peak section 80, which is preferably distal from the hook end 12 and nearer to, or adjacent to the plate 30. This is not required, but is preferred in certain embodiments as such requires no assembly subsequent to the initial fabrication of the hanger 10. As is also visible, the peak section 80 is a conveniently formed by the shape of the hanger which is formed by bends or other junctures between the respective segments and between the respective segments and the stalk 16 or plate 30. In the embodiment shown, the length of the first peak segment 82 and the second peak segment 84 are of equal lengths, however this is nor required of hangers 10 of the present invention. While not illustrated with sufficient particularity in the figure, it is of course understood that the plate, stalk 16 and the hook end 20 all have a thickness which may be consistent throughout, or which can vary.

FIG. 9B depicts a side view of the hanger of FIG. 9A. As is more clearly seen in this figure, the hook end 20 is formed from first and second elements 12, 14 and part of the stalk 16. In the embodiment shown, the length of the first peak segment 82 and the second peak segment 84 of the peak section 80 are of the same length, with both the first peak segment 82 and the second peak segment 84 joining at the peak 86. Depending from the stalk 16 is the plate 30. In this embodiment the plate 30 has a thickness "T1" which is equivalent to the thickness "T2" of the stalk 16 and the hook end 20. Of course, it will be understood that each of the hook end, stalk, and plate can have different thicknesses or can all share the same thickness as illustrated in FIG. 9A.

An important feature of the embodiment according to FIGS. 9A and 9B is that the peak section 80 may also operate a standoff element.

Figure 10A:
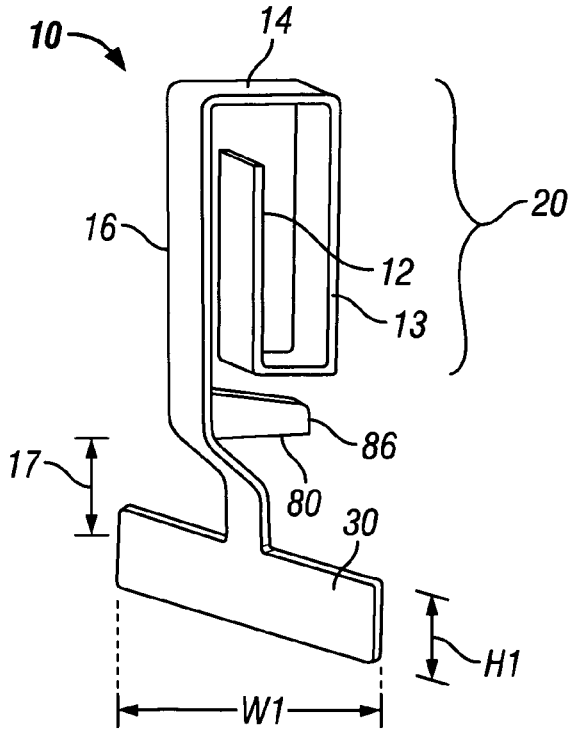
Figure 10B:
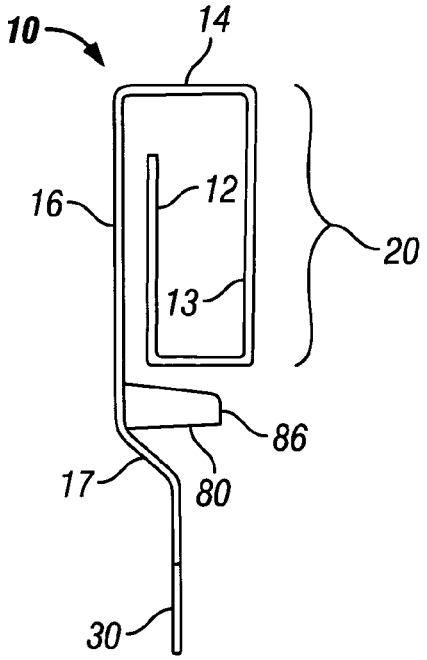

FIGS. 10A and 10B depicts a further embodiment of a hanger 10 according to the invention, in which the hook end 20 is a flexible element, and a standoff element 80 which is intermediate the hook end and the plate 30 of the hanger. The standoff element 80 extends rearwardly from a part of the stalk 16 in the same direction as the hook end 20 extends from the stalk 16. While the hook end is integrally formed with stalk 16 and is proximate to the plate 30 as is illustrated in the figures, it is to be understood that the standoff element 80 may be a discrete element which may be affixed to a part of the hanger 10, advantageously to a part of the stalk 16 by any suitable means. Inter alia, such means may be mechanical means such as interlocking elements such as cooperating snap-fittings and/or chemical means such as an adhesive or by welding or fusing of these elements. As can be seen from the figures, the hook end is comprised of an end element 12 flexibly connected to second hook element 13 which is in turn connected to a top element 14 which in turn is flexibly connected to the stalk 16. At the end of the stalk 16 opposite the hook end, viz, the distal end of the stalk depends the plate 30, here having an planar, oblate configuration. As is further visible from FIG. 3, the plate 30 is substantially planar in configuration has a width W1 as well as height H1 and is symmetric around the center line CL of the stalk 16. The plate 30 has a generally rectangular configuration and depends from the stalk 16 via an intermediate bent neck section 17 of the stalk 16.

While not specifically illustrated in FIGS. 10A and 10B it is to be understood that the hook end 20 of the hanger 10 is depicted in a first, "folded" configuration which permits for the hanger 10 to be compact and conveniently packaged. However, when at least the hook end 20 of the hanger 10 is fabricated of a flexible material, the elements of the hook end 20, especially the a end element 12 flexibly connected to second hook element 13 may be flexed to form the hook end 20 so that it may be placed about the rim of a portion of a sanitary device, i.e. a toilet bowl. Such elements form an articulated hook which may be extended from the stalk 16. This action imparts tension to the hook end 20 and also causes the hook end to 20 impart a degree of gripping to that portion of the rim upon which it is mounted. This is turn helps retain the relative position of the hook end, as well as that of the cageless lavatory device until repositioned, or removed by a consumer. At the same time however the peak point 86 of the standoff element 80 is adapted to contact a part of the sanitary appliance, typically a sidewall of a toilet bowl.

FIGS. 11A through 11G depict in various views of a particularly preferred embodiment of a hanger 10 according to the invention which comprises a peak section 80, and which is illustrated both with and without the cast solid block composition affixed to the plate 50

Figure 11A:
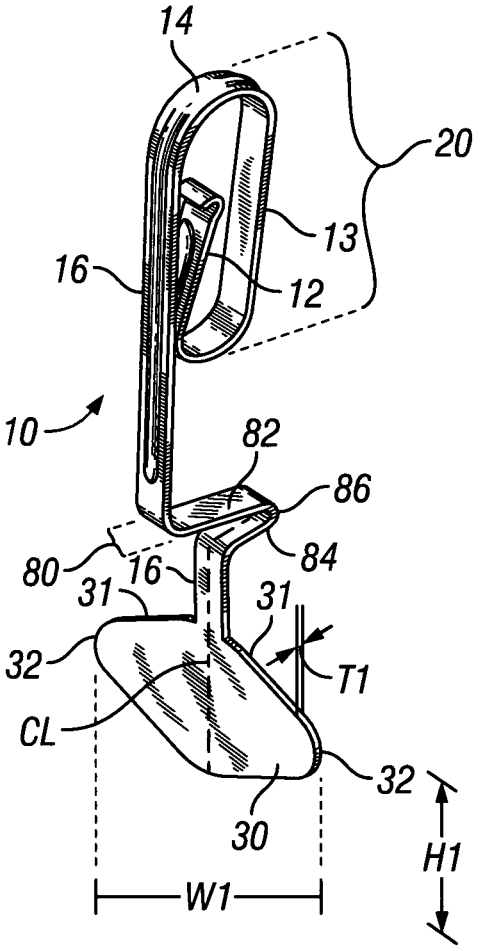

FIG. 11A depicts a one-piece hanger 10 formed of a flexible material, e.g., a thermoplastic polymer. The hanger 10 comprises a hook end 20 comprising a first hook element 12, a second hook element 13 and a top member 14 which in turn is connected to a downwardly extending stalk 16, which terminates in plate 30. Intermediate the hook end 20 and the plate 30, a portion of the stalk 16 is configured to extend rearwardly, namely in the direction of the hook end 20 to form a peak section 80. As depicted, the peak section 80 comprises a first peak segment 82 which extends rearwardly from the stalk 16 to a peak 86, and a second peak segment 84 which extends rearwardly from the stalk 16 to the same peak 86. As is visible in the depicted embodiment of FIG. 11A the stalk 16, first peak segment 82, peak 86, second peak segment 84 and the plate 30 are all integrally formed as parts of the hanger 10. Further as depicted, the length of the first peak segment 82 and the second peak segment 84 are unequal, with the former being longer than the latter. The plate 30 is a generally flat planar plate having a maximum width W1 which is at least 1.2 times the dimension of its maximum height H1. The plate 30 depends from a part of the stalk 16 and is a symmetrical about the center line "CL" of the stalk 16. The plate 30 also has a thickness "T1", and as illustrated on the figure, has top edges 31 which are generally straight and are angled downwardly with respect to the stem 16. The top edges 31 continue to the region of the side vertices 32 of the plate 30 which are rounded. The plate 30 is also generally symmetrical about a line which would extend between the two side vertices 32 of the plate 30.

While not disclosed in the figure, it is to be understood that the hook end 20 is flexible and in the figures shown are in a folded configuration. However, the elements of the hook end may be readily unfolded by a consumer so to adapt the hanger 10 to be suspended upon a part of a sanitary appliance.

Figure 11B:
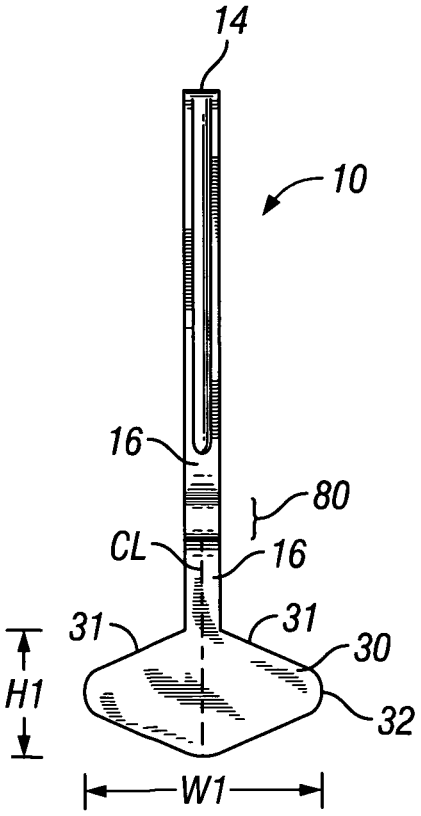

FIG. 11B depicts a frontal view of the hanger of FIG. 11A. As is visible in that figure, the plate 30 includes is essentially flat and planar, and excludes any perforations passing therethrough as well as excluding any outwardly extending from either the front face 37 or the rear face 37' of the plate 30.

Figure 11C:
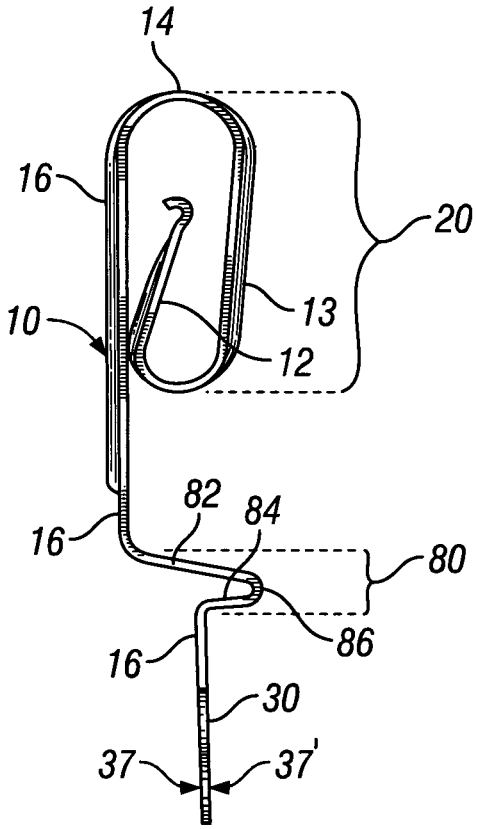

FIG. 11C depicts a side view of the hanger 10 of prior FIGS. 11A and 11B. As is more evident from the figure, the peak section 80 extends in the same direction as that of the hook end 20, and particularly at least the top element 14 which extends rearwardly from the stalk 16. As may be also understood from the figure, in preferred embodiments the hook end 20 and the peak section 80 are preferably coplanar with respect to one another, while the plate 30 is preferably approximately perpendicular to this plane within which the hook end 20 and the peak section 80 are coincident. Also more clearly visible is the absence any outwardly extending from either the front face 37 or the rear face 37' of the plate 30.

Figure 11D:
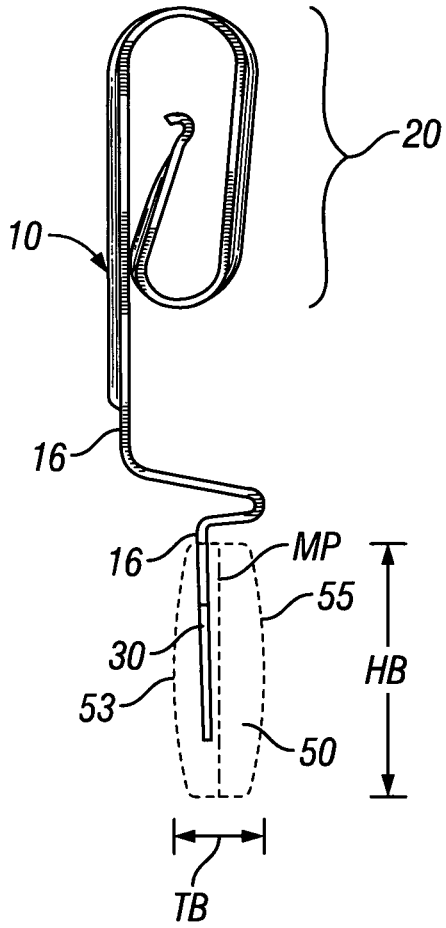

FIG. 11D is a further illustration of the hanger 10 of FIG. 11C however the figure further illustrates a cast solid block 50 encasing the hanger 30 and here, also part of the stalk 16 immediately adjacent to the plate 30. The said block 50 is depicted in phantom for sake of convenient review of the features of the hanger 10. The cast solid block 50 has a thickness "TB" as well as a height "HB". FIG. 11D illustrates a preferred embodiment of the invention, namely wherein the plate 30 is positioned on the interior of the cast block 50 and is in a plane parallel to the mid-plane "MP" which bisects the block 50 and particularly is between the mid-plane MP and the front face 53 of the block 50. The front face 53 of the block 50 is the face which faces the interior of a sanitary appliance, here the interior of a toilet bowl WC, while the back face 55 is intended to be positioned adjacent to or abutting the interior sidewall SW of a sanitary appliance, particularly that of a toilet bowl WC.

Figure 11E:
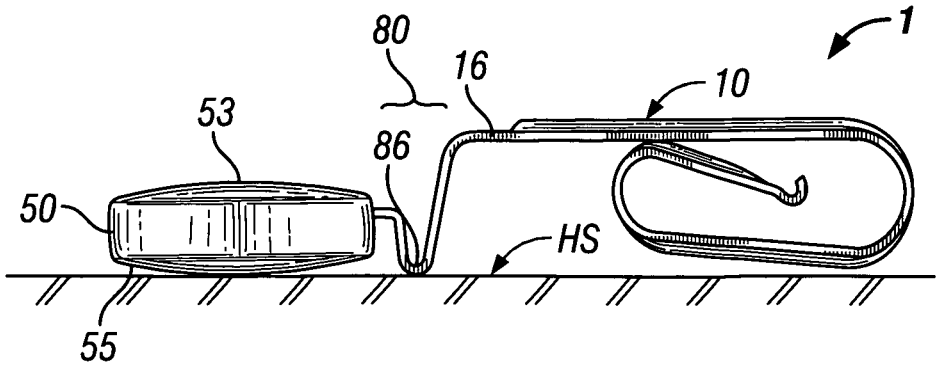

FIG. 11E depicts the embodiment depicted on FIG. 11D, however illustrates the cast solid block 50 in solid lines. The depiction illustrates that in accordance with particularly preferred embodiments, when the cageless lavatory dispensing device 1 is laid upon a flat horizontal surface "HS", such that the peak 86 is sufficiently extended to raise at least a part of the rearward face 55 of the cast solid block 50 from contacting the horizontal surface. In this figure, none of the cast solid block 50 is in contact with the horizontal surface HS.

Figure 11F:
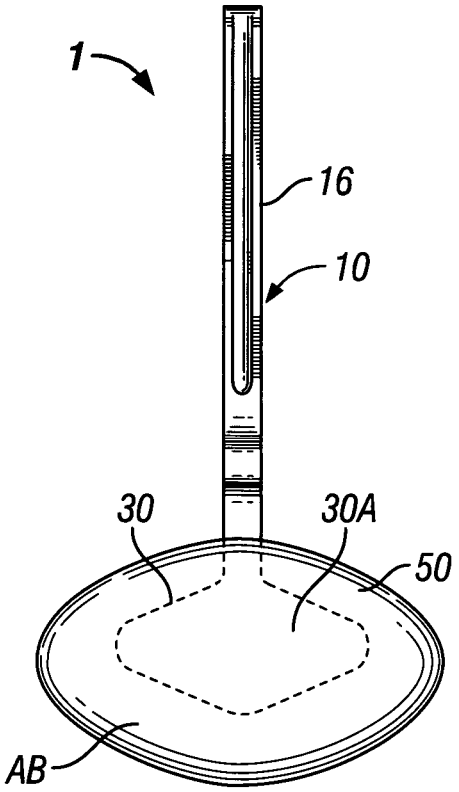

FIG. 11F illustrates a frontal view of the embodiment of the cageless lavatory dispensing device 1 depicted on FIGS. 11D and 11E. For sake of convenience, the plate 30 embedded within the cast block 50 is depicted in phantom. As is illustrated in the figure, the respective areas of the plate 30A and the area AB of the cast block 50 at the transverse plane coincident with a face of the plate 30A, further illustrating a preferred ratio of these two surface areas.

Figure 11G:
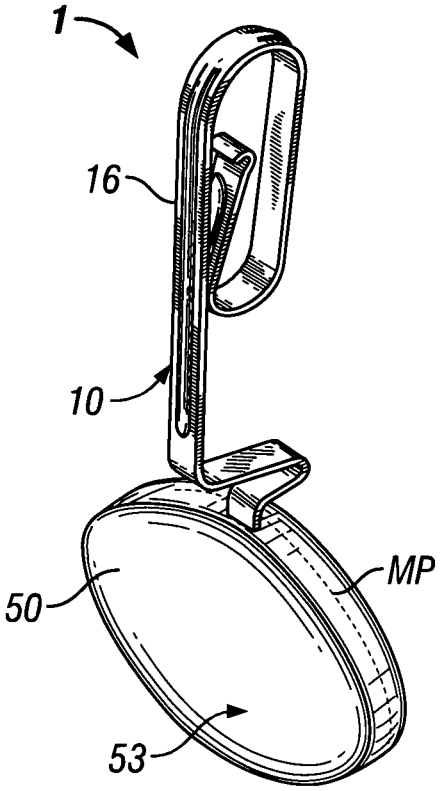

FIG. 11G illustrates a top and side perspective view of the cageless lavatory dispensing device 1 of prior FIGS. 11D, 11E and 11F illustrating the relationship of the placement of the plate 30 within the block 50. More specifically the plane of the plate 30 is between the mid-plane MP and the front face 53 of the block 50. This embodiment of the cageless lavatory dispensing device 1 illustrates a particularly preferred embodiment of the invention.

Figure 12A:
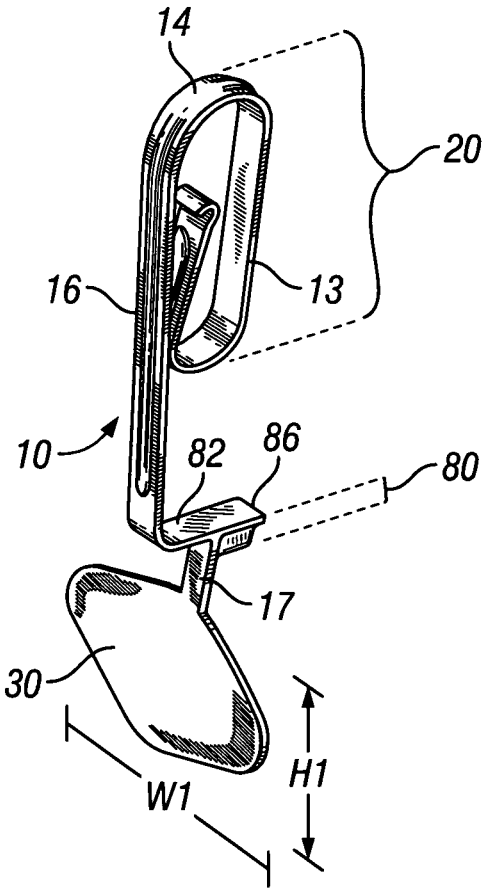
Figure 12B:
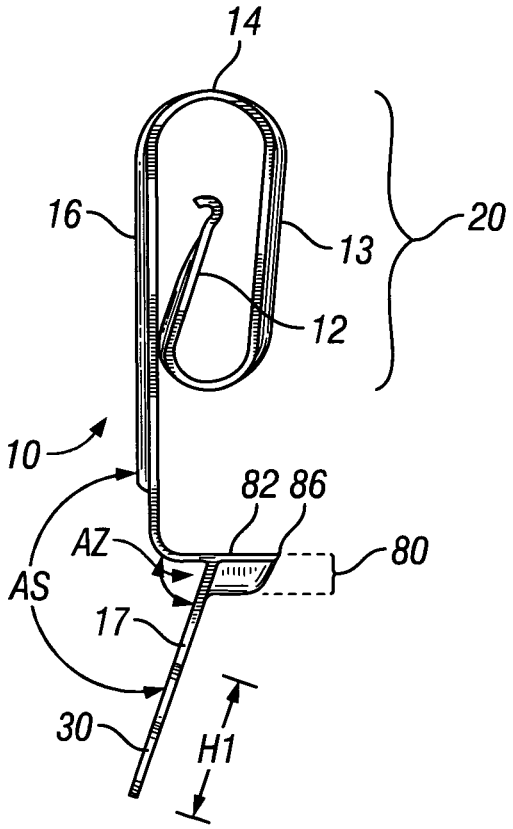

FIGS. 12A and 12B depicts a still further embodiment of a hanger 10 according to the invention which comprises a further embodiment of a peak section 80. As is shown, the hanger includes a hook end 20 which is comprised of the end member 12, flexibly connected to an intermediate element 13, which is in turn flexibly connected to a top element 14, which in turn is flexibly connected to a part of the stalk 16. The opposite end of the stalk terminates in a generally oblate (or "diamond") shaped plate 30 having a width dimension (W1), a height dimension (H1). Whereas the hanger is depicted in a folded or otherwise coiled configuration, it is to be understood that the hook end can be extended by a user of the hanger and the cageless lavatory dispensing device to reconfigure said hook end 20 to form a hook end which can be used to suspend the hanger and the cageless lavatory dispensing device upon a part of a sanitary device particularly a toilet bowl rim. The embodiments according to FIGS. 12A and 12B also illustrate that, according to preferred embodiments, the plate 30 is substantially planar and as is shown in the figures and is of generally uniform thickness. The embodiment of the hook end 20 as depicted in the figures is preferred in that the hook end 20 is particularly well coiled when in its folded configuration, but when uncoiled or in its unfolded configuration, provides a significant degree of tension which is useful in retaining the respective position of the cageless lavatory dispensing device when installed upon a sanitary appliance, particularly when the hook is affixed on a part of a toilet bowl rim. Furthermore, as is visible the stalk 16 extends downwardly and rearwardly such that it bends in the direction of the hook end 20 and defines a first peak segment 82 which extends rearwardly from the stalk 16 to a peak 86; said first peak segment 82 which terminates at a peak 86 also simultaneously also defines a standoff. Depending downwardly from the first peak segment 82 is a bent neck 17 from which depends the plate 30. As depicted, the bent neck 17 forms an angle "AZ" with respect to the stalk 16 and also, forms a second angle "AS" between the face of the plate 30 and the stalk 16.

Desirably, in all embodiments of the invention (and not limited to the embodiment of FIGS. 12A and 12B) wherein the stalk 16 and the plate 30 are angled with respect to one another, as represented by angle AS, angle AS is between 90°-180°, but preferably is between 100° and 170°, and most preferably is between 100° and 145°. Such an angular relationship between the stalk 16 and the plate 30 are relevant to the invention wherein the hanger includes or excludes a standoff section 80. Similarly in all embodiments of the invention wherein the stalk 16 and the bent neck 17 are angled with respect to one another, as represented by angle AS, angle AS is between 0°-90°, but preferably is between 10° and 80°, and most preferably is between 15° and 55°. Such an angular positioning of the plate 30 which ultimately supports the a cast solid block may be advantageous This positioning rearward of the major part of the stalk 16 is beneficial as ultimately, it acts to also thereby position the cast solid block enrobing the plate 30 such that when the hanger 10 is mounted upon a toilet bowl, the cast solid block may be positioned in the proximity to the interior sloping side wall of a toilet bowl but at an angle away therefrom. Such positioning is advantageous in that it ensures that the cast solid block remains in the flow path of the flush water throughout the useful service life of the cageless lavatory dispensing device, but minimizes the likelihood of physical contact of the cast solid block and the interior sidewall of a toilet bowl.

Figure 13A:
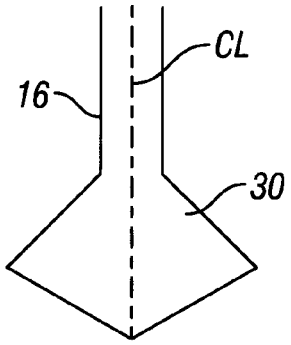
Figure 13B:
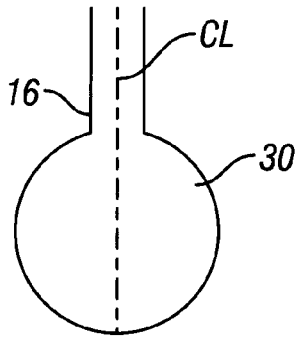
Figure 13C:
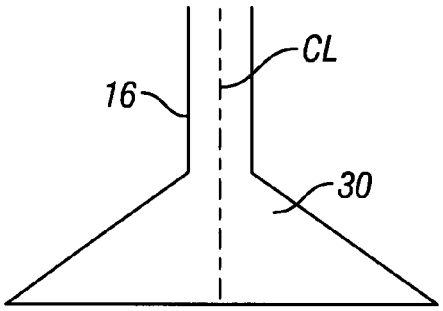
Figure 13D:
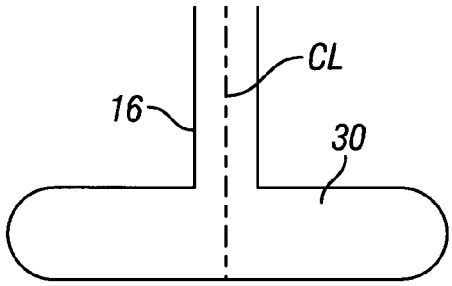

FIGS. 13A through 13D depict various alternate configurations which may also be used for the plate 30 for the hanger as described herein. FIG. 13A depicts a diamond-shaped plate 30 depending at one vertex from the stalk 16. FIG. 13B depicts a substantially circular plate 30 depending from one part of its circumference from the stalk 16. FIG. 13C depicts an equilateral-triangular shaped plate 30 depending at one vertex from the stalk 16. FIG. 13D depicts a further plate 30 which is generally rectangular but having two opposite semi-circular ends depending from the stalk 16. In each of the foregoing, it is seen that the configuration of the plates is generally symmetrical about the center line, CL.

Figure 14:
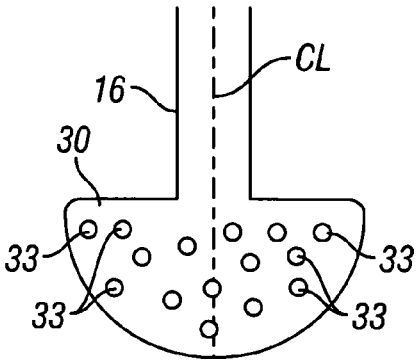

FIG. 14 depicts an embodiment of a portion of the hanger wherein the plate 30 includes a series of perforations 33 passing therethrough. As is depicted, the perforations are not symmetrical with respect to either the center line CL or the configuration of the semi-circular shaped plate 30. As noted above, plates 30 having perforations passing there through are less preferred embodiments of the hangers and useful with the lavatory dispensing devices taught herein.

Figure 15A:
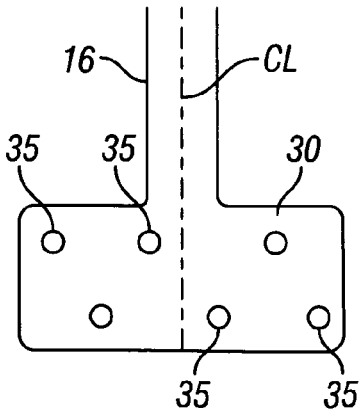
Figure 15B:
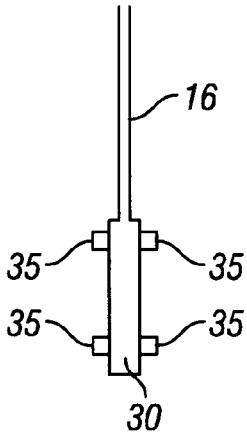

FIGS. 15A and 15B depict in two views an embodiment of a plate 30 depending from a stalk 16 wherein the plate comprises at least one, here a plurality of projections 35 extending outwardly from the generally planar and opposite faces 37, 37 of the plate. As is seen in particular in FIG. 15B, the projections 35 are in the form of generally cylindrical studs having a base coincident with the respective face 37, 37' of the plate 30. The studs terminate at flat ends, by may have different configurations, i.e., semicircular, conical or frustoconical. The studs, when present, advantageously have a height which is approximately equal to, or slightly greater than thickness of the plate 30. The studs 33 may extend outwardly from one, or both sides of the plate 30 the latter embodiment being illustrated on FIG. 15B. Again, while these figures depict the utility of outwardly extending elements extending outward from the plate, again, as noted above embodiments of the hanger having such outwardly extending elements from the plate are less preferred.

Figure 16A:
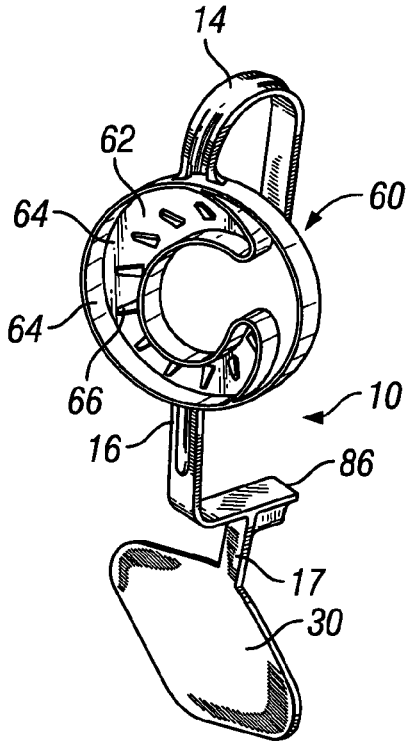
Figure 16B:
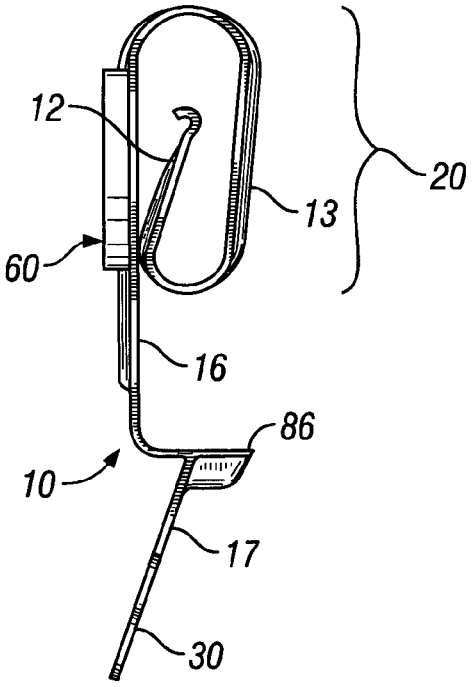

FIGS. 16A and 16B depict a hanger 10 including an embodiment of an air treatment dispenser 60. As is visible by inspection thereof the hanger 10 is similar in many respects to that described with reference to FIGS. 12A and 12B and are distinguishable thereover by the addition of the air treatment dispenser 60 which is shown generally depending from the stalk 16. The air treatment dispenser 60 illustrated is adapted to contain a quantity of an air treatment composition (not shown) in a cavity 62 which is defined by a sidewall 64 extending outwardly/upwardly from a bottom 65. The sidewall 64 depicted defines a fanciful "C" shaped cavity but any other shape might also be used. The cavity 62 further includes a series of upstanding tapered pins 66 which extend from the bottom 65 and are present in the interior of the cavity 62; the presence of such pins 66, while optional, provides a useful support for a gel type air treatment composition, or a solid air treatment composition, such as is the gel system described in U.S. Pat. No. 5,780,527. As is also evident, the cavity 62 is positioned such that it is adapted to be facing the interior of a toilet bowl or other sanitary appliance upon which the hanger 10 may be mounted, thus the contents of the cavity 62 provide a release of the air treatment composition in the direction of the interior of a toilet bowl or other sanitary appliance.

FIG. 16B illustrates a side view of the hanger 10 depicting the arrangement of the air treatment dispenser 60 with respect to the stalk 16 of the hanger 10. While not illustrated it is understood that the air treatment dispenser 60 is either integrally formed with the hanger 10 or is permanently affixed thereto such as by means of an adhesive or welding of portions of the air treatment dispenser 60 with the stalk 16.

While not illustrated, it is to be understood that the air treatment dispenser 60 may be repositioned with respect to the hanger 10. In one alternative the orientation of the air treatment dispenser 60 is reversed such that the cavity 62 faces the stalk 16 and the cavity faces the hook end 20. In a further alternative the air treatment dispenser 60 may be affixed to or suspended from the end member 12; in such a position the air treatment dispenser 60 is adapted to be exterior of the toilet bowl or sanitary appliance upon which the hanger 10 is mounted and emanates the fragrance or other air treatment composition to ambient environment exterior of the toilet bowl or other lavatory appliance.

Figure 17:
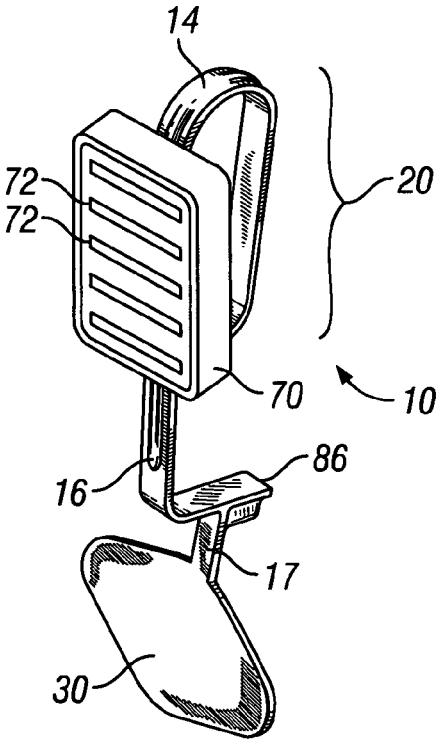

FIG. 17 depicts a further hanger 10 including an embodiment of an air treatment dispenser 70. As is visible by inspection thereof the hanger 10 is similar in many respects to that described with reference to FIGS. 12A and 12B but are distinguishable thereover by the addition of the air treatment dispenser 70 which is shown generally depending from the stalk 16. The air treatment dispenser 70 is a housing which is adapted to contain a quantity of an air treatment composition, e.g., a fragrance, or other volatile material which may exit the interior of the air treatment dispenser 70 via the passages 72 present. As is understood from the figure, the passages 72 of the air treatment dispenser 70 are positioned such that they are adapted to face the interior of a toilet bowl or other sanitary appliance upon which the hanger 10 may be mounted, thus the air treatment dispenser 70 provide a release of the air treatment composition in the direction of the interior of a toilet bowl or other sanitary appliance.

While not illustrated, it is to be understood that the air treatment dispenser 70 may be repositioned with respect to the hanger 10. In one alternative the orientation of the air treatment dispenser 70 is reversed such that the passages 72 face the stalk 16 and the hook end 20. In a further alternative the air treatment dispenser 70 may be affixed to or suspended from the end member 12; in such a position the air treatment dispenser 70 is adapted to be exterior of the toilet bowl or sanitary appliance upon which the hanger 10 is mounted and emanates the fragrance or other air treatment composition to ambient environment exterior of the toilet bowl or other lavatory appliance.

In certain preferred embodiments the air treatment dispenser 70 may be replaceable upon the hanger 10 or may contain a refill cartridge (not shown) or other refill element which may be used to resupply the air treatment dispenser 70 with a further quantity of an air treatment composition, e.g., a fragrance when necessary, such as upon the prior exhaustion of a prior refill cartridge or air treatment dispenser 70.

Figure 18A:
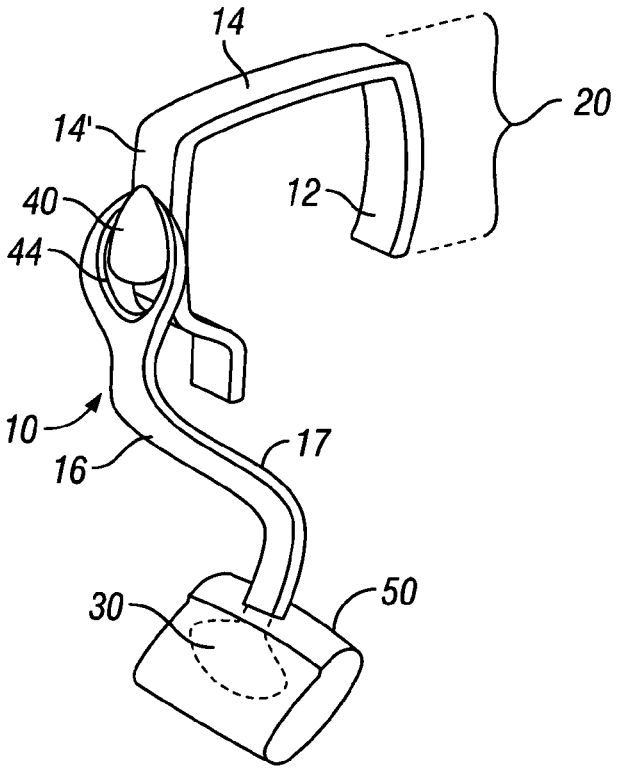
Figure 18B:
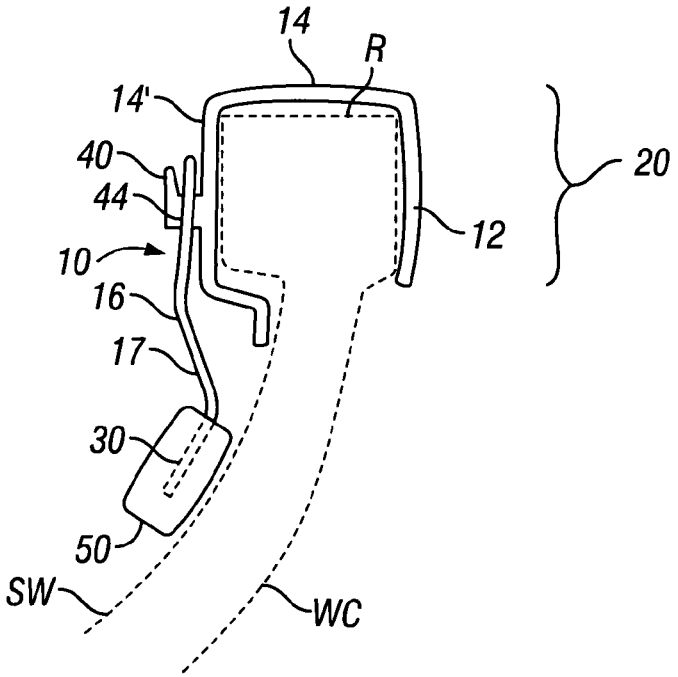

FIGS. 18A and 18B depict two views of an embodiment of a two-part cageless lavatory dispensing device 10 of the invention. FIG. 18A depicts a perspective view of a hook end 20 comprising an end member 12, a top element 14 and a front element 14' having extending from a part thereof a hanger peg 40. The hook end 20 is configured to be suspended upon the rim of a toilet bowl "WC" and may be used a single time but desirably is used several times by a consumer. The second part of the cageless lavatory dispensing device of the invention 10 includes a stalk 16 having at a proximal end an eyelet or loop 44 which is sufficiently sized so that the stalk 16 may be removably affixed to and suspended from the hanger peg 40. The stalk 16 extends downwardly from the proximal end to the distal end and includes a slanting neck 17, which terminates in plate 30 which is encased in a cast solid block 50. This second part may be installed by a user, and when the cast solid block 50 is consumed, this second part may be removed by the consumer and replaced with a further second part with a new cast solid block 50 and utilized.

As is more clearly depicted on FIG. 18B, the hook end 20 is mounted upon a part of a rim "R" of a toilet bowl "WC". The second part is suspended by eyelet 44 such that the cast solid block 50 is positioned adjacent to or upon the inner sidewall "SW" of the toilet bowl WC. In this manner, flush water released from the rim downwardly into the toilet bowl WC contacts the cast solid block 50 to form a treatment composition which is used to treat the toilet bowl.

While a cooperating hanger peg 40 and eyelet 44 exemplified one embodiment of a useful fastener means which may be used to assemble a cageless lavatory dispensing device 10 within the meaning of the invention, it is contemplated that any other effective fastener means or cooperative fastener elements as discussed above, particularly mechanical means and/or chemical means may be used as well and is considered to be within the scope of the invention, although not specifically depicted in the figures. It is also contemplated that the dispensing devices 10 may also further include an air treatment dispenser which may be advantageously present on the stalk 16 and/or on the top element 14 or end element 12.

Figure 19:
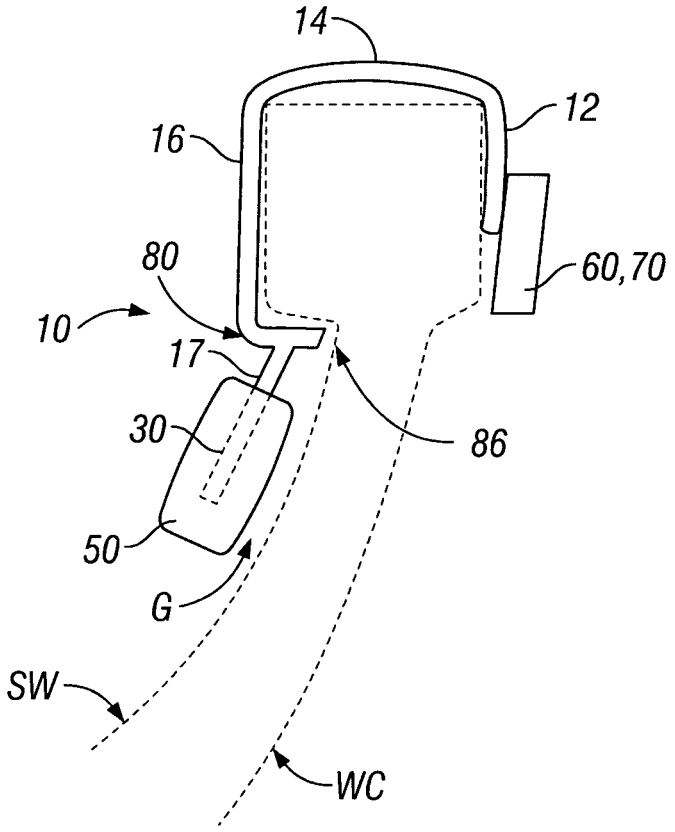

FIG. 19 depicts an embodiment of a dispensing device 10 of the invention which includes a standoff section 80 configured for use as an ITB device, illustrating the device 10 mounted on the rim "R" of a toilet bowl "WC". As seen in the figure a hook end 20 comprising an end element 12, and a top element 14 are configured to be suspended upon the rim of a toilet bowl "WC". The hanger 10 includes a stalk 16 which extends downwardly and includes an integrally formed standoff section 80 comprising parts of the stalk 16 adjacent to the peak point 86, which stalk 16 continues to extend downwardly and terminates via a bent neck section 17 at plate 30 which is encased in a cast solid block 50. As is seen from the figure, the dimensions of the hanger 10 are such that when it is installed in a toilet bowl, the peak point 86 contacts a part of the inner sidewall "SW" of the toilet bowl and lifts the block 50 from physical contact with said inner sidewall SW defining an intermediate gap "G". In this manner, flush water released from the rim downwardly into the toilet bowl WC contacts the cast solid block 50 to form a treatment composition which is used to treat the toilet bowl. Part of the flush water also flows in the gap G wherein it flushes the rear face of the block 50 as well. Subsequent to the flush cycle, the block 50 rests out of contact with the sidewall SW and above the remaining water present in the toilet bowl WC thus providing an opportunity for the block to dry between flushes. The figure further illustrates the position of an air treatment dispenser 60, 70 which is provided. As is seen, the air treatment dispenser 60, 70 is mounted via the hanger 10 on the exterior of the toilet bowl WC so to supply an air treatment benefit which is directed to the exterior ambient environment of the toilet bowl WC. Such may be beneficial to provide an air treatment benefit when the interior of the toilet bowl is covered between uses, such as by a toilet seat and/or toilet set cover. It is to be understood that while not depicted, that the air treatment dispenser 60, 70 may be mounted via the hanger 10 such that it is directed towards the interior of the toilet bowl WC so to supply an air treatment benefit which is directed to the interior ambient environment of the toilet bowl WC. For instance, the air treatment dispenser 60, 70 may be mounted on a further part of the hanger 10 such as upon the stalk 16 or bent neck 17 using suitable means. Such a configuration may be beneficial in order to provide an air treatment benefit to the interior of the toilet bowl especially when it is covered between uses, such as by a toilet seat and/or toilet set cover. In any case, the provision of an air treatment dispenser 60, 70 as illustrated and/or as described immediately above may be omitted from any embodiment of the hanger 10, particularly if no air treatment benefit is required or desired, or wherein the composition of the cast block contains a fragrance or other constituent which may provide an air treatment benefit.

While the hanger depicted in FIG. 19 is similar to the hanger disclosed and discussed with reference to FIGS. 12A and 12B, such is to be understood by way of illustration and not by way of limitation and other hangers according to the invention, and advantageously those which comprise a standoff section may be suspended in a lavatory appliance and used in a similar manner although not specifically depicted in the figures.

Figure 20A:
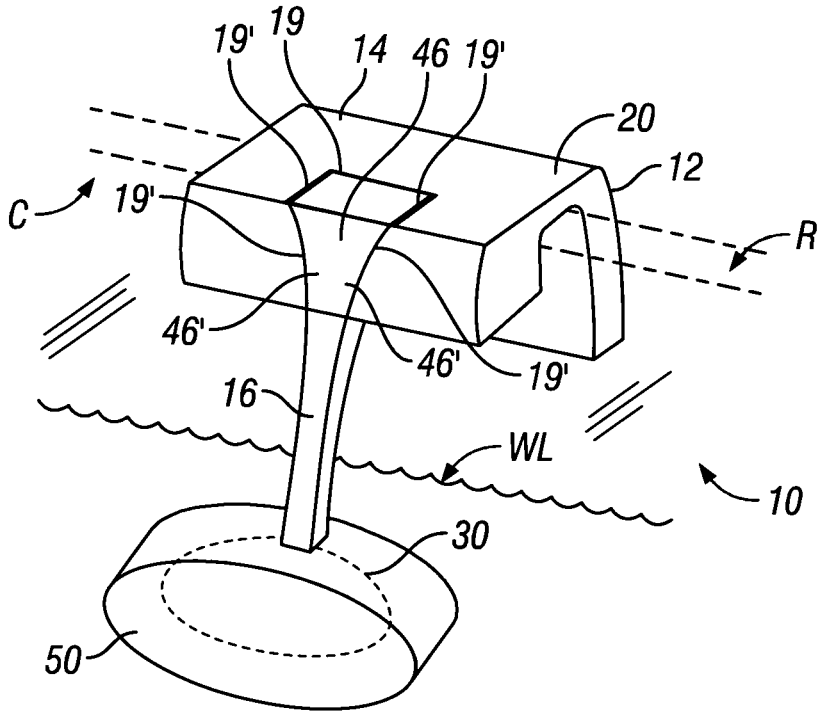
Figure 20B:
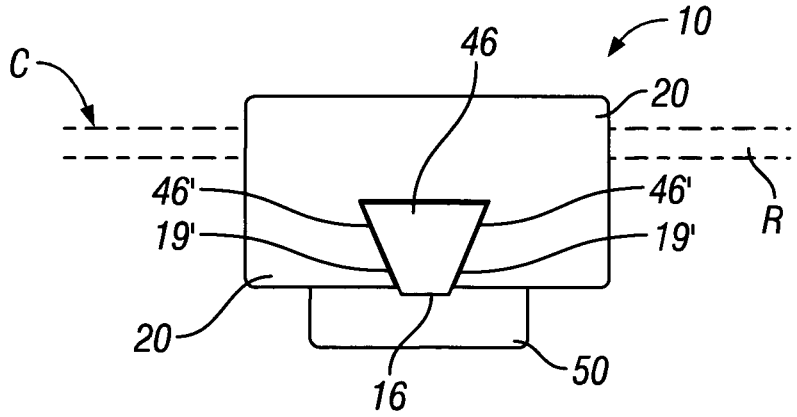

FIGS. 20A and 20B depict two views of an embodiment of a two-part cageless lavatory dispensing device 10 of the invention configured for use as an ITC device.

FIG. 20A depicts a perspective view of a two-part cageless lavatory dispensing device 10 comprising a first part, a rigid hook end 20 adapted to be suspended upon the rim "R" of a toilet cistern "C", and a second part, a stalk 16 having a sloped, tenon-shaped proximal end 46 inserted in a suitably shaped mortise 19 present in the hook end 20, and at its distal end a plate 30 encased by a cast solid block 50. The stalk 16 is of sufficient length that between flushes of the toilet to which it is attached, the block 50 is submerged beneath the water line "WL" so that the water contacts the block 50 to form a treatment composition within the cistern C. As is more clearly visible from FIG. 20B, the mortise 19 includes two sloped mortise sidewalls 19' which abut correspondingly shaped tenon sidewalls 46' of the proximal end 46 of the stalk 16. Further, as is more apparent from FIG. 11A the tenon sidewalls 46' of the proximal end 46 of the stalk 16 are seen to taper inwardly toward one another as well, as well as the two sloped mortise sidewalls 19' which are configured to correspondingly conform.

Figure 21A:
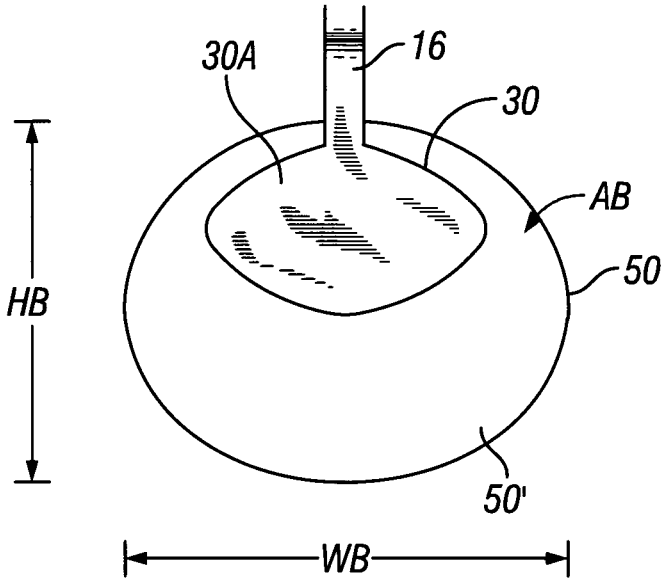

FIGS. 21A, 22B and 22C depict respectively a front sectional view of a cast solid block 50 encasing/enrobing a plate 30 which depends from a stalk 16, while the latter two figures depict alternate side views of the foregoing. As is depicted on FIGS. 21B and 21C, there is depicted a cast solid block 50 encasing the plate 30 as well as the stalk 16 extending outwardly from the cast solid block. The cast solid block has a thickness "TB" as well as a height "HB".

Figure 21B:
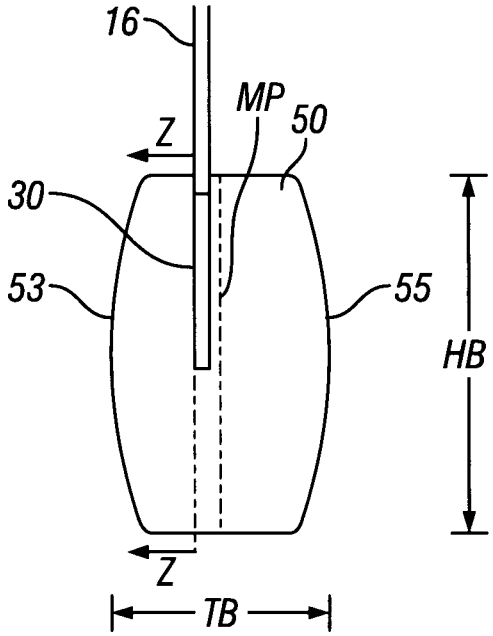

FIG. 21B illustrates one preferred embodiment of the invention, namely wherein the plate 30 is positioned on the interior of the block 50 and is in a plane parallel to the mid-plane "MP" which bisects the block 50 and is between the mid-plane MP and the front face 53 of the block 50. The front face 53 of the block 50 is the face which faces the interior of a sanitary appliance, here the interior of a toilet bowl WC, while the back face 55 is intended to be positioned adjacent to or abutting the interior sidewall SW of the toilet bowl WC. Further depicted on FIG. 21B is a sectional line "ZZ" which is intended to indicate a cross section of the block 50 coincident with a face of the plate 30. As can be understood with reference to the figure, the cross sectional area of the base has dimension 30A, which is less than about half of the surface area AB of the section of the cast solid block 50 which is coincident with the face of the plate 30. More accurately, it should be understood that the calculation of respective ratios of the plate area, 30A to the cross sectional area of the block, AB, is made with the plate 30 being removed from the cast solid block so that the area AB is unobscured.

Figure 21C:
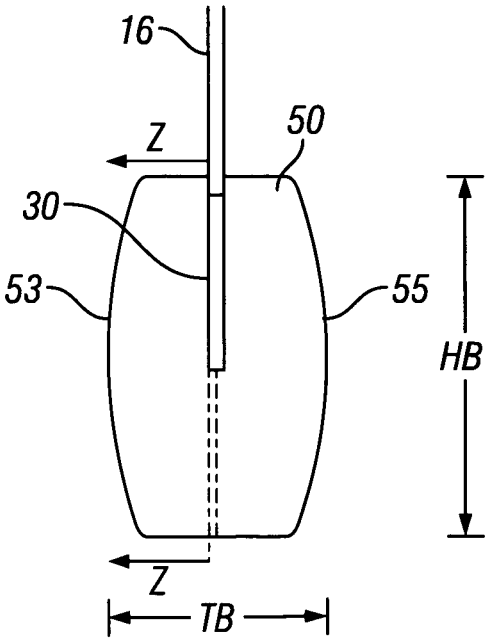

FIG. 21C illustrates a further and more preferred embodiment of the invention similar to FIG. 21B but distinguishable in that the plate 30 is positioned on the interior of the block 50 and is in a plane coincident to the mid-plane "MP" which bisects the block between the front face 53 of the block 50 and the back face 55 of the block 50. The front face 53 of the block 50 is the face which faces the interior of a sanitary appliance, here the interior of a toilet bowl WC, while the back face 55 is intended to be positioned adjacent to or abutting the interior sidewall SW of the toilet bowl WC. Further depicted on FIG. 21B is a sectional line "ZZ" which is intended to indicate a cross section of the block 50 coincident with a face of the plate 30. As can be understood with reference to the figure, the cross sectional area of the base has dimension 30A, which is less than about half of the surface area AB of the section of the cast solid block 50 which is coincident with the face of the plate 30. More accurately, it should be understood that the calculation of respective ratios of the plate area, 30A to the cross sectional area of the block, AB, is made with the plate 30 being removed from the cast solid block so that the area AB is unobscured.

Figure 22:
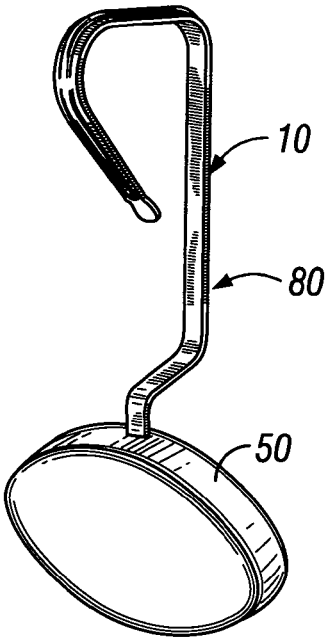

FIG. 22 depicts a further embodiment of a lavatory dispensing device 80 according to the invention including hanger 10 as previously described with reference to FIG. 7, a part of which is encased or enrobed in a cast solid block composition 50.

Figure 23:
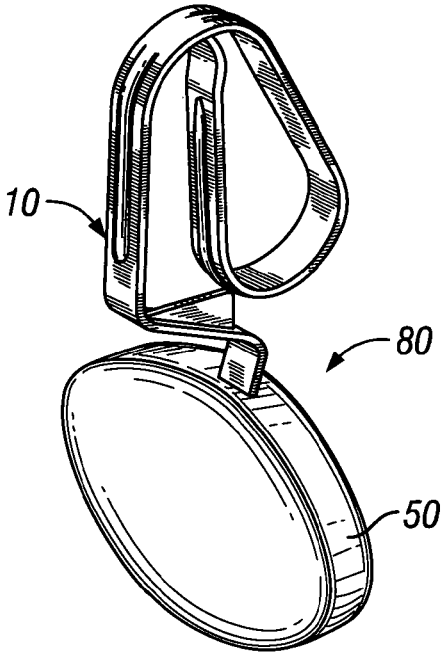

FIG. 23 depicts a yet further embodiment of a lavatory dispensing device 80 according to the invention including hanger 10 as previously described with reference to FIG. 8, a part of which is encased or enrobed in a cast solid block composition 50.

Figure 24:
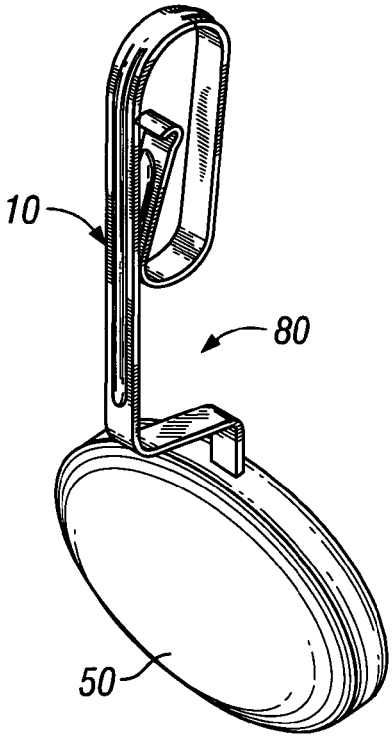

FIG. 24 depicts a further embodiment of a lavatory dispensing device 80 according to the invention including hanger 10 as previously described with reference to FIG. 6, a part of which is encased or enrobed in a cast solid block composition 50.

Figure 25:
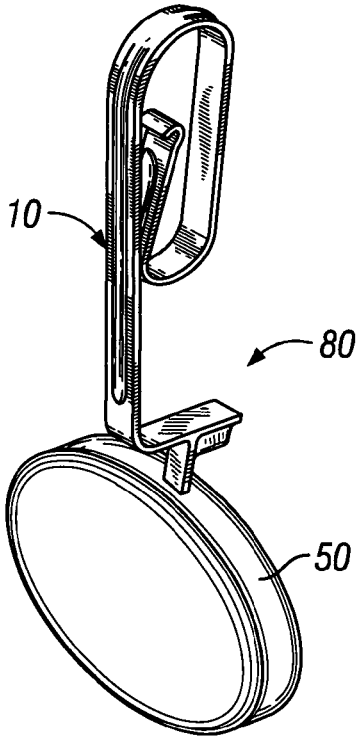

FIG. 25 depicts a yet further embodiment of a lavatory dispensing device 80 according to the invention including hanger 10 as previously described with reference to FIGS. 12A and 12B, a part of which is encased or enrobed in a cast solid block composition 50.

Figure 26:
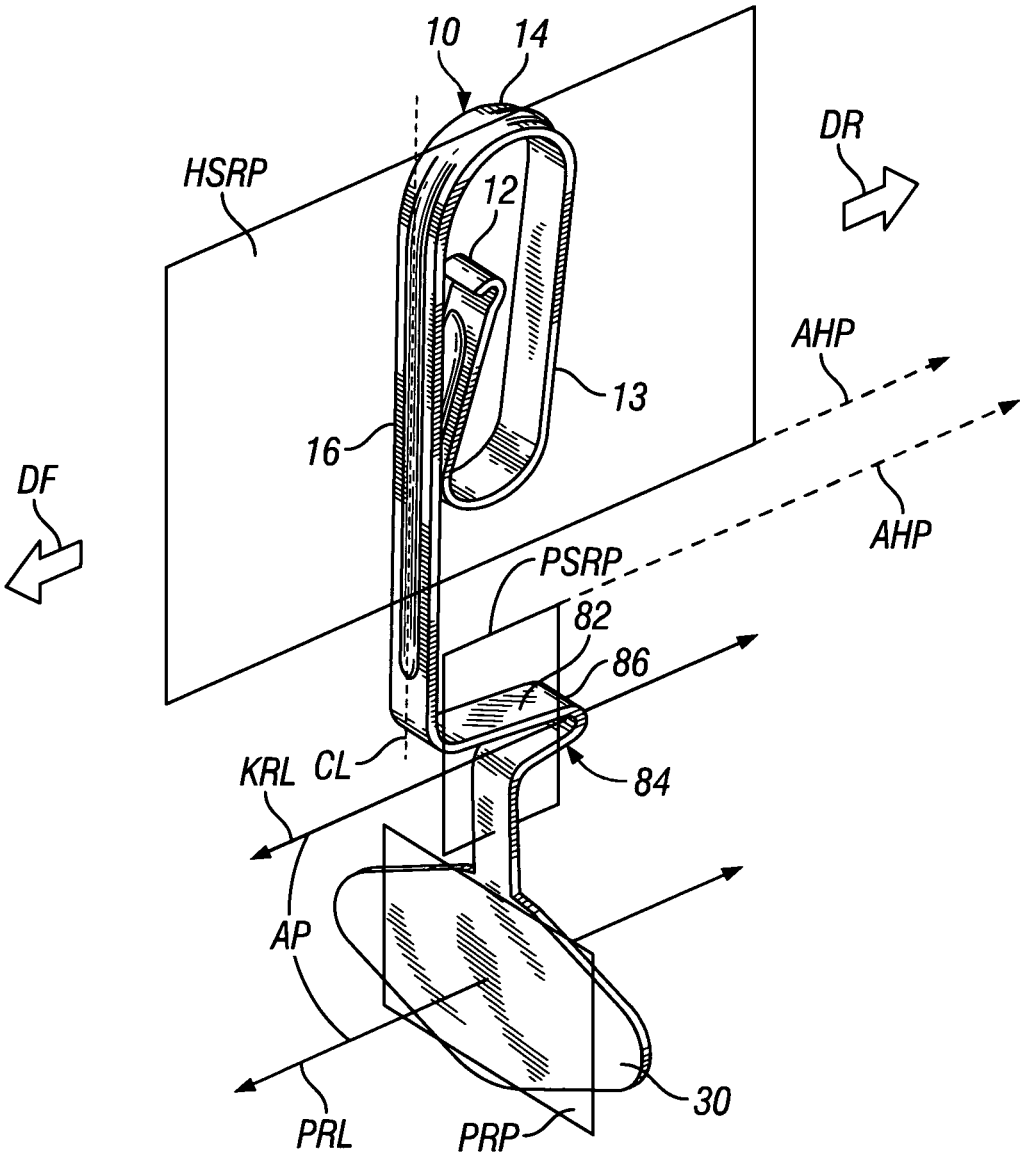

FIG. 26 illustrates a particularly preferred embodiment of a hanger 10 useful in the cageless lavatory dispensing device according the invention, and more particularly depicts preferred configurations of the respective elements thereof. Illustrated is wherein the hanger 10 includes at least one peak section (comprised of a first peak segment 82 and the second peak segment 84 and peak 86), preferably wherein the peak section is proximate to the plate 30. As depicted, the peak section is preferably oriented with respect to the hanger 10 such that the peak 86 of the peak section is directed with respect to the center line CL of the hanger 10 and/or stalk 16 of the hanger such that the peak section is "generally coplanar" with the direction of the hook end of the hanger 10. By the term "generally coplanar" is to be understood that the angle AHP formed between a peak section reference plane PSRP, which is in turn a reference plane passing through the midsections of the first peak segment 82, second peak segment 84, and the peak 86, and a hook reference plane HSRP which is in turn defined as a further reference plane defined by a plane passing through the center line of each section of the hook (12, 13 and 14), and the center line of the hanger and/or stalk 16, is +/−20° or less, and here in the depiction is +/−2° or less, wherein the first, peak section reference plane PSRP and the second, hook reference plane HSRP are nearly coplanar. That being said it is also to be understood that the peak 86 is directed in the same direction as illustrated by arrow "DR" as that of the direction of the hook 12, 13, 14 and particular the direction of the hook end 12 when it is in an unfolded extended configuration, such as when installed on the rim of a lavatory appliance. The direction depicted by the arrow "DR" is intended to represent a "rearward" or "rear" direction with respect to the hanger 10, while the opposite direction depicted by the arrow "DR" is intended to represent a "frontward", or "front" direction with respect to the hanger 10. Further illustrated in the figure is that the peak 86 is "generally perpendicular" to the plate 30. Such is illustrated in the figure, in that the angle AP between a first reference line KRL drawn from the peak 86 towards the center line CL of the hanger 10, and equidistant between the first peak segment 82 and the second peak segment 84, and a second reference line PRL extending outward from and perpendicular to a plate reference plane PRP which is defined as (i) a plane defined by the face of the plate nearest to the peak section, or (ii) a plane passing through the widest part of the retention element which plane also intersects the junction or point of connection between the retention element and the part of the hanger from which the retention element depends, is +/−45°, here is to be understood as being 0°.

While such respective orientation is discussed with reference to the embodiment depicted on FIG. 26, it is nonetheless to be understood that the principles discussed therein may apply to all other embodiments of hangers either described and/or depicted in this patent specification.

Several useful processes for the production of cageless lavatory dispensing devices are disclosed in the following figures.

Figure 27A:
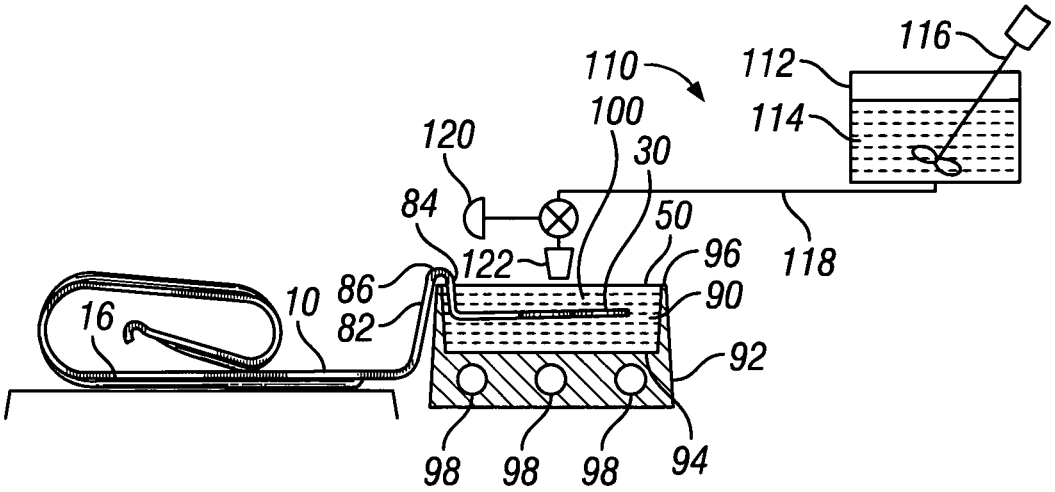
Figure 27B:
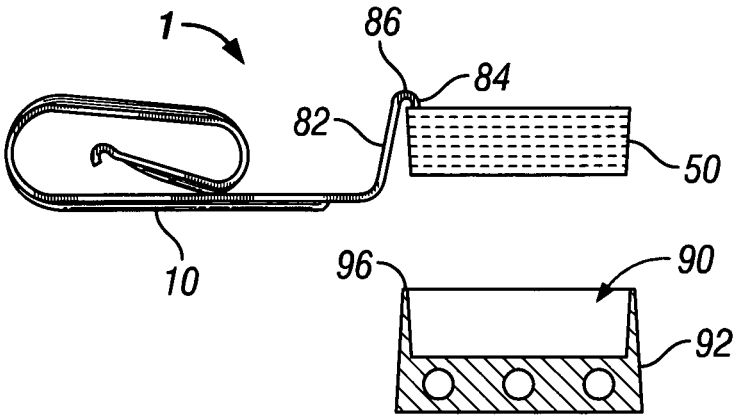

FIG. 27 illustrates a series of semi-schematic sequence of process steps illustrating a first process useful in the production of an embodiment of a cageless lavatory dispensing device 1 comprising a hanger 10 and a cast solid block 50 formed from a castable solid block composition comprising one or more chemical constituents for use with a sanitary appliance. In a first process step illustrated on FIG. 27A, the plate 30 of a hanger 10 is supplied within the interior cavity 90 of a mold 92 were in the plate 30 is positioned within the said cavity 90 such that it is intermediate a base or bottom of 94 of the mold, and the upper or top margin 96 of the mold 92. As is visible in the figure, the peak section of the hanger, namely the first peak segment 82, second peak segment 84, and the peak 86 are positioned adjacent to a portion of the top margin 96, such that the peak 86 straddles the top margin 96 of the mold in 92, and extends above the cavity 90. The cavity 90 defines a space wherein a quantity of a castable solid block composition may be poured, pumped or otherwise apply to the interior of the cavity 90 such that the quantity of the castable solid block composition is sufficient to come into contact with and at least partially encase or enrobe the plate 30 of the hanger 10. Illustrated in the figure is a point in the process wherein a quantity of a castable solid block composition 100 has been supplied to the cavity 90 from a supply source. Here, an exemplary supply source is depicted although, it is to be expressly understood that such is for purposes of illustration and not of limitation. Further, alternatives to the illustrated supply source or fully contemplated to be within the scope of the present invention. In FIG. 27A the supply source 110 comprises in a mixing and storage vessel 112 which contains a quantity of a castable solid block composition 114 which is maintained in a liquefied state by appropriate means (not shown) although it is to be understood that such may include e.g., a heat source such as a heating element either immersed within the quantity of the castable solid block composition 114 within the storage vessel 112, or the storage vessel 112 itself may be provided with a temperature control mantle which can be used to heat, or cool the contents of the storage vessel 112. Optionally, but frequently advantageously, a mixer 116 is utilized to ensure that this prior to being supplied to the cavity 90 of any molds 92, the castable solid block composition 114 remains essentially homogenous in composition and is in a pourable and or pumpable physical state. The castable solid block composition 114 passes from in the storage vessel 112 via a supply line 118 to a metering valve 120 which is used to control the supply of the castable solid block composition 114 to a supply nozzle 122 which is used to fill the cavity 90 of the mold 92. Such a metering valve 120 is advantageously used in that it can provide a limited quantity of the castable solid block composition 114 and such controlled dispensing permits for the production of cast solid block compositions having a relatively uniform mass. In the cross-sectional view of FIG. 27A, it can be seen and that the cavity 90 is filled up to be top margin 96 of the molds 92 and it is to be understood at this point to the process is immediately following the termination of supply of the castable solid block composition 114 via the supply nozzle 122. Subsequently, the castable solid block composition 114 is retained in the interior of the molds 92 until it has sufficiently solidified such that it is substantially rigid, and can be removed from the cavity 90 without being unduly deformed. In certain instances, the mold 92 may include incorporated within its construction a cooling manifold, here represented as a plurality of passages 98 passing through a portion of the molds 92, through which a cooling medium, such as water, or other fluid (liquid or gas) may pass in order to decrease the temperature of the mold 92. With certain compositions of the castable solid block composition 114, such may be advantageously practiced, although particular care should be taken to ensure that the constituents comprising the castable solid block composition 114 are not deleteriously affected by an accelerated cooling process step. Alternately, following the supply of the castable solid block composition 114 to the cavity 90, the molds 92, and its contents may be allowed to remain undisturbed until the castable solid block composition 114 is sufficiently solidified. While in many instances the castable solid block composition 114 may be provided at an elevated temperature and requires cooling in order to solidify, such is not always the case and it is contemplated that the foregoing process may be practiced with other types of castable solid block compositions 114 which may require heating in order to be solidified, or which may require no change in temperature but require a specific time interval in order for sufficient solidification of the castable solid block composition 114 to occur. When sufficient solidification has occurred, the cast solid block 50 forms from the castable solid block composition 114 may be removed, withdrawn, were ejected from the mold 92, as is depicted on FIG. 27B which illustrates a cageless lavatory dispensing device 1, comprising a cast solid block composition according to a one preferred aspect of the present invention.

Figure 28:
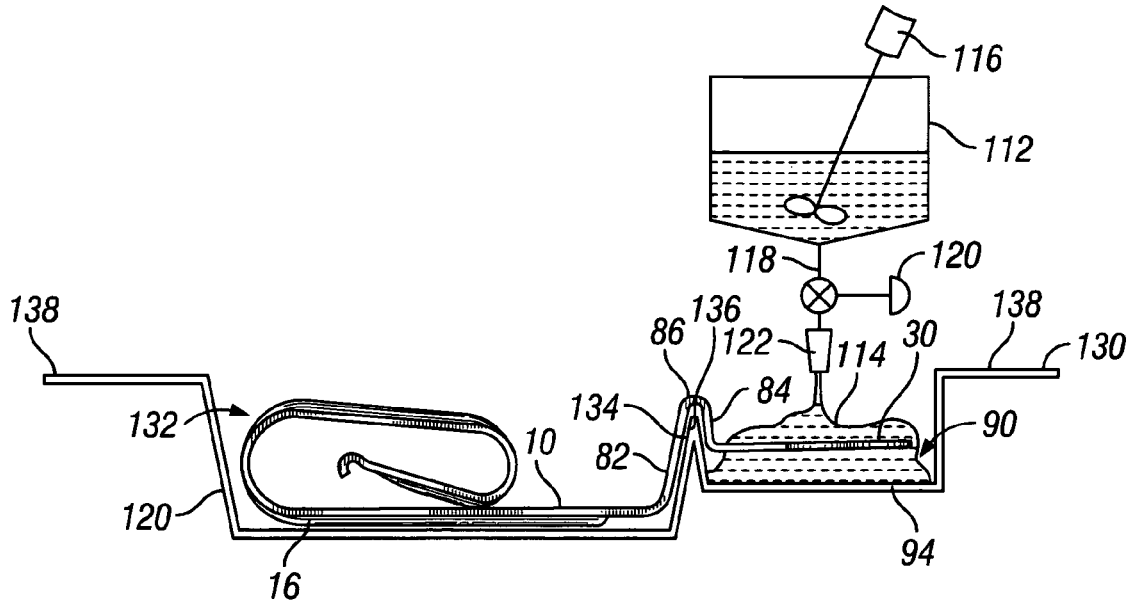

FIG. 28 illustrates a series of semi-schematic sequence of process steps illustrating a second process useful in the production of an embodiment of a cageless lavatory dispensing device comprising a hanger and a cast solid block formed from a castable solid block composition comprising one or more chemical constituents for use with a sanitary appliance. Is this a second process is similar in many respects to the first process described with reference to FIG. 27, except that the castable solid block composition is applied directly to a preformed blister 130 which includes appropriate cavities, including a block cavity 90 within which the castable solid block composition 114 is supplied and allowed to solidify, as well as a hook cavity 132 within which a portion of the anger tend including the stalk 16 may be positioned. Intermediates these two cavities it is a dividing ridge 134 which terminates at a ridge peak 136 which serves through providing physical division between the block cavity 90 and that the hook cavity 132. The distance between the base 94 off of the block cavity 90, and the rage peak 136 also defines the maximum volume of the cavity 90 which can be filled prior to having the castable block composition 114 spillover into the hook cavity 132.

The preformed blister 130 may be formed of any suitable material which can be formed to the ultimate desired configuration, but advantageously is any molded, thermoformed, or thermoset synthetic plastics material, such as any thermoformed plastic sheet which is commonly encountered and used for the packaging of vendible articles wherein the blister it commonly affixed to a backing material such as a card, sheet or film which provides for further support of the vendible article contained between the interior of the blister 130 at such a backing material. Preferably, such a blister is essentially transparent as providing an attractive display. By way of nonlimiting example, useful thermoset of all synthetic plastic materials include polyolefins, polyamides, and especially polyalkylene terepthalates as well as copolymers are one or more of their of, including copolymers with further monomers or polymers not specifically disclosed herein. Typically, and as a shown on FIG. 28, the preformed blister 130 includes a generally flat, peripheral margin 138 surrounding any cavities formed within the blister, which peripheral margin 138 provides a surface against which the backing material (not shown) may be applied, and thereby sealing the preformed blister 130 and forming a package. It is contemplated that, according to the present invention, any material suitable for forming such a preformed blister 130 may be used, it only being required that the material of construction of the preformed blister 130 is not unduly deleteriously affected by the castable solid block composition 114 during any part of the production process, or during storage of the cast solid block 50 and/or of the cageless lavatory dispensing device 1.

Further illustrated on FIG. 28 is an exemplary supply source 110 comprising a mixing and storage vessel 112 which contains a quantity of a castable solid block composition 114 which is maintained in a liquefied state by appropriate means (not shown) e.g., an immersed heating element, or a temperature control mantle which can be used to heat, or cool the contents of the storage vessel 112 (also not shown). An optional mixer 116 is illustrated, which is advantageously provided and utilized to ensure that this prior to being supplied to the cavity 90 of the blister 130, the castable solid block composition 114 remains essentially homogenous in composition and is in a pourable and or pumpable physical state. The castable solid block composition 114 passes from the storage vessel 112 via a supply line 118 to a metering valve 120 which is used to control the supply of the castable solid block composition 114 to a supply nozzle 122 which is used to fill the cavity 90 of the blister 130. Such a metering valve 120 is advantageously used in that it can provide a limited quantity of the castable solid block composition 114 and such controlled dispensing permits for the production of cast solid block compositions having a relatively uniform mass. Additionally, the use of such a metering valve 120 also ensures that the quantity of the castable solid block composition 114 preferably does not exceed the maximum volume which can be used to fill the cavity 90, and ensures that no excess of the castable solid block composition 114 overflows the ridge peak 136 and spillover into the hook cavity 132. Such is undesirable as both an unnecessary wastage of the castable solid block composition 114, and also leads to an unattractive appearance. Naturally, it is to be understood that the quantity of the castable solid block composition 114 may not completely fill the maximum volume of the cavity 90, but a lesser volume of the castable solid block composition 114 can be provided. In the cross-sectional view of FIG. 28, it can be seen and that the cavity 90 is in the process of being filled and that during filling, the castable solid block composition 114 flowing from the supplying nozzle 122 at least partially encases, here is seen to completely enrobe the plate 30. Although not being depicted, it is to be understood that the flow of the castable solid block composition 114 will be terminated prior to the delivery of any amount of the castable solid block composition 114 which would be in excess of the maximum volume which can be used to fill the cavity 90. Immediately following the termination of supply of the castable solid block composition 114 via the supply nozzle 122, the castable solid block composition 114 is retained in the interior of the cavity 90 of the blister 130, until it has sufficiently solidified such that it is substantially rigid, and can be removed from the cavity 90 without being unduly deformed.

A specific advantage of the embodiment of the process described with reference to FIG. 28 is that the ultimate product package, namely the preformed blister 130 may be used both as a mold for the castable solid block composition 114, as well as for the subsequent storage and packaging of the cageless lavatory dispensing device 1 according to the present invention. Such is a vast simplification of the prior process described with reference to FIG. 27 which requires the use of a separate mold, solidification of the cast solid block composition 114 within the molds 92, removal of the cast solid block 50 from the mold, and subsequent separate packaging of the cageless lavatory dispensing device 1. Such process steps are eliminated according to the process described with reference to FIG. 28. Additionally, as in the process described with reference to FIG. 28 provides for the hardening or solidification of the cast solid block 50 in situ within the interior of the cavity 90 of the blister 130, such provides excellent interfacial contact between the exterior of the cast solid block 50 and the interior of the cavity 90 and provides for little or no movement in the air between. Such may improve the structural integrity of the cast solid block 50 of the cageless lavatory dispensing device 1 post-manufacture which may retain an attractive product appearance prior to the opening of the package and withdrawal of the cageless lavatory dispensing device 1 from within the blister 130 and its use in conjunction with a sanitary appliance.

Figure 29:
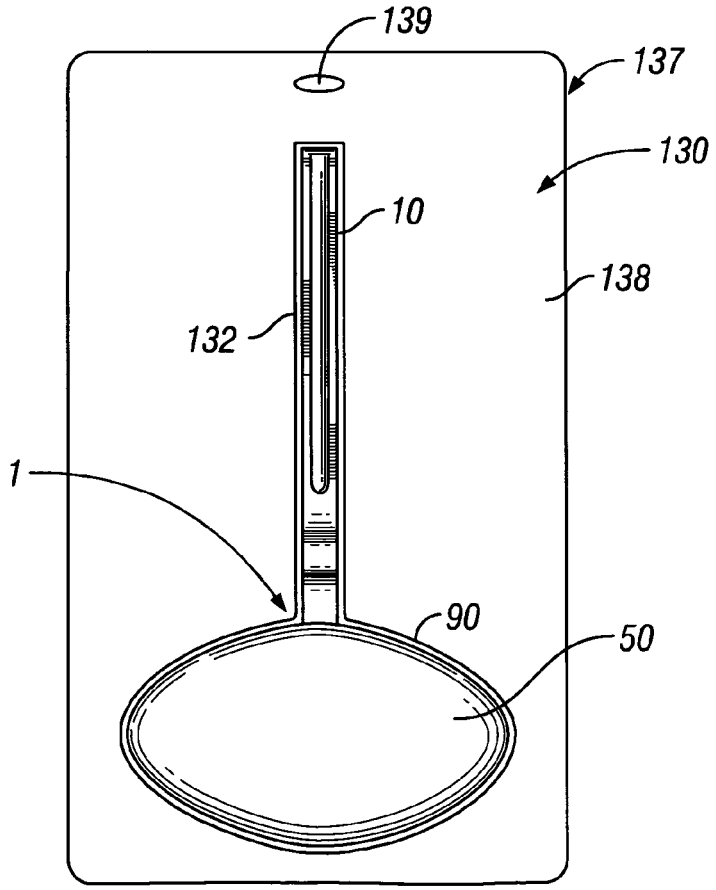

FIG. 29 depicts in a front plan view a packaged cageless lavatory dispensing device 1 of the invention which has been formed in accordance with the process described with reference to FIG. 28. As is visible thereon, the blister 130 is affixed to, such as by lamination to a backing material 137 along the flat, peripheral margin 138 of the blister 130. Also depicted is a hole or eyelet 139 which although optional, is advantageously provided in order to conveniently hang the packaged cageless lavatory dispensing device one from a peg or hook. The hangar 10 is positioned within the hangar cavity 132, while the cast solid block 50 is positioned within the cavity 90 of the preformed blister 130. In accordance with the manufacturing process describes with reference to FIG. 28, the cageless lavatory dispensing device 1 is removable from the packaging provided, namely the blister 130 in the vendible article and package illustrated on FIG. 29 by the ultimate product consumer.

FIG. 30 illustrates a series of semi-schematic sequence of process steps illustrating a third process useful in the production of an embodiment of a cageless lavatory dispensing device, wherein the cast solid block includes an interior, solidified mass of a first chemical composition provided as an interior core of a larger solid block composition, which is overlaid or overmolded by a further chemical block composition. This third process comprises many steps which are similar to the steps of the first process described above. In this third process, and with reference first to FIG. 30A, the plate 30 of a hanger 10 is supplied within the interior cavity 90 of a mold 92 wherein the plate 30 is positioned within the said cavity 90 such that it is intermediate a base or bottom of 94 of the mold, and the upper or top margin 96 of the mold 92. As is visible in this cross sectional view, the mold 92 includes a sidewall recess 93 which permits for the placement of a part of the hanger 10 to extend through a part of a sidewall 95 of this mold, such that the plate 30 may be positioned within that the cavity 90. While not illustrated, a further mold element may be provided in order to seal the remaining part of the sidewall recess 93 during the filling of the cavity 90, which can be later removed in order to permit for the removal of the cast solid block 50 from the mold. The cavity 90 defines a volume wherein a quantity of a first castable solid block composition 114 may be poured, pumped or otherwise apply to the interior of the cavity 90 such that the quantity of this first castable solid block composition 114 is sufficient to come into contact with and at least partially encase or enrobe the plate 30 of the hanger 10. According to the instant process, it is to be recognized and understood that the volume of this mold and 90 is less than the ultimate or final volume of the cast solid block composition 50 of the final form of the cageless lavatory dispensing device 1 such that a further, second castable solid block composition may be used to overmold the first castable solid block composition 114. Illustrated in the figure is a point in the process wherein a quantity of a first castable solid block composition 114 is being poured into the cavity 90 from a first supply source and is coming into contact with the plate 30. An exemplary supply source is depicted although, it is to be expressly understood that such is for purposes of illustration and not of limitation. As with the first process described previously, further, alternatives to the illustrated supply sources are fully contemplated to be within the scope of the present invention. In FIG. 30 the first supply source 110 comprises a mixing and storage vessel 112 which contains a quantity of a first castable solid block composition 114 which is maintained in a liquefied state by appropriate means (not shown) although it is to be understood that such may include e.g., a heat source such as a heating element either immersed within the quantity of the castable solid block composition 114, or the storage vessel 112 itself may be provided with a temperature control mantle which can be used to heat, or cool the contents of the storage vessel 112. An optional mixer 116 is provided and is utilized to ensure that this first castable solid block composition 114 supplied to the cavity 90 of any molds 92, the first castable solid block composition 114 remains essentially homogenous in composition and is in a pourable and or pumpable physical state. The first castable solid block composition 114 passes from in the storage vessel 112 via a supply line 118 to a metering valve 120 which is used to control the supply of the first castable solid block composition 114 to a supply nozzle 122 which is used to fill the cavity 90 of the mold 92. A metering valve 120 is advantageously used in that it can provide a limited quantity of the first castable solid block composition 114 and such controlled dispensing, although any other valve or any other means can be utilized in its place. With reference again to FIG. 30A, it is to be understood that following the provision of a sufficient amount of the first castable solid block composition 114, the supply of said composition is interrupted and the castable solid block composition 114 is retained in the interior of the mold 92 until it has sufficiently solidified such that it is substantially rigid, and can be removed from the cavity 90 without being unduly deformed as is depicted in the side view illustration of FIG. 30B. While in certain instances, the mold 92 may include incorporated within its construction a cooling manifold, in the present embodiment such is omitted although it may be present if required.

Figure 30A:
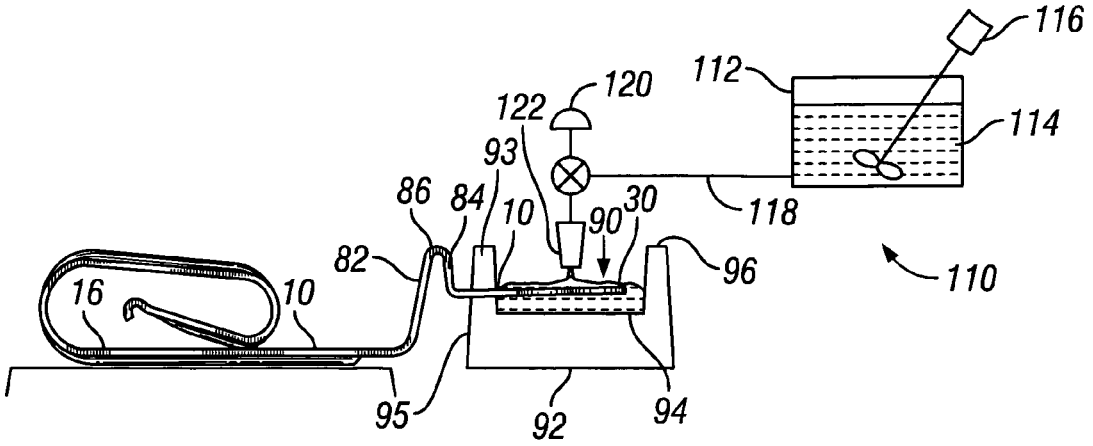
Figure 30B:
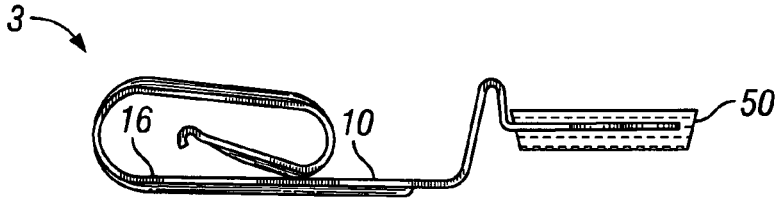
Figure 30C:
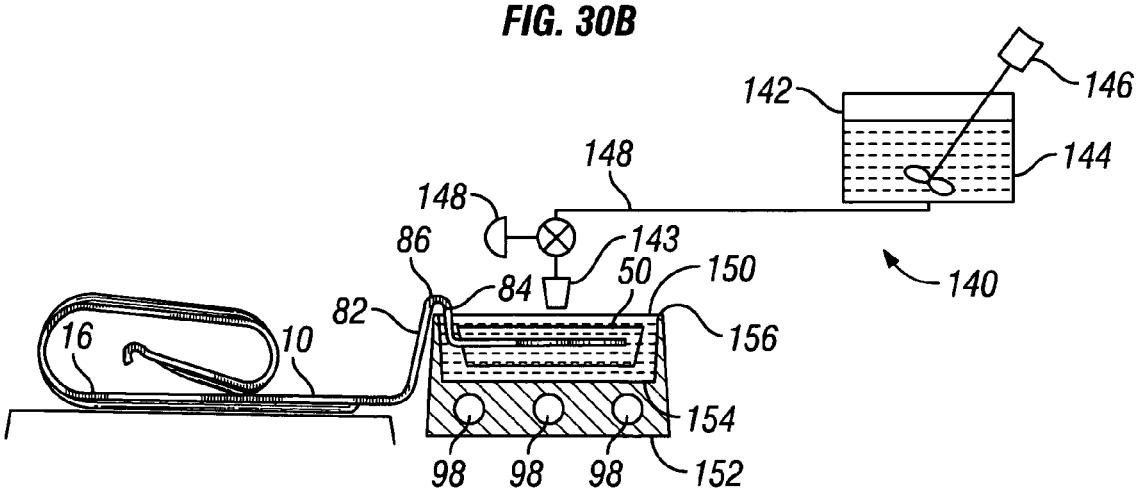
Figure 30D:
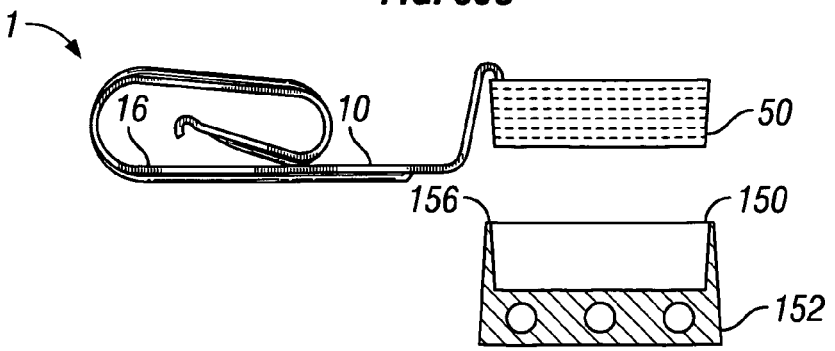

In a next step of the process, as is illustrated with reference to FIG. 30C, the previously formed article 3 is supplied to a second mold 152 having an interior cavity 150 wherein the plate 30 is positioned within the said cavity 150 such that it is intermediate a base or bottom of 154 of the mold, and the upper or top margin 156 of the mold 152. As is visible in the figure, the peak section of the hanger, namely the first peak segment 82, second peak segment 84, and the peak 86 are positioned adjacent to a portion of the top margin 156, such that the peak 86 straddles the top margin 156 of the mold in 152, and extends above the cavity 150. The cavity 150 defines a space wherein a quantity of a second castable solid block composition 144 may be poured, pumped or otherwise supplied to the interior of the cavity 150 such that the quantity of a second castable solid block composition 144 comes into contact with, but preferably encases or enrobes the plate 30 of the hanger 10 on which the block 50 of the first castable solid block composition 114 is present, namely overmolding the block 50. Illustrated in the figure is a point in the process wherein a quantity of the second castable solid block composition 144 has been supplied to the cavity 90 from a supply source 140 and has completely overmolded the block 50. Here, an exemplary supply source 140 is depicted although, it is again be expressly understood that such is for purposes of illustration and not of limitation, and further, alternative supply sources are fully contemplated to be within the scope of the present invention. In FIG. 30C the supply source 140 comprises a mixing and storage vessel 142 which contains a quantity of a second castable solid block composition 144 which is maintained in a liquefied state by appropriate means (not shown) e.g., a heat source and/or a temperature control mantle which can be used to heat, or cool the contents of the storage vessel 142. An optional a mixer 146 is present and is utilized to ensure that the composition being supplied to the cavity 150 of the second mold 152 remains essentially homogenous in composition and is in a pourable and/or pumpable physical state. The second castable solid block composition 144 passes from in the storage vessel 142 via a supply line 148 to a metering valve 148 which is used to control the supply of the second castable solid block composition 144 to a supply nozzle 143 which is used to fill the cavity 150 of the mold 152. Such a metering valve 143 is optional and any other valve or a means to control the flow of the second castable solid block composition 144 may be used but such a metering valve 143 is advantageously used as it can provide a controlled quantity of the second castable solid block composition 144 and such controlled dispensing permits for the production of cast solid block compositions having a relatively uniform mass. In the cross-sectional view of FIG. 30C, it can be seen and that the cavity 150 is filled up to be top margin 156 of the mold 152 and it is to be understood at this point to the process is immediately following the termination of supply of the second castable solid block composition 144 via the supply nozzle 143. Subsequently, the second castable solid block composition 114, which encases the block of the first castable solid block composition 50 is retained in the interior of the mold 152 until it has sufficiently solidified such that it is substantially rigid, and can be removed from the cavity 150 without being unduly deformed. In certain instances, the mold 152 may include incorporated within its construction a cooling manifold, here represented as a plurality of passages 98 passing through a portion of the mold 152, through which a cooling medium, such as water, or other fluid (liquid or gas) may pass in order to decrease the temperature of the mold 152. With certain compositions of the second castable solid block composition 144, such may be advantageously practiced, although particular care should be taken to ensure that the constituents comprising the second castable solid block composition 144 are not deleteriously affected by an accelerated cooling process step. Alternately, following the supply of the second castable solid block composition 144 to the cavity 150, the mold 152, and its contents may be allowed to remain undisturbed until the second castable solid block composition 154 is sufficiently solidified. Heating or cooling of the mold 152 may not be required. While in many instances the castable solid block composition 154 may be provided at an elevated temperature and requires cooling in order to solidify, such is not always the case and it is contemplated that the foregoing process may be practiced with other types of castable solid block compositions 154 which may require heating in order to be solidified, or cooling, or which may require no change in temperature but require a specific time interval in order for sufficient solidification of the second castable solid block composition 154 to occur. When sufficient solidification has occurred, the cast solid block 50 containing two different blocks of different chemical compositions may be removed, withdrawn, or ejected from the mold 152, as is depicted on FIG. 30D which illustrates a further preferred embodiment of a cageless lavatory dispensing device 1.

Although the process described with reference to FIG. 30 provides a cast solid block 50 having an interior core of a first chemical composition and an overcoat of a second chemical composition, a process may be adapted to be utilized to form a block of a laminar construction wherein a block may include a first layer of a solid block consisting of a first chemical composition, adjacent a second layer of a the cast solid block consisting of a second chemical composition which is different than the first chemical composition. Thus such a block provides two or more separate regions or masses of different chemical compositions which are simply layered adjacent to one another. Such may be achieved for example by providing a hanger to the second mold 152 and supplying thereto a controlled amount of the first castable solid block composition 114 which is insufficient to completely fill the cavity 150, optionally but preferably allowing the first castable solid block composition 114 to harden or solidify, and subsequently supplying a controlled amount of the second castable solid block composition 144 to the cavity 144 such that it comes into contact with the first castable solid block composition 114 and allowing it to harden or solidify. The positioning of the plate 30 is not critical but is only required to be within or affixed to the ultimately formed laminate cast block composition. In such a manner, a bi-layered block for a cageless lavatory dispensing device can be provided. Further layers of still further different chemical compositions may also be present. Such solid blocks formed having two or more discrete layers or regions of, respectively, two or more different chemical compositions may be referred to as composite blocks.

Figure 31A:
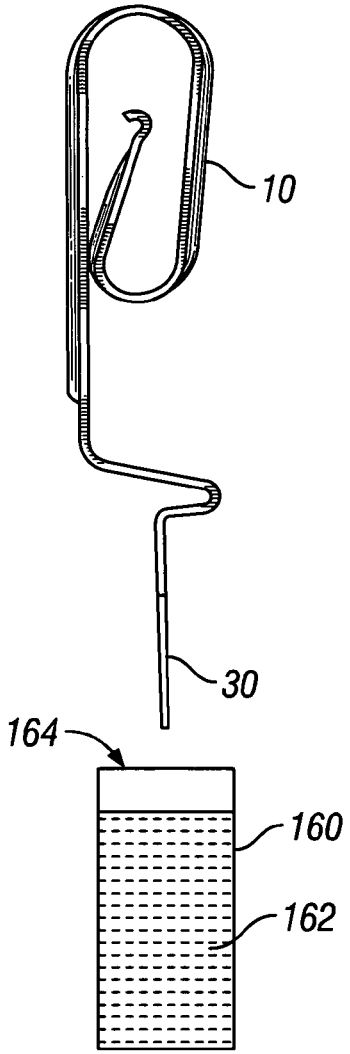
Figure 31B:
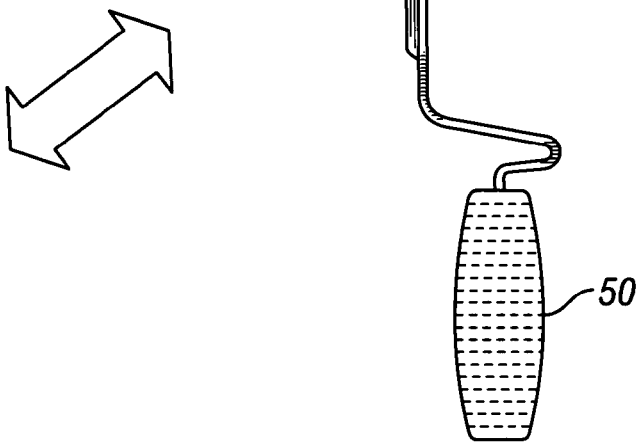
Figure 31C:
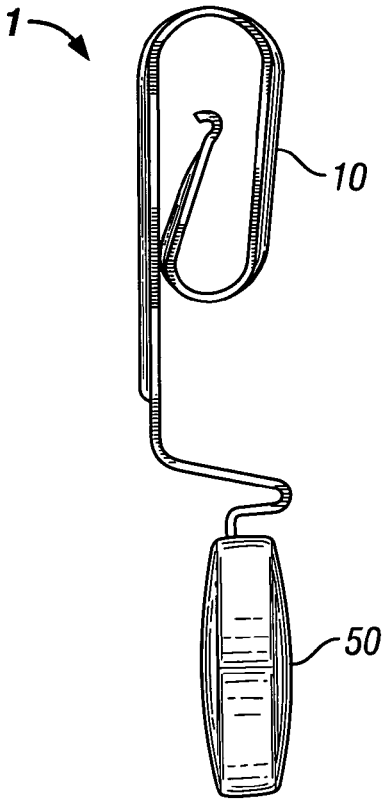

FIG. 31 illustrates a semi-schematic sequence of a further, alternative process for the manufacture of a cageless lavatory dispensing device 1 according to the present invention. Such a process requires one or more dipping operations wherein part of the hanger 10 and especially the retention element, here depicted as a plate 30, is immersed into a fluid quantity of a castable solid block composition 162 present within a suitable vessel 160 having an open part 164. Such is illustrated on FIG. 31A. Subsequently, the hanger 10 and the plate 30 are withdrawn having adhered thereto a laminar layer of the castable solid block composition 162 which is permitted to harden or solidify. While the process can be interrupted at this point, desirably the process is repeated a plurality of times such that a sufficient mass of the castable solid block composition 162 is built up as successive laminar layers on the hanger 10 as during each dipping cycle, a further quantity of the castable solid block composition 162 adheres to the prior formed block 50, and when withdrawn from the vessel 160 and allowed to harden or solidify, forms a further laminar layer, as is depicted on FIG. 31B. Ultimately, when a sufficient quantity of the castable solid block composition 162 is attained, the process may be interrupted, and a suitable cageless lavatory dispensing device 1 is provided, as illustrated on FIG. 31C. If desired, the cast solid block 50 may be shaped, such as by trimming or compression in a stamping mold so to provide a desired product appearance, e.g., using a stamp or mold to impress within the cast block 50 a trademark or other visual indicator.

Figure 32:
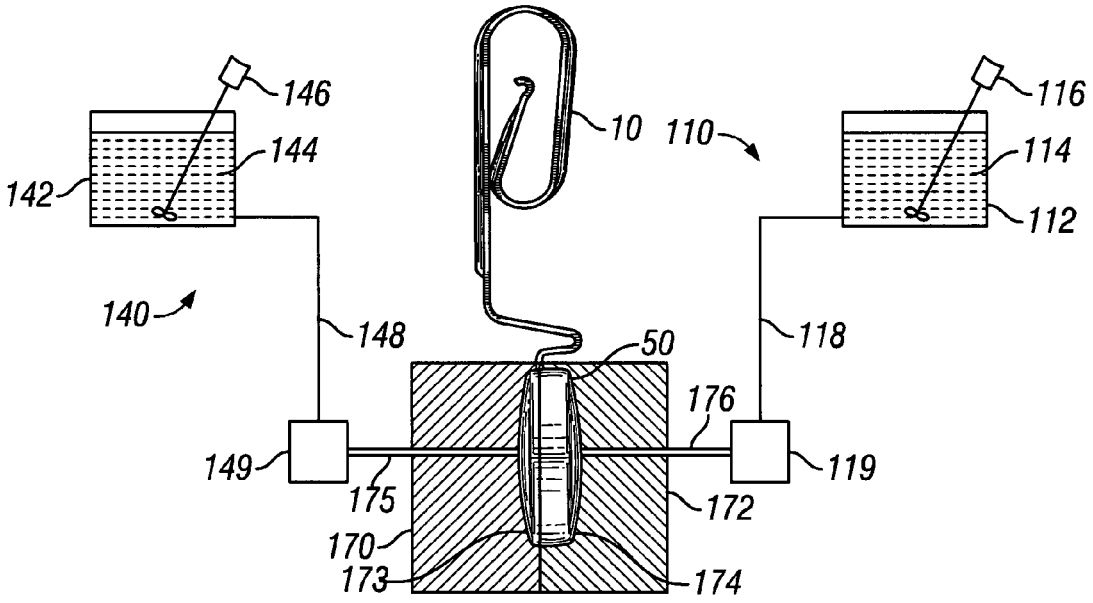

FIG. 32 depicts a semi-schematic depiction of a mold casting process according to the present invention for the production of a cageless lavatory dispensing device. There is provided a two-part mold comprising a first mold part 170 and a second mold part 172. The first mold part 170 includes an internal cavity 173 and a supply conduit 175, while the second mold part 172 includes a further internal cavity 174 and a further supply conduit 176. The first mold part 170 and the second mold part 172 are constructed so that when assembled, their respective internal cavities 173, 174 define a hollow volume within which a portion of the hanger 10, and especially the retention element, e.g. a plate may be positioned. In the depicted figure, the production of a cageless lavatory dispensing device having compositions a cast solid block which block comprises two discrete chemical compositions it is illustrated. However, it is to be clearly understood that the process depicted may be modified, and the use of a mold casting process can be similarly configured and utilized for forming a cageless lavatory dispensing device having a single chemical composition for the cast solid block 50. In the illustrated process, a first supply source 110 comprises a mixing and storage vessel 112 which contains a quantity of a first castable solid block composition 114 which is maintained in a liquefied state by appropriate means (not shown) although it is to be understood that such may include e.g., a heat source such as a heating element either immersed within the quantity of the castable solid block composition 114, or the storage vessel 112 itself may be provided with a temperature control mantle which can be used to heat, or cool, the contents of the storage vessel 112 so to maintain in a liquefied form. An optional mixer 116 is provided and is utilized to ensure that this first castable solid block composition 114 supplied to the cavity 172, 174 of the mold parts 170, 172. A pump 119 is provided in order to provide a controlled amount of the first castable solid block composition 114 from the supply line 118 via the supply conduit 176 by which it may be introduced into the cavity 172, 174 of the mold parts 170, 172. A second castable solid block composition 142 is provided by a second supply source 140 which comprises a mixing and storage vessel 142 which contains a quantity of a second castable solid block composition 144 which is maintained in a liquefied state by appropriate means (not shown) e.g., a heat source and/or a temperature control mantle which can be used to heat, or cool the contents of the storage vessel 142 and maintain it in a liquefied. An optional a mixer 146 is present and is utilized to ensure that the composition being supplied to the cavity 172, 174 of the mold parts 170, 172 remains essentially homogenous in composition and is in a pourable and/or pumpable physical state. A pump 149 is provided in order to provide a controlled amount of the second castable solid block composition 144 via the supply conduit 175 by which it may be introduced into the cavity 172, 174 of the mold parts 170, 172. During the process, equal amounts, or unequal amounts of the perspective first castable solid block composition 114 and the second castable solid block composition 144 may be supplied to the cavity 172, 174 of the mold parts 170, 172 when they come into contact with, and desirably enrobe or encase the retention element of the hanger 10. The compositions are allowed to solidify within the interior of the cavity 172, 174 of the mold parts 170, 172 before the mold parts 170, 172 are separated and thereby releasing the cast solid block 50.

Certain features of the process described with reference to FIG. 32 may be varied. In one such variation, either the first supply source 110 or second supply source 140 are omitted, and only a single castable solid block composition is supplied to the interior of the cavity 172, 174 of the mold parts 170, 172 from the remaining supply source. In a next variation, both a first supply source 110 used to supply a first castable solid block composition 112 is provided, as well as a second supply source 140 used to supply a second castable solid block composition 142 is also present. During the filling of the interior of the cavity 172, 174 of the mold parts 170, 172, only one of the two supply sources is operated to only partially fill the interior of the cavity 172, 174 and the supplied castable solid block composition is allowed to solidify or harden, after which the other of the two supply sources is operated to complete the filling of the interior of the cavity 172, 174 and the other of the castable solid block compositions is allowed to solidify or harden, and subsequently the mold parts 170, 172 may be separated in order to release the cageless lavatory dispensing device. In such a manner, a cast solid block 50 having two discrete regions of different chemical composition may be provided and, particularly where the first of the castable solid block compositions is provided to fill less than one half of the cavity 172, 174, and the second of the castable solid block compositions is provided to subsequently fill the remaining volume of the cavity 172, 174 a dual-layer composite block is provided having a different bottom layer, and a different top layer within the block 50.

It is to be understood that a dispensing device according to the invention may also have a different geometry, configuration or and appearance than the embodiments described in the Figures and still be considered to fall within the scope of the invention. It is also to be understood that various elements of the lavatory dispensing devices according to the invention may be interchanged amongst the various embodiments illustrated or described, as may be desirable or necessary.

Similarly, it is to be understood that the processes for production of the dispensing device according to the invention may also be modified in a manner reasonably foreseeable by skilled artisan, and is yet considered to fall within the scope of the present inventive teaching.

In order to further illustrate the present invention, various examples of preferred embodiments of the invention are described, following. In these examples, as well as throughout the balance of this specification and claims, all parts and percentages are by weight unless otherwise indicated.

EXAMPLES

Cast solid blocks according to the invention were produced from the described on the following tables; examples according to the invention are indicated by a letter "E" preceding one or more digits. The compositions recited on Table 1 illustrated non-bleach containing castable solid block compositions according to the invention.

TABLE 1

| Example | 1 | 2 | 3 | 4 | 5 | 6 | 7 | 8 |
|---|---|---|---|---|---|---|---|---|
| LMEA | 4.99 | 5.0 | 10.04 | 5.0 | 15.0 | 10.1 | 15.06 | 4.69 |
| PEG 6000 | 60.19 | 60.14 | 60.2 | 54.88 | 65.25 | — | — | — |
| PEG 8000 | — | — | — | — | — | 60.05 | 55.16 | 65.36 |
| propylene glycol | 5.12 | 5.18 | 5.0 | 5 | 5.0 | 5.06 | 10.1 | 5.02 |
| Lutensol AT 55 | 20.24 | 20.22 | 15.02 | 19.95 | 10.03 | 15.03 | 10.07 | 20.02 |
| Daclor 70-3-23AL | 5.96 | 5.12 | 5.06 | 9.95 | — | 5.19 | 10.63 | — |
| fragrance and/or dye | 5.06 | 4.96 | 5.01 | 5.4 | 5.04 | 5.01 | 5.00 | 5.00 |
| peak fluid temperature | 200° F. (93.3° C.) | 175° F. (79.4° C.) | 155° F. (68.3° C.) | 135° F. (57.2° C.) | 170° F. (76.6° C.) | 140° F. (60° C.) | 145° F. (62.7° C.) | 150° F. (65.5° C.) |
| pouring temperature | 100° F. (37.7° C.) | 110° F. (43.3° C.) | 120° F. (48.8° C.) | 120° F. (48.8° C.) | 130° F. (54.4° C.) | 125° F. (51.6° C.) | 120° F. (48.8° C.) | 125° F. (51.6° C.) |

TABLE 1-continued

| Example | 9 | 10 | 11 | 12 | 13 | 14 | 15 |
|---|---|---|---|---|---|---|---|
| LMEA | 9.96 | 15.04 | 5.0 | 15.05 | 15.04 | 14.96 | 14.96 |
| PEG 6000 | — | — | — | — | 47.12 | — | — |
| PEG 8000 | 60.09 | 45.09 | 75.06 | 47.27 | — | 48.24 | 47.99 |
| propylene glycol | 5.08 | 5.3 | 5.0 | 5.02 | 5.13 | 5.02 | 5.01 |
| Lutensol AT 55 | 15.0 | 20.05 | 9.98 | 15.26 | 15.11 | 15.23 | 15.09 |
| Daclor 70-3-23AL | 5.11 | 10.76 | — | 10.12 | 10.0 | 10.0 | 10.0 |
| Ufaryl DL 85 | — | — | — | — | — | — | 2.01 |
| Nansa LSS 480/H | — | — | — | — | — | 2.1 | — |
| fragrance and/or dye | 5.08 | 4.99 | 4.99 | 8.06 | 8.06 | 4.94 | 5.2 |
| peak fluid temperature | 160° F. (71.1° C.) | 135° F. (57.2° C.) | 170° F. (76.6° C.) | 70° C. | 54° C. | — | — |
| pouring temperature | 120° F. (48.8° C.) | 120° F. (48.8° C.) | 125° F. (51.6° C.) | 49° C. | 47° C. | — | — |

| Example | 16 | 17 | 18 | 19 | 20 | 21 | 22 |
|---|---|---|---|---|---|---|---|
| LMEA | 10.03 | — | — | — | | | |
| SMEA | 9.99 | 10.03 | 10.11 | 10.02 | 10.04 | 10.05 | 10.29 |
| PEG 6000 | — | — | — | — | | | |
| PEG 8000 | 50.03 | 55.08 | 50.08 | 45.01 | 55.03 | 55.0 | 55.06 |
| propylene glycol | — | — | — | — | | | |
| dipropylene glycol | 5.11 | 5.04 | 5.11 | 5.02 | 5.12 | 5.03 | 5.05 |
| Lutensol AT 55 | 10.22 | 10.02 | 10.07 | 10.0 | 11.2 | 10.05 | 10.14 |
| Daclor 70-3-23AL | 13.05 | 10.0 | 9.97 | 9.96 | 10.07 | 9.98 | 10.12 |
| Ufaryl DL 85 | — | — | — | — | | | |
| Nansa LSS 480/H | — | — | — | — | | | |
| Crodasinic LS95 | — | 5.06 | 10.21 | 15.15 | 5.01 | 5.48 | 5.13 |
| fragrance and/or dye | 4.88 | 4.97 | 5.01 | 4.99 | — | 5.28 | 4.95 |
| peak fluid temperature | 100° C. | 125° C. | 125° C. | 130° C. | 100° C. | 120° C. | 115° C. |
| pouring temperature | 77° C. | 80° C. | 80° C. | 82° C. | 81° C. | 82° C. | 82° C. |

| Example | 23 | 24 | 25 | 26 | 27 | 28 | 29 | 30 |
|---|---|---|---|---|---|---|---|---|
| LMEA | — | — | — | — | — | — | — | — |
| SMEA | 10.13 | 10.28 | 10.0 | 10.01 | 10.22 | 5.22 | 11.99 | 9.92 |
| PEG 6000 | — | — | — | — | — | — | — | — |
| PEG 8000 | 55.09 | 55.18 | 56.34 | 45.87 | 35.08 | 50.01 | 56.23 | 50.03 |
| propylene glycol | — | — | — | — | — | — | — | — |
| dipropylene glycol | 5.23 | 5.14 | 5.05 | 5.0 | 5.06 | 4.89 | 5.12 | 9.95 |
| Lutensol AT 55 | — | — | — | — | — | — | — | — |
| Daclor 70-3-23AL | 15.27 | 15.0 | 15.08 | 15.07 | 15.02 | 15.08 | 15.01 | 10.36 |
| Ufaryl DL 85 | — | — | — | — | — | — | — | — |
| Nansa LSS 480/H | — | — | — | — | — | — | — | — |
| Crodasinic LS95 | 4.98 | 5.16 | 5.12 | 5.06 | — | 9.92 | 5.12 | 10.03 |
| Ninol CMP | 10.04 | — | — | — | — | — | — | — |
| Ninol LMP | — | 10.03 | — | — | — | — | — | — |
| Ninol 96-SL | — | — | 10.17 | 21.12 | 30.16 | 15.18 | 10.65 | 10.23 |
| fragrance and/or dye | — | — | — | — | — | — | — | — |
| peak fluid temperature | 102° C. | 115° C. | 92° C. | 110° C. | 110° C. | 125° C. | 115° C. | 94° C. |
| pouring temperature | 75° C. | 90° C. | 82° C. | 77° C. | 85° C. | 88° C. | 83° C. | 80° C. |

The identity of the constituents used to form the forgoing cast solid blocks are identified more specifically on the following Table 2. The individual constituents were used "as supplied" from their respective suppliers and may constitute less than 100% wt, or 100% wt. of the named compound, as indicated on Table 1. If less than 100%, the amount of actives present in the "as supplied" material are indicated in Table 1 and 2.

TABLE 2

| | |
|---|---|
| LMEA | lauramide monoethanolamine (100% wt. actives) |
| SMEA | stearamide monoethanolamine, supplied as Monamid 972 (ex. Uniqema) (100% wt. actives) |
| PEG 6000 | polyethylene glycol polymer, avg. m.w. of 6000, supplied as Pluracol E 6000 (ex. BASF) (100% wt. actives) |
| PEG 8000 | polyethylene glycol polymer, avg. m.w. of 8000, supplied as Pluracol E 8000 (ex. BASF) (100% wt. actives) |
| propylene glycol | propylene glycol (100% wt. actives) |
| dipropylene glycol | propylene glycol (100% wt. actives) |
| Lutensol AT 55 | nonylphenol alcohol ethoxylate, avg. of 55 mols EO (ex. BASF) (100% wt. actives) |
| Daclor 70-3-23AL | primary alcohol $C_{12}$-$C_{13}$ (1) ethoxylate, sulfate, sodium salt (100% wt. actives) |
| Ufaryl DL 85 | linear sodium benzene sulfonate (80% wt. actives) |
| Nansa LSS 480/H | $C_{14}/C_{16}$ olefin sulfonate, sodium salt (80% wt. actives) |
| Crodasinic LS95 | sodium lauroyl sarcosinate (95% wt. actives) |

TABLE 2-continued

| | |
|---|---|
| Ninol CMP | coconut monoethanolamide (100% wt. actives) (ex. Stepan Co.) |
| Ninol LMP | lauryl/myrsityl monoethanolamide (100% wt. actives) (ex. Stepan Co.) |
| Ninol 96-SL | lauryl diethanolamide (100% wt. actives) (ex. Stepan Co.) |
| fragrance and/or dye | fragrances are proprietary compositions of its respective supplier, and/or inorganic dyes dispersible in remaining constituents |

Each of the foregoing compositions described on Table 1 were formed into pourable and pumpable fluid compositions by admixing the initial constituents under stirring in an laboratory beaker and gently heating (a temperature rise of not more than 3° C.-10° C./minute from an initial room temperature of approx. 20° C.) until a desired "peak fluid temperature" was reached, and subsequently the fluid compositions were allowed to cool at room temperature to a reduced "pouring temperature" where aliquots of the fluid compositions were poured into either mold cavities, or trays having a shaped cavity within which was present a part of hanger and the plate of a hanger. The compositions were permitted to continue cooling at room temperature until it was observed that the compositions had formed into cast solid blocks, and the cast solid blocks were at room temperature. Thereafter, the cast solid blocks and hangers were removed from the mold or tray cavities. The "peak fluid temperature" and "pouring temperature" for each composition is indicated on Table 1.

It is to be understood that further cooling may per permitted and practiced, whereby the cast solid blocks and hangers may be permitted to cool in situ within the mold cavities, or trays to room temperature or even lesser temperatures before being removed, especially wherein the mold or tray cavity is provided by a preformed blister, such as is may be used in packaging the product cageless lavatory dispensing device for sale to the ultimate product consumer.

Lifespan Testing:

Certain of the foregoing example compositions were subjected to service life testing to evaluate cast solid block compositions used as ITB cageless lavatory devices. In accordance with the tests, ITB cageless lavatory devices were produced in accordance with the foregoing discussion in the specification wherein a mass of the cast solid block compositions were produced, and poured into molds containing a plate of a hanger generally in accordance with that illustrated in FIG. 7 was provided such that the plate of the hanger was fully immersed and enrobed by the cast solid block formed, which resulted in a cageless lavatory dispensing device generally in accordance with that illustrated in FIG. 22.

In accordance with the test samples ITB cageless lavatory devices were supplied to a toilet, either to a "Remo" model toilet bowl, (ex. Shires Co., Ireland), or an "Alto" model toilet bowl (ex. Ideal Standard Co, UK). The placement of the ITB device varied but once positioned prior to the test was not moved until the test was concluded. The test was performed over a number of successive days, and all testing was performed at approximately room temperature (19-22° C.). In certain tests, replicates of a single cast block composition may have been used, and are indicated. Each of the toilets were periodically and automatically flushed by a machine-controlled device which operated the toilets to flush 24 times daily at averaged time intervals of 60 minutes between flushes. Periodically each of the ITB cageless lavatory devices were removed, dried if necessary by gently patting the cast solid block and hanger with an absorbent paper towel, weighed, and then replaced in their prior position suspended from the rim of a toilet bowl. In this manner, the loss of the mass of essentially dry cast solid blocks were evaluated at regular intervals. The results of the test are indicated on the following Table.

TABLE 3A

| tested in "Alto" model toilet bowl | | | | | |
|---|---|---|---|---|---|
| Example Composition/ Replicate # | Initial mass of cast solid block (grams) | mass of cast solid block (grams) following 38 flushes | mass of cast solid block (grams) following 79 flushes | mass of cast solid block (grams) following 129 flushes | mass of cast solid block (grams) following 162 flushes |
| Ex. 1/(I) | 30.98 | 24.59 | 19.07 | 12.48 | 8.97 |
| Ex. 1/(II) | 30.09 | 25.92 | 18.98 | 10.56 | 3.77 |
| Ex. 2/(I) | 27.59 | 22.06 | 13.94 | 4.95 | —* |
| Ex. 2/(II) | 27.66 | 21.16 | 11.66 | 4.54 | — |

*"—" indicates that no cast solid block composition was observed to remain on the hanger During the test and following the conclusion of the test, no breaking off of the cast solid block compositions were observed, demonstrating surprisingly effective adhesion of the compositions to the plate notwithstanding multiple flush cycles wherein flowing water delivered from the rim of the toilet impinging directly on the plate and the respective cast solid block compositions. The compositions also delivered an effective amount of the surfactants present in the cast solid blocks as evidenced by the formation of bubbles or foam at the waterline of the toilet bowl following a flush cycle.

A further test was performed to evaluate the product lifespan of cageless lavatory dispensing devices utilizing further example compositions which were used to form further cageless lavatory dispensing device generally in accordance with that illustrated in FIG. 22. The process for the manufacture of the further devices, and the process for testing said devices is as described previously.

TABLE 3B

| tested in "Remo" model toilet bowl | | | | | |
|---|---|---|---|---|---|
| Example Composition/ Replicate # | Initial mass of cast solid block (grams) | mass of cast solid block (grams) following 39 flushes | mass of cast solid block (grams) following 89 flushes | mass of cast solid block (grams) following 122 flushes | mass of cast solid block (grams) following 197 flushes |
| Ex. 3/(I) | 30.55 | 19.66 | 8.31 | 6.44 | — |
| Ex. 3/(II) | 29.59 | 15.25 | 5.68 | —* | — |
| Ex. 4/(I) | 27.35 | 10.71 | 4.16 | — | — |
| Ex. 4/(II) | 27.65 | 12.8 | 3.93 | — | — |
| Ex. 5/(I) | 27.79 | 26.88 | 25.46 | 25.39 | 19.97 |
| Ex. 5/(II) | 29.39 | 29.18 | 28.02 | 28.19 | 18.55 |

*"—" indicates that no cast solid block composition was observed to remain on the hanger A still further test was performed to evaluate the product lifespan of cageless lavatory dispensing devices utilizing further example compositions which were used to form further cageless lavatory dispensing device generally in accordance with that illustrated in FIG. 22. The process for the manufacture of the further devices, and the process for testing said devices is as described previously.

TABLE 3C

| tested in "Remo" model toilet bowl | | | | |
|---|---|---|---|---|
| Example Composition/ Replicate # | Initial mass of cast solid block (grams) | mass of cast solid block (grams) following 69 flushes | mass of cast solid block (grams) following 101 flushes | mass of cast solid block (grams) following 175 flushes |
| Ex. 6/(I) | 28.22 | 19.49 | 14.56 | 7.34 |
| Ex. 6/(II) | 29.19 | 10.63 | 6.07 | —* |
| Ex. 7/(I) | 26.76 | 25.09 | 16.01 | 3.96 |
| Ex. 7/(II) | 27.88 | 26.98 | 21.80 | — |
| Ex. 8/(I) | 28.76 | 14.72 | 10.68 | 4.97 |
| Ex. 8/(II) | 31.36 | 15.93 | 11.09 | — |

*"—" indicates that no cast solid block composition was observed to remain on the hanger A yet further test was performed to evaluate the product lifespan of cageless lavatory dispensing devices utilizing further example compositions which were used to form further cageless lavatory dispensing device generally in accordance with that illustrated in FIG. 22. The process for the manufacture of the further devices, and the process for testing said devices is as described previously.

TABLE 3D

| tested in "Alto" model toilet bowl | | | | |
|---|---|---|---|---|
| Example Composition/ Replicate # | Initial mass of cast solid block (grams) | mass of cast solid block (grams) following 50 flushes | mass of cast solid block (grams) following 83 flushes | mass of cast solid block (grams) following 158 flushes |
| Ex. 9/(I) | 28.45 | 25.73 | 21.4 | 8.58 |
| Ex. 10/(I) | 30.10 | 29.24 | 26.05 | 5.36 |
| Ex. 11/(I) | 27.83 | 10.63 | 3.82 | —* |

*"—" indicates that no cast solid block composition was observed to remain on the hanger A still further test was performed to evaluate the product lifespan of cageless lavatory dispensing devices utilizing further example compositions which were used to form further cageless lavatory dispensing device generally in accordance with that illustrated in FIG. 22. The process for the manufacture of the further devices, and the process for testing said devices is as described previously.

TABLE 3E

| tested in "Remo" model toilet bowl | | | | |
|---|---|---|---|---|
| Example Composition/ Replicate # | Initial mass of cast solid block (grams) | mass of cast solid block (grams) following 62 flushes | mass of cast solid block (grams) following 115 flushes | mass of cast solid block (grams) following 183 flushes |
| Ex. 12/(I) | 28.63 | 19.26 | 6.24 | 4.88 |
| Ex. 12/(II) | 28.56 | 22.14 | 12.06 | 4.94 |
| Ex. 13/(I) | 29.26 | 27.07 | 7.33 | 4.49 |
| Ex. 13/(II) | 29.39 | 17.77 | 9.12 | 6.84 |

During the foregoing tests and following their conclusion, no breaking off of the cast solid block compositions were observed, demonstrating surprisingly effective adhesion of the compositions to the plate notwithstanding multiple flush cycles wherein flowing water delivered from the rim of the toilet impinging directly on the plate and the respective compositions. The compositions also delivered an effective amount of the surfactants present in the blocks as evidenced by the formation of bubbles or foam at the waterline of the toilet bowl following a flush cycle.

Perceived disparities in the rate of dissolution of the tested sample devices having the same chemical composition of the cast solid block at like numbers of flushes may often attributed to the placement of the sample with respect to specific positions on the rim of the toilet bowl. Such is not considered to be a detriment, but rather permits the consumer to selectively place the ITB cageless lavatory dispensing devices to provide a degree of control over the useful life of the block, and upon the degree of foaming which is desired following individual flushes of the toilet bowl.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A cageless lavatory dispensing device comprising a hanger having a hook end adapted to be suspended from a part of a sanitary appliance and a cast solid block comprising at least one chemical agent adapted to be suspended within the interior of the sanitary appliance wherein the cast solid block comprises:

35-70% wt., of one or more oxyalkylenated compounds, which are high molecular weight glycol polymers having molecular weights of from 500 to 35000;

a detersive surfactant selected from one or more of non-ionic surfactants, anionic surfactants based on branched alkyl anionic surfactants and/or anionic surfactants based on sarcosinate surfactants;

0.1% wt.-25% wt. of one or more fatty alkanolamides; and,

–0% to 40% wt. further additive constituents selected from: further surfactants, fillers, binders, fragrances, processing aids, bleaches, and sanitizing compositions.

2. The cageless lavatory dispensing device according to claim 1 which comprises a hanger having a hook end, a stalk depending therefrom and a plate depending from the stalk.

3. The cageless lavatory dispensing device according to claim 1 which comprises a hanger having a hook end, a stalk depending therefrom which includes a peak section and a plate depending from the stalk.

4. The cageless lavatory dispensing device according to claim 2 wherein the cast solid block composition enrobes or encases part of the hanger.

5. The cageless lavatory dispensing device according to claim 4 wherein the cast solid block composition enrobes or encases the plate.

6. The cageless lavatory dispensing device according to claim 1, wherein the device further includes an air treatment dispenser.

7. The cageless lavatory dispensing device according to claim 1, wherein the cast solid block composition comprises one or more chemical constituents such that when the block is immersed, rinsed or washed with water, said chemical constituents are eluted or dissolved into said water and forms a treatment composition which provides a cleaning and/or sanitizing and/or disinfecting benefit to the toilet or other sanitary appliance being treated with the treatment composition.

8. The cageless lavatory dispensing device according to claim 7 wherein the cast solid block comprises at least one surfactant.

9. A process for delivering a treatment composition to a sanitary appliance, preferably, to the interior of a toilet bowl, which process comprises:

providing the cageless lavatory dispensing device according to claim 1, suspending the said cast solid block within the sanitary appliance, and, periodically flushing water onto the cast solid block to elute at least one chemical constituent to form a treatment composition with said water which treatment composition provides a cleaning and/or sanitizing and/or disinfecting benefit to the sanitary appliance.

10. A process for delivering a treatment composition to a sanitary appliance, preferably, to the interior of a toilet bowl, which process comprises:

providing the cageless lavatory dispensing device according to claim 8, suspending the said cast solid block within the sanitary appliance, and, periodically flushing water onto the exterior of the cast solid block to elute at least one chemical constituent to form a treatment composition with said water which treatment composition provides a cleaning and/or sanitizing and/or disinfecting benefit to the sanitary appliance.

11. The cageless lavatory dispensing cageless lavatory dispensing device according to claim 1, wherein the cast solid block is cast from one or more fluidified chemical constituents, and subsequently solidified.

12. The cageless lavatory dispensing cageless lavatory dispensing device according to claim 1, wherein the cast solid block comprises:

40-60% wt., of one or more high molecular weight polyalkylene glycol polymers having molecular weights of from 500 to 35000.

* * * * *